US010841678B2

(12) United States Patent
Choi et al.

(10) Patent No.: US 10,841,678 B2
(45) Date of Patent: Nov. 17, 2020

(54) SOUND GENERATOR AND DISPLAY APPARATUS

(71) Applicant: LG Display Co., Ltd., Seoul (KR)

(72) Inventors: YeongRak Choi, Paju-si (KR); KwanHo Park, Incheon (KR); HyunSu Shin, Goyang-si (KR); Sungtae Lee, Incheon (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 16/696,795

(22) Filed: Nov. 26, 2019

(65) Prior Publication Data

US 2020/0100008 A1 Mar. 26, 2020

Related U.S. Application Data

(63) Continuation of application No. 15/987,214, filed on May 23, 2018, now Pat. No. 10,531,171.

(30) Foreign Application Priority Data

May 29, 2017 (KR) ..... 10-2017-0066347

(51) Int. Cl.

| | |
|---|---|
| ***H04R 1/02*** | (2006.01) |
| *H04R 9/04* | (2006.01) |
| *H04R 1/28* | (2006.01) |
| *H04R 9/02* | (2006.01) |
| *H04R 7/04* | (2006.01) |

(52) U.S. Cl.

CPC ..... *H04R 1/028* (2013.01); *H04R 1/2888* (2013.01); *H04R 7/045* (2013.01); *H04R 9/025* (2013.01); *H04R 9/046* (2013.01); *H04R 2400/03* (2013.01); *H04R 2400/11* (2013.01); *H04R 2440/05* (2013.01); *H04R 2440/07* (2013.01); *H04R 2499/15* (2013.01)

(58) Field of Classification Search

CPC . H04R 1/028; H04R 2499/15; H04R 2400/03

USPC ..... 381/388, 333, 152

See application file for complete search history.

(56) References Cited

U.S. PATENT DOCUMENTS

| | | | | |
|---|---|---|---|---|
| 2004/0038722 | A1* | 2/2004 | Gauselmann | G07F 17/32 463/16 |
| 2007/0291976 | A1* | 12/2007 | Kajiwara | H04R 11/02 381/400 |
| 2008/0285778 | A1* | 11/2008 | Kuroda | G03B 21/565 381/152 |
| 2015/0125009 | A1 | 5/2015 | Kamitani et al. | |
| 2015/0139456 | A1 | 5/2015 | Okamura | |

FOREIGN PATENT DOCUMENTS

| | | | |
|---|---|---|---|
| CN | 1427650 | A | 7/2003 |
| CN | 101233785 | A | 7/2008 |
| CN | 103828393 | A | 5/2014 |

(Continued)

*Primary Examiner* — Melur Ramakrishnaiah

(74) *Attorney, Agent, or Firm* — Morgan, Lewis & Bockius LLP

(57) ABSTRACT

Disclosed is a display apparatus including a display panel configured to emit light, a rear structure disposed on a rear surface of the display panel, a sound generating device fixed to the rear structure and configured to vibrate the display panel, and an insulation member disposed between the display panel and the sound generating device.

38 Claims, 27 Drawing Sheets

(56) References Cited

FOREIGN PATENT DOCUMENTS

| | | | |
|---|---|---|---|
| CN | 103843367 | A | 6/2014 |
| CN | 205158206 | U | 4/2016 |
| JP | 2000-125391 | A | 4/2000 |

* cited by examiner

SOUND GENERATOR AND DISPLAY APPARATUS

CROSS REFERENCE TO RELATED APPLICATIONS

This application is a continuation application of U.S. patent application Ser. No. 15/987,214 filed on May 23, 2018, which claims the benefit of the Korean Patent Application No. 10-2017-0066347 filed on May 29, 2017, both of which are hereby incorporated by reference as if fully set forth herein.

BACKGROUND

Field of the Disclosure

Embodiments of the present disclosure relate to a display apparatus, and more particularly, to a display apparatus capable of generating sound by vibrating a display panel.

Discussion of the Related Art

With the advancement of an information-oriented society, various requirements for the display field of expressing information in accordance with an electric information signal are increasing, and thus, research is being conducted on various display devices that are thin, light, and have low power consumption.

For example, the display devices are categorized into liquid crystal display (LCD) devices, field emission display (FED) devices, organic light emitting display (OLED) devices, etc.

Among the above display devices, the LCD device may include an array substrate including a thin film transistor, an upper substrate including a color filter and/or black matrix, and a liquid crystal layer interposed between the array substrate and the upper substrate. An alignment state of the liquid crystal layer is controlled based on an electric field applied to two electrodes of a pixel region, whereby light transmittance is adjusted based on the alignment state of the liquid crystal layer, to thereby display an image.

The OLED device, which is a self-luminous display device, has advantages of low power consumption, rapid response speed, high emission efficiency, high luminance and wide viewing angle.

Generally, a display apparatus displays an image on a display panel, and an additional speaker for supplying sound has to be provided. If the speaker is provided in the display apparatus, the sound generated in the speaker advances toward a lower or rear side of the display panel instead of a front side of the display panel. Thus, the sound does not advance toward the front side of the display panel, that is, a user who watches the image displayed on the display panel so that it disrupts a user's sense of immersion.

According as the sound generated in the speaker advances toward the lower or rear side of the display panel, sound quality is deteriorated due to an interference with sound reflected on the wall or floor.

If providing the speaker includes a set apparatus such as a television, the speaker occupies a space that may cause limitations on the design and arrangement of the set apparatus.

SUMMARY

Accordingly, embodiments of the present disclosure are directed to a display apparatus that substantially obviates one or more problems due to limitations and disadvantages of the related art. Through various experiments, a display apparatus has been researched which outputs sound to a front direction of a display panel, that is, toward a user who watches an image displayed on the display panel, with improved sound quality.

An object of embodiments of the present disclosure is to provide a display apparatus capable of outputting sound to a front direction of a display panel.

Another object of embodiments of the present disclosure is to provide a display apparatus capable of preventing heat generated by an operation of a sound generating device from being transferred to a display panel.

Additional advantages and features of embodiments of the disclosure will be set forth in part in the description which follows and in part will become apparent to those having ordinary skill in the art upon examination of the following or may be learned from practice of embodiments of the disclosure. The objectives and other advantages of embodiments of the disclosure may be realized and attained by the structure particularly pointed out in the written description and claims hereof as well as the appended drawings.

To achieve these and other advantages and in accordance with the purpose of embodiments of the disclosure, as embodied and broadly described herein, there is provided a display apparatus that may include a display panel configured to emit light, a rear structure disposed on a rear surface of the display panel, a sound generating device fixed to the rear structure and configured to vibrate the display panel, and an insulation member disposed between the display panel and the sound generating device.

In another aspect, a sound generator for a display panel configured to emit light may include a sound generating device configured to vibrate the display panel, and an insulation member disposed on the sound generating device, wherein the sound generating device includes a bobbin having a hollow, the bobbin connected with the insulation member.

It is to be understood that both the foregoing general description and the following detailed description of embodiments of the present disclosure are exemplary and explanatory and are intended to provide further explanation of the disclosure as claimed.

BRIEF DESCRIPTION OF THE DRAWINGS

The accompanying drawings, which are included to provide a further understanding of embodiments of the disclosure and are incorporated in and constitute a part of this application, illustrate embodiments of the disclosure and together with the description serve to explain the principles of embodiments of the disclosure. In the drawings.

DETAILED DESCRIPTION OF THE DISCLOSURE

Figure 1A:
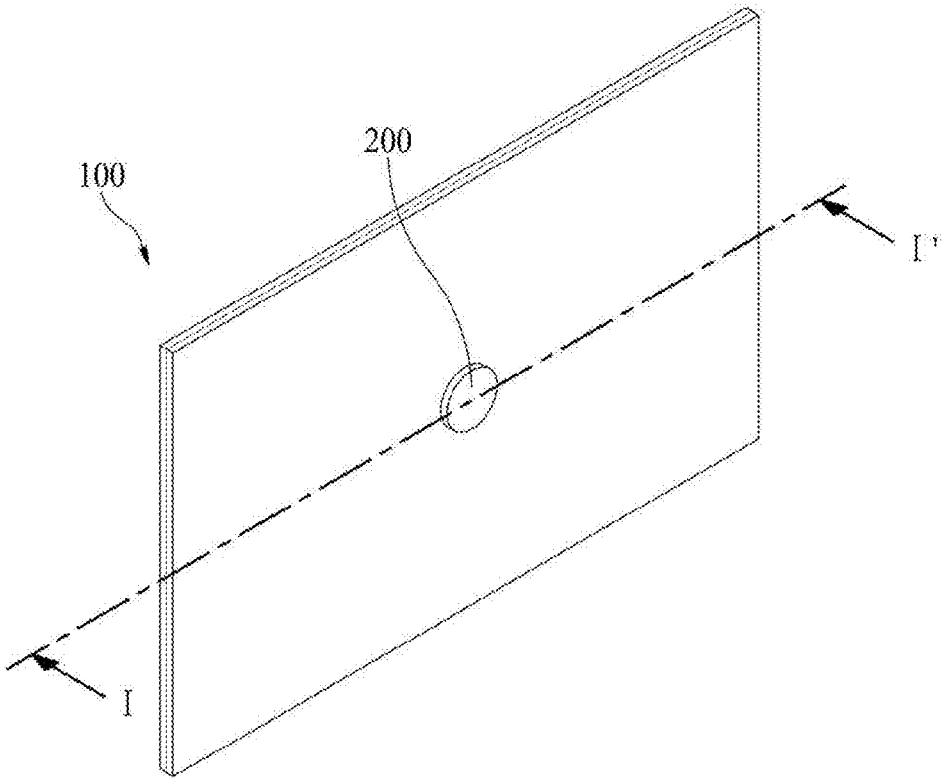
FIG. 1A illustrates a display apparatus including a sound generating device according to an example embodiment of the present disclosure.

Reference will now be made in detail to the exemplary embodiments of the present disclosure, examples of which are illustrated in the accompanying drawings. Wherever possible, the same reference numbers will be used throughout the drawings to refer to the same or like parts. Advantages and features of the present disclosure, and implementation methods thereof will be clarified through following embodiments described with reference to the accompanying drawings. The present disclosure may, however, be embodied in different forms and should not be construed as limited to the embodiments set forth herein. Rather, these embodiments are provided so that this disclosure will be thorough and complete, and will fully convey the scope of the present disclosure to those skilled in the art. Further, the present disclosure is only defined by scopes of claims.

A shape, a size, a ratio, an angle, and a number disclosed in the drawings for describing embodiments of the present disclosure are merely an example, and thus, the present disclosure is not limited to the illustrated details. Like reference numerals refer to like elements throughout. In the following description, when the detailed description of the relevant known function or configuration is determined to unnecessarily obscure the the present disclosure, the detailed description will be omitted.

In a case where "comprise", "have", and "include" described in the present specification are used, another part may be added unless "only" is used. The terms of a singular form may include plural forms unless referred to the contrary.

In construing an element, the element is construed as including an error region although there is no explicit description.

In describing a position relationship, for example, when the positional order is described as "on~", "above~", "below~", and "next~", a case which is not contact may be included unless "just" or "direct" is used.

It will be understood that, although the terms "first", "second", etc. may be used herein to describe various elements, these elements should not be limited by these terms. These terms are only used to distinguish one element from another. For example, a first element could be termed a second element, and, similarly, a second element could be termed a first element, without departing from the scope of the present disclosure.

Also, it should be understood that the term "at least one" includes all combinations related with any one item. For example, "at least one among a first element, a second element and a third element" may include all combinations of two or more elements selected from the first, second and third elements as well as each element of the first, second and third elements. Also, if it is mentioned that a first element is positioned "on or above" a second element, it should be understood that the first and second elements may be brought into contact with each other, or a third element may be interposed between the first and second elements.

Features of various embodiments of the present disclosure may be partially or overall coupled to or combined with each other, and may be variously inter-operated with each other and driven technically as those skilled in the art can sufficiently understand. The embodiments of the present disclosure may be carried out independently from each other, or may be carried out together in co-dependent relationship.

Hereinafter, a display apparatus according to an example embodiment of the present disclosure will be described in detail with reference to the accompanying drawings.

Figure 1B:
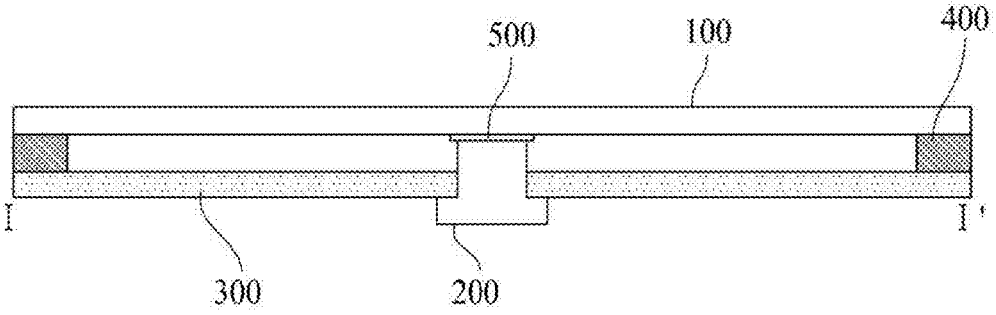
FIG. 1B is a cross sectional view along I-I' of FIG. 1A.

FIG. 1A illustrates a display apparatus including a sound generating device according to an example embodiment of the present disclosure, and FIG. 1B is a cross sectional view along I-I' of FIG. 1A.

With reference to FIGS. 1A and 1B, the display apparatus according to an example embodiment of the present disclosure may include a display panel 100, a sound generating device 200, a rear structure 300, an adhesion member 400, and an insulation member 500.

The display panel 100 is provided to display an image, and may be vibrated by the sound generating device 200 disposed at the rear of the display panel 100.

The display panel 100 according to the example embodiment of the present disclosure may be any type of display panel, for example, a liquid crystal display panel, an organic light emitting display panel, a plasma display panel, a quantum dot light emitting display panel, a micro light emitting diode display panel, and an electrophoresis display panel, but is not limited to these types. For example, the display panel 100 may be any display panel capable of being directly vibrated by the sound generating device 200 to generate sound.

In more detail, the liquid crystal display panel may include a lower substrate (or thin film transistor array substrate) comprising a plurality of pixels defined by a plurality of gate lines and a plurality of data lines, and a thin film transistor for driving each pixel, an upper substrate (or color filter array substrate) comprising a color filter and/or a black matrix, and a liquid crystal layer prepared between the lower and upper substrates and provided to control a light transmittance in accordance with the driving of each pixel.

Also, the organic light emitting display panel may include a thin film transistor array substrate comprising a plurality of pixels defined by a plurality of gate lines and a plurality of data lines, and a thin film transistor provided in each pixel so as to drive each pixel, an organic light emitting device layer prepared on the thin film transistor array substrate, and an encapsulation substrate for covering the organic light emitting device layer. In this case, the encapsulation substrate protects the thin film transistor and the organic light emitting device layer from an external shock, and prevents moisture from being permeated into the organic light emitting device layer.

The display panel used for the display apparatus according to the present disclosure is not limited to the specific type. However, in an example embodiment, the display panel used for the display apparatus may be formed of the organic light emitting display panel.

The sound generating device 200 is fixed to the rear structure 300, to thereby directly vibrate the display panel 100. The sound generating device 200, which is disposed on a rear surface of the display panel 100, vibrates the display panel 100 to thereby generate sound. The sound generating device 200 according to an example embodiment of the present disclosure may be embodied in an actuator, exciter, or transducer.

The rear structure 300 may support at least one of rear and lateral surfaces of the display panel 100. The rear structure 300 may support and fix the sound generating device 200 disposed on the rear surface of the display panel 100.

The rear structure 300 according to one embodiment of the present disclosure may be embodied in a cover bottom structure disposed on the rear surface of the display panel 100, or a middle cabinet provided to surround a lateral surface of the display panel 100, connected with the cover bottom, and provided to accommodate one edge of the display panel 100 to support the display panel 100. For example, the middle cabinet may have a cross section having a shape of "⊢". The rear structure 300 may be embodied in the cover bottom or the middle cabinet connected with the cover bottom, but is not limited to these types. For example, the rear structure 300 may be embodied in any shape capable of supporting the rear surface or lateral surface of the display panel 100.

The rear structure 300 may be a plate-shaped member of metal, glass, or plastic material over the rear surface or entire surface of the display panel 100.

The rear structure 300 according to the present disclosure may be referred to as a cover bottom, a plate bottom, a back cover, a base frame, a metal frame, a metal chassis, a chassis base, or an m-chassis. Thus, the rear structure 300 may be embodied in any type of frame or plate-shape structure which is used as a supporter for supporting the display panel 100, and is disposed at the rear of the display apparatus.

The adhesion member 400 may be disposed between an edge of the display panel 100 and an edge of the rear structure 300, to thereby adhere the display panel 100 and the rear structure 300 to each other. The adhesion member 400 according to an example embodiment of the present disclosure may be a double-sided tape or double-sided adhesion foam pad, but is not limited to these types.

The insulation member 500 is provided between the display panel 100 and the sound generating device 200, whereby the insulating member 500 limits a local temperature rise in the display panel 100 by heat generated in the sound generating device 200. For example, the insulating member 500 according to an example embodiment of the present disclosure provides an air gap between the display panel 100 and the sound generating device 200 so that it may be possible to limit the local temperature rise in the display panel 100 by heat generated in the sound generating device 200.

The insulating member 500 may be connected with the rear surface of the display panel 100 by the use of a first adhesion member. In this case, the insulation member 500 provides a sealing space between the first adhesion member and the sound generating device 200 so that it may be possible to limit the local temperature rise in the display panel 100 by heat generated in the sound generating device 200.

Because the display apparatus according to an example embodiment of the present disclosure includes the sound generating device 200 which vibrates the display panel 100 to generate sound, it may be possible to output the sound to the front direction of the display panel 100, and furthermore, to enhance a user's sense of immersion. For example, the display apparatus according to an example embodiment of the present disclosure includes the insulation member 500 for limiting the temperature rise of the display panel 100 caused by the heat generated in the sound generating device 200 so that it may be possible to prevent deterioration of picture quality in the display panel 100 by a sudden temperature change in a local area of the display panel 100 overlapped with the sound generating device 200.

Figure 2A:
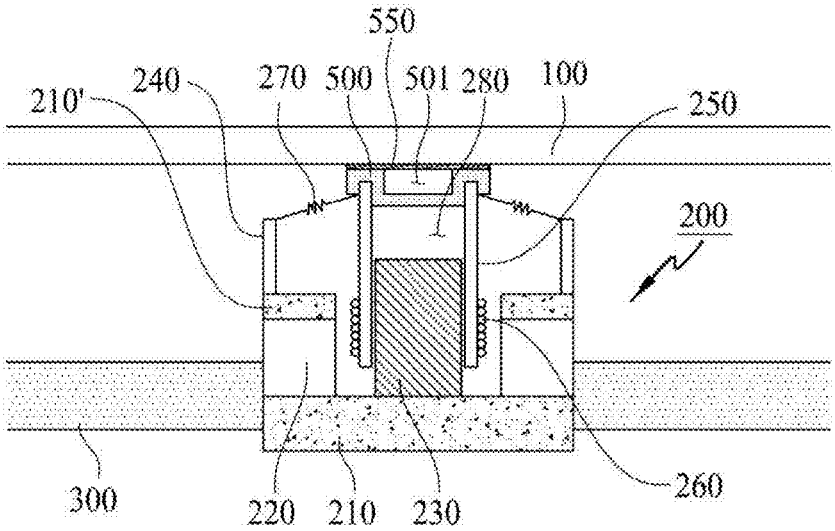
FIGS. 2A and 2B are cross sectional views illustrating the sound generating device according to an example embodiment of the present disclosure.
Figure 2B:
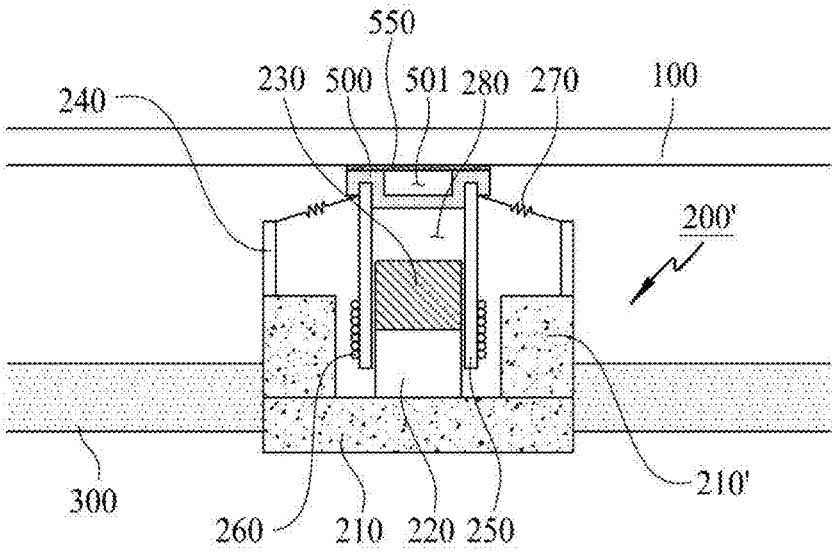

FIGS. 2A and 2B are cross sectional views illustrating the sound generating device according to an example embodiment of the present disclosure, wherein FIG. 2A illustrates a first structure of the sound generating device 200, and FIG. 2B illustrates a second structure of the sound generating device 200. In case of the first structure of the sound generating device 200, a magnet member is disposed at an external side of a coil. In case of the second structure of the sound generating device 200, a magnet member is disposed at an internal side of a coil. The first structure of the sound generating device 200 corresponds to a dynamic type or external magnetic type. The second structure of the sound generating device 200 corresponds to a micro type or internal magnetic type.

With reference to FIG. 2A, the sound generating device 200 according to an example embodiment of the present disclosure may include first and second module frames 210 and 210', a magnet member 220, a center pole 230, an external frame 240, a bobbin 250, a coil 260, and a damper 270. This structure of the sound generating device 200 may be the first structure.

The first module frame 210 is disposed at a lower end of the sound generating device 200, wherein the first module frame 210 may structurally function as a base. The second module frame 210' is disposed on the magnet member 220 provided on the first module frame 210. That is, the second module frame 210 may be provided at a predetermined interval from the first module frame 210 by the magnet member 220 interposed in-between. The first module frame 210 and the second module frame 210' may support the magnet member 220, and may fix the sound generating device 200 to the rear structure 300. Accordingly, the first module frame 210 may be fixed to a supporting hole prepared in the rear structure 300, and the magnet member 220 may be fixedly supported between the first module frame 210 and the second module frame 210'.

At least one of the first module frame 210 and the second module frame 210' according to an example embodiment of the present disclosure may be formed of a magnetic material such as iron (F). In this case, the first module frame 210 and the second module frame 210' are not limited to these terms, and the first module frame 210 and the second module frame 210' may be referred to as yokes.

The magnet member 220 is disposed along the periphery on the first module frame 210. The magnet member 220 surrounds the center pole 230 under the condition that a predetermined distance is maintained between the magnet member 220 and the center pole 230, whereby it may be possible to prepare an empty space for the center pole 230 by the magnet member 220 surrounding the center pole 230.

The magnet member 220 according to an example embodiment of the present disclosure may use a sintered magnet of barium ferrite, and the magnet member 220 may be formed of ferric oxide ($Fe_2O_3$), barium carbonate ($BaCO_3$), neodymium (Nd) magnet, strontium ferrite with improved magnetism, aluminum (Al), nickel (Ni), or alloy-casting magnet of cobalt (Co), but is not limited to these materials. For example, the neodymium magnet may be neodymium-iron-boron (Nd—Fe—B).

The center pole 230 is disposed on the center of the first module frame 210. The center pole 230 is surrounded by the magnet member 220 and the second module frame 210' disposed in the outermost periphery on the first module frame 210 under the condition that the center pole 230 is provided at a predetermined interval from the magnet member 220 and the second module frame 210', and the center pole 230 is also surrounded by the bobbin 250 adjacent to the center pole 230, whereby the center pole 230 is doubly surrounded by the bobbin 250 as well as the magnet member 220 and the second module frame 210'.

The center pole 230 may guide a reciprocating up-and-down movement of the bobbin 250. According to an example embodiment of the present disclosure, the center pole 230 may be prepared at a height appropriate for guiding the reciprocating up-and-down movement of the bobbin 250.

The center pole 230 according to an example embodiment of the present disclosure may be formed as one body with the first module frame 210. For example, the center pole 230 may be embodied in a pole piece. Also, the plurality of center poles 230 may be deposited in sequence and surrounded by the bobbin 250.

The external frame 240 extends from the periphery of an upper end of the second module frame 210' to the display panel 100. An upper end of the external frame 240 is connected with the damper 270. In this case, the external frame 240 may be one part of the second module frame 210'. In this case, the external frame 240 and the second module frame 210' may be formed as one body.

The bobbin 250 surrounds at least one part of the center pole 230. The bobbin 250 according to an example embodiment of the present disclosure may be embodied in a cylinder shape having a central hollow for the center pole 230 received therein. Also, the bobbin 250 may be formed in a ring-shaped (or cylinder-shaped) structure of a material obtained by pulp or paper, aluminum, magnesium, alloy of aluminum and magnesium, synthetic resin such as polypropylene, or polyamide-based fiber. The bobbin 250 may be reciprocally moved up-and-down by a magnetic force.

The coil 260 is wound on a lower outer area, for example, a lower outer surface of the bobbin 250, wherein the coil 260 receives a current (or voice signal) for generating sound from the external. The coil 260 according to an example embodiment of the present disclosure may be embodied in a voice coil wound on the bobbin 250. When the current is applied to the coil 260, a magnetic field is generated around the coil 260, and there is an external magnetic field formed by the magnet member 220, whereby the entire bobbin 260 is guided and moved up-and-down by the center pole 230 on the basis of Fleming's left hand rule. The up-and-down movement of the bobbin 250 vibrates the display panel 100, whereby the sound is generated by the vibration of the display panel 100, and the generated sound is output to a front direction of the display panel 100.

The damper 270 connects an upper side of the external frame 240 with an upper side of the bobbin 250. The damper 270 may be referred to as an edge. The damper 270 according to an example embodiment of the present disclosure may be formed in a wrinkled structure having elasticity. The damper 270 controls the up-and-down vibration of the bobbin 250 by contraction and relaxation movements in accordance with the up-and-down movement of the bobbin 250. That is, the up-and-down vibration of the bobbin 250 may be controlled by a restoring force of the damper 270. If the bobbin 250 vibrates to be higher or lower than a predetermined height, the bobbin 250 may be restored to its original position by the restoring force of the damper 270.

Meanwhile, the insulation member 500 is disposed on the bobbin 250, to thereby form an air gap 501 between the display panel 100 and the bobbin 250. The insulation member 500 covers a heat-emission space 280 prepared on the center pole 230 received in the hollow of the bobbin 250 so that the heat-emission space 280 is spatially separated from the display panel 100, to thereby restrict (or limit) the temperature rise of the display panel 100 caused by heat of the heat-emission space 280. That is, the insulating member 500 provides the air gap (or closed space) 501 between the display panel 100 and the heat-emission space 280. The air gap 501 reduces and/or minimizes transmission of the heat, which is generated in the heat-emission space 280 by the current applied to the coil 260 and the reciprocating up-and-down movement of the bobbin 250, to the display panel 100, to thereby restrict the temperature rise of the display panel 100. The insulating member 500 provides the air gap 501 between the display panel 100 and the heat-emission space 280 so that it may be possible to prevent the heat transfer from the heat-emission space 280 to the display panel 100, thereby preventing deterioration of picture quality in the display panel 100 by the temperature rise in the area of the display panel 100 overlapped with the sound generating device 200, and furthermore, improving luminance and emission efficiency of the display apparatus.

The insulation member 500 according to an example embodiment of the present disclosure may be adhered onto the rear surface of the display panel 100 by the use of first adhesion member 550. The first adhesion member 550 may be disposed to cover the entire confronting surface (or upper surface) of the insulation member 500 which confronts the rear surface of the display panel 100. In this case, the insulation member 500 includes the air gap (or closed space) 501 between the bobbin 250 of the sound generating device 200 and the first adhesion member 550 so that it may be possible to reduce and/or minimize the transfer of heat from the heat-emission space 280 to the display panel 100 through the use of air gap 501, to thereby restrict the temperature rise of the display panel 100.

In comparison to a direct contact between the bobbin 250 and the display panel 100 without any medium, the insulation member 500 enables the increase of a contact area between the sound generating device 200 and the display panel 100, and facilitates an attachment process between the sound generating device 200 and the display panel 100.

Also, the insulation member 500 covers the bobbin 250 to protect the bobbin 250, so that it may be possible to prevent the sound generating device 200 from being damaged by a shock applied to the sound generating device 200, which is caused by an external shock applied to the display panel 100 in addition to a vibrational force of the display panel 100.

The display apparatus may further include a first adhesion member 550 provided between the display panel 100 and the insulation member 500.

The first adhesion member 550 adheres the insulation member 500 onto the rear surface of the display panel 100. In this case, the first adhesion member 550 may be embodied as double-sided tape. In case of the first adhesion member 550 of the double-sided tape, if there is a defect in adhesion between the display panel 100 and the insulation member 500, it facilitates rework. Also, if the first adhesion member 550 is formed of the double-sided tape, its adhesion process becomes easier in comparison to the case using the adhesive resin.

With reference to FIG. 2B, the sound generating device 200 according to an example embodiment of the present disclosure may include first and second module frames 210 and 210', a magnet member 220, a center pole 230, an external frame 240, a bobbin 250, a coil 260, and a damper 270. This structure of the sound generating device 200 may be the second structure. In comparison to the first structure of the sound generating device 200, the second structure of the sound generating device 200 is different in that the position of the second module frame 210', the magnet member 220, and the center pole 230 is changed. Hereinafter, only the changed structure of the second structure will be described in detail, and a description for the same parts as those of the first structure will be omitted.

In more detail, the second module frame 210' is disposed along the periphery on the first module frame 210. The second module frame 210' according to an example embodiment of the present disclosure may be formed as one body with the first module frame 210. The second module frame 210' provides a central space for the magnet member 220 and the center pole 230, and surrounds the magnet member 220 and the center pole 230 under the condition that the second module frame 210' is provided at a predetermined interval from the magnet member 220 and the center pole 230.

The magnet member 220 is disposed on the center of the first module frame 210, and the magnet member 220 is surrounded by the second module frame 210' under the condition that the magnet member 220 is provided at a predetermined interval from the second module frame 210'. Also, the magnet member 220 is surrounded by the second module frame 210' disposed in the outermost periphery on the first module frame 210 under the condition that the magnet member 220 is provided at a predetermined interval from the second module frame 210', and the magnet member 220 is also surrounded by the bobbin 250 adjacent to the magnet member 220, whereby the magnet member 220 is doubly surrounded by the bobbin 250 as well as the second module frame 210'. In this case, the bobbin 250 is also surrounded by the second module frame 210' under the condition that the bobbin 250 is provided at a predetermined interval from the second module frame 210'.

The center pole 230 is disposed on an upper end of the magnet member 220, and is surrounded by the bobbin 250. The center pole 230 is surrounded by the second module frame 210' disposed in the outermost periphery on the first module frame 210 under the condition that the center pole 230 is provided at a predetermined interval from the second module frame 210', and the center pole 230 is also surrounded by the bobbin 250 adjacent to the center pole 230, whereby the center pole 230 is doubly surrounded by the bobbin 250 as well as the second module frame 210'. In this case, the bobbin 250 is also surrounded by the second module frame 210' under the condition that the bobbin 250 is provided at a predetermined interval from the second module frame 210'.

The center pole 230 together with the magnet member 220 may guide a reciprocating up-and-down movement of the bobbin 250. According to an example embodiment of the present disclosure, the magnet member 220 and the center pole 230 may be provided at a height appropriate for guiding the reciprocating up-and-down movement of the bobbin 250. Also, a total height of the magnet member 220 and the center pole 230 in the second structure of the sound generating device 200 may be the same as a total height of the center pole 230 in the first structure of the sound generating device 200.

In comparison to the first structure having the center pole 230 surrounded by the magnet member 220, the second structure is advantageous in that it enables the decrease of leakage flux and totally-decreased size.

The sound generating device according to example embodiments of the present disclosure is not limited to the aforementioned structures of FIGS. 2A and 2B. The sound generating device may be embodied in any shape capable of generating sound by vibrating the display panel 100.

Figure 3:
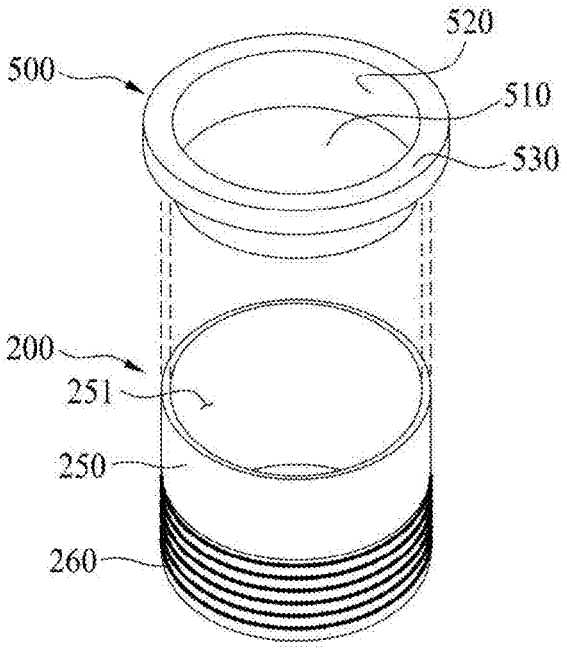
FIG. 3 is a perspective view illustrating a bobbin and an insulation member of the sound generating device according to an example embodiment of the present disclosure.
Figure 4:
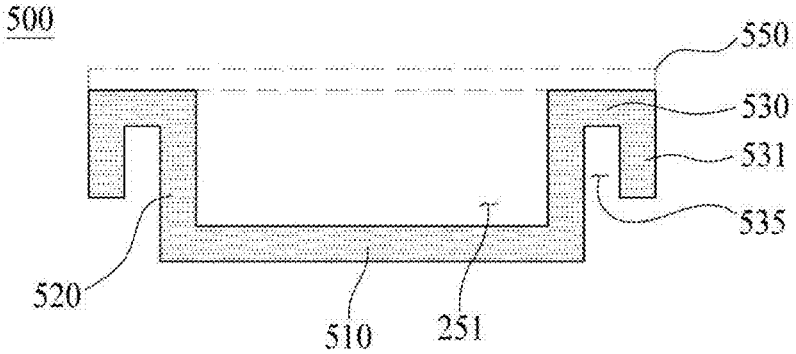
FIG. 4 is a cross sectional view illustrating the insulation member shown in FIG. 3.

FIG. 3 is a perspective view illustrating the bobbin and the insulation member of the sound generating device according to an example embodiment of the present disclosure. FIG. 4 is a cross sectional view illustrating the insulation member shown in FIG. 3.

With reference to FIGS. 3 and 4, the insulation member 500 according to an example embodiment of the present disclosure includes a central portion 510, a sidewall portion 520, and a peripheral portion 530.

The central portion 510 covers a hollow 251 of the bobbin 250, and the central portion 510 is disposed at a predetermined interval from the rear surface of the display panel 100. That is, the central portion 510 is disposed between the bobbin 250 and the display panel 100 so that it may be possible to prevent the heat of the heat-emission space formed in the hollow 251 of the bobbin 250 from being directly transferred to the rear surface of the display panel 100. Accordingly, the central portion 510 may be referred to as a heat-blocking member.

The central portion 510 according to an example embodiment of the present disclosure is inserted into the hollow 251 of the bobbin 250 under the condition that the central portion 510 is provided at a predetermined interval from one end of the bobbin 250, that is, an upper surface of the bobbin 250, to thereby cover the hollow 251 of the bobbin 250. In this case, the central portion 510 may not be inserted into the hollow 251 of the bobbin 250. In order to decrease a thickness of the display apparatus, the central portion 510 is inserted into the hollow 251 of the bobbin 250.

The sidewall portion 520 supports an edge of the central portion 510. That is, the sidewall portion 520 is vertically connected with the edge of the central portion 510 so that the sidewall portion 520 has a predetermined height. Accordingly, the sidewall portion 520 and the central portion 510 may be formed in a cross section having a shape of "⌊⌋" so that an upper portion of the central portion 510 confronting the rear surface of the display panel 100 is surrounded by the sidewall portion 520. In this case, a space provided on the central portion 510 by the sidewall portion 520 surrounding the central portion 510 may be the aforementioned air gap. With respect to a thickness direction of the display panel 100, a height of the air gap 251 is determined by the height of the sidewall portion 520, which may be preset based on an amount of heat generated in accordance with an operation of the sound generating device 200.

The sidewall portion 520 is inserted into the hollow 251 of the bobbin 250 included in the sound generating device 200 so that the central portion 510 is provided at a predetermined interval from the rear surface of the display panel 100. In this case, the sidewall portion 520 may not be inserted into the hollow 251 of the bobbin 250. In order to decrease a thickness of the display apparatus, the sidewall portion 520 is inserted into the hollow 251 of the bobbin 250, for example.

The peripheral portion 530 is connected with one end of the bobbin 250, that is, the upper surface of the bobbin 250, to thereby support the sidewall portion 520. The peripheral portion 530 and the bobbin 250 may have the same shape, wherein the peripheral portion 530 covers the entire upper surface of the bobbin 250 except the hollow 251 of the bobbin 250. That is, the central portion 530 may have a ring-shaped or band-shaped type having an opening overlapped with the central portion 510. Accordingly, the sidewall portion 520 and the peripheral portion 530 may be formed in a cross section having a shape of "][". The peripheral portion 530 may be connected with the rear surface of the display panel 100 by the use of first adhesion member 550.

The insulation member 500 according to an example embodiment of the present disclosure may further include a skirt portion 531, and a bobbin insertion groove 535.

The skirt portion 531 is vertically connected with a rear edge of the peripheral portion 530 while being parallel to the sidewall portion 520. In this case, the skirt portion 531 is parallel to the sidewall portion 520 under the condition that the bobbin insertion groove 535 is provided between the skirt portion 531 and the sidewall portion 520. A height of the skirt portion 531 may be the same as or smaller than a height of the sidewall portion 520. The height of the skirt portion 531 may be higher than the height of the sidewall portion 520. However, when the sidewall portion 520 is externally exposed, a connection between the insulation member 500 and the bobbin 250 becomes easier. For this reason, the height of the skirt portion 531 may be the same as or smaller than the height of the sidewall portion 520.

The bobbin insertion groove 535 is a space for receiving one end of the bobbin 250 therein, wherein the bobbin insertion groove 535 is provided between the skirt portion 531 and the sidewall portion 520. A width of the bobbin insertion groove 535 may be set to be more than a thickness of the bobbin 250. That is, the width of the bobbin insertion groove 535 corresponds to an interval between the skirt portion 531 and the sidewall portion 520 which are parallel to each other, wherein the width of the bobbin insertion groove 535 may be set to be more than the thickness of the bobbin 250.

The insulation member 500 according to an example embodiment of the present disclosure may be embodied in a shape of injection-mold or metallic patterned mold. The insulation member 500 according to an example embodiment of the present disclosure may be formed of rubber, silicon, fiber reinforced plastics, complex resin including fiber reinforced plastics, or metal material, which may prevent heat caused by the driving of the sound generating device 200. For example, the fiber reinforced plastics may be one among carbon fiber reinforced plastics, glass fiber reinforced plastics, and graphite fiver reinforced plastics, or may be their combination, but are not limited to these materials. Among the aforementioned materials, the carbon fiber has a small thermal expansion coefficient so that it has good stability. Also, the carbon fiber has good electroconductivity, high corrosion resistance, good vibration attenuation properties, and good X-ray transmission properties. Also, the glass fiber has lightness in weight, good durability, good shock resistance, and good durability of abrasion. In addition, the glass fiber is anti-rust, has a low coefficient of heat conduction, and has easy processibility. For example, the metal material may be aluminum (Al), but is not limited to this material.

Figure 5A:
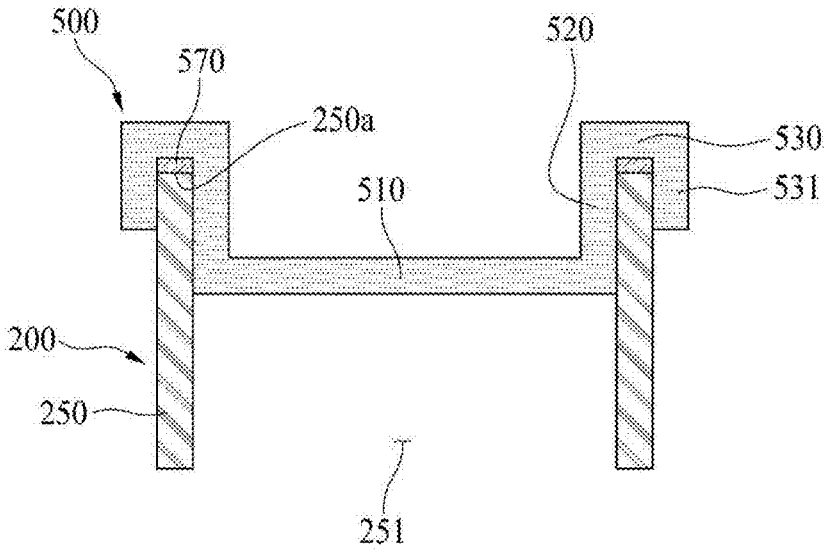
FIGS. 5A and 5B are cross sectional views illustrating a connection structure between the insulation member and the bobbin shown in FIG. 3.
Figure 5B:
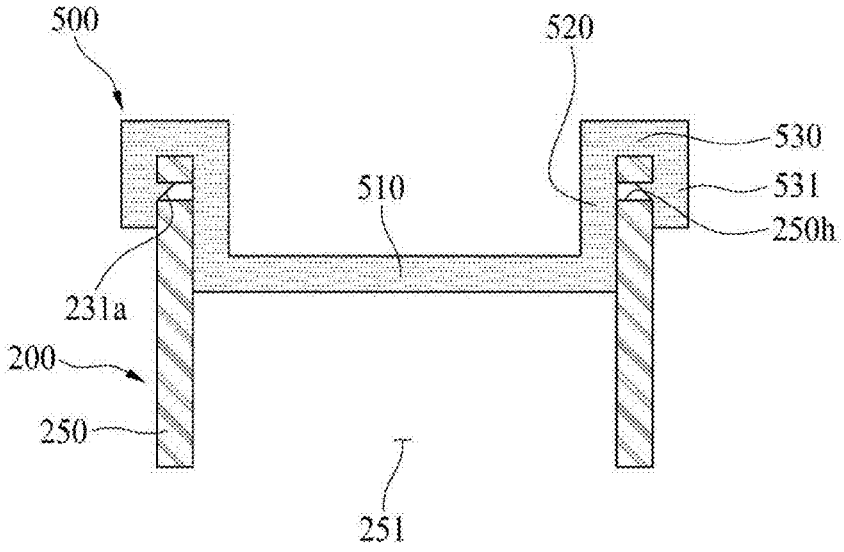

FIGS. 5A and 5B are cross sectional views illustrating the connection structure between the insulation member and the bobbin shown in FIG. 3.

With reference to FIG. 5A in connection with FIG. 4, the insulating member 500 according to an example embodiment of the present disclosure may be connected with the bobbin 250 by the use of second adhesion member 570.

The second adhesion member 570 is connected with an upper end 250*a* of the bobbin 250, and also connected with a rear surface of the peripheral portion 520 provided in the insulation member 500. That is, the second adhesion member 570 connected with the upper end 250*a* of the bobbin 250 is connected with the rear surface of the peripheral portion 520 confronting the upper end 250*a* of the bobbin 250 inserted into the bobbin insertion groove 535 of the insulation member 500. The second adhesion member 570 according to an example embodiment of the present disclosure may be epoxy resin, acryl resin, or double-sided tape. In this case, if the second adhesion member 570 is the double-sided tape, it may be difficult to form the second adhesion member 570 in the upper end 250*a* of the bobbin 250 due to the small thickness of the bobbin 250. For an easy connection process between the second adhesion member 570 and the bobbin 250, the second adhesion member 570 is formed of epoxy resin or acryl resin.

With reference to FIG. 5B in connection with FIG. 4, the insulation member 500 and the bobbin 250 may be connected with each other by the use of a connection member of a mechanical structure. To this end, the display apparatus according to an example embodiment of the present disclosure may further include a first connection member 250*h* and a second connection member 231*a*.

The first connection member 250*h* may include at least two connection holes provided in the bobbin 250 surrounded by the sidewall portion 520 of the insulation member 500. The at least two connection holes are symmetric to each other with respect to a central point of the bobbin 250 along a width direction of the bobbin 250. Each of the at least two connection holes penetrates through the bobbin 250 along the width direction of the bobbin 250. For example, each of the at least two connection holes has a rectangular shape.

The second connection member 231*a* may include at least two connection protrusions to be connected with the connection holes in a one-to-one correspondence. At least two connection protrusions, which protrude from the sidewall portion 520 or skirt portion 531 of the insulation member 500, are respectively inserted into the connection holes of the first connection member 250*h*. The at least two connection protrusions may protrude from the skirt portion 531 or sidewall portion 520, wherein each connection protrusion has a triangular-shaped cross section having a stepped portion and an inclined surface.

Each of the at least two connection protrusions is inserted into the corresponding connection hole, to thereby connect the insulation member 500 and the bobbin 250 with each other. In this case, a movement of the bobbin 250 to a vibration direction is restricted by the connection hole of the first connection member 250*h*, whereby the stepped portion provided in the connection protrusion of the second connection member 231*a* prevents detachment or separation of the insulation member 500 from the bobbin 250 in accordance with the vibration of the bobbin 250, and the insulation member 500 is moved to the lower side in accordance with the lower vibration of the bobbin 250.

Selectively, the first connection member 250*h* may include the hole, groove, or protrusion provided in the bobbin 250, and the second connection member 231*a* may include the protrusion, groove, or hole provided in the sidewall portion 520 or skirt portion 531 of the insulation member 500 to be connected with the first connection member 250*h*.

In this example embodiment of the present disclosure, when the insulation member 500 may be detachably connected with the bobbin 250 by the use of connection members 250*h* and 231*a*, the insulation member 500 may be attached to or detached from the bobbin 250. Thus, it facilitates a replacement work of the insulation member 500, and also enables reuse of the insulation member 500 for the replacement of the bobbin 250.

Figure 6A:
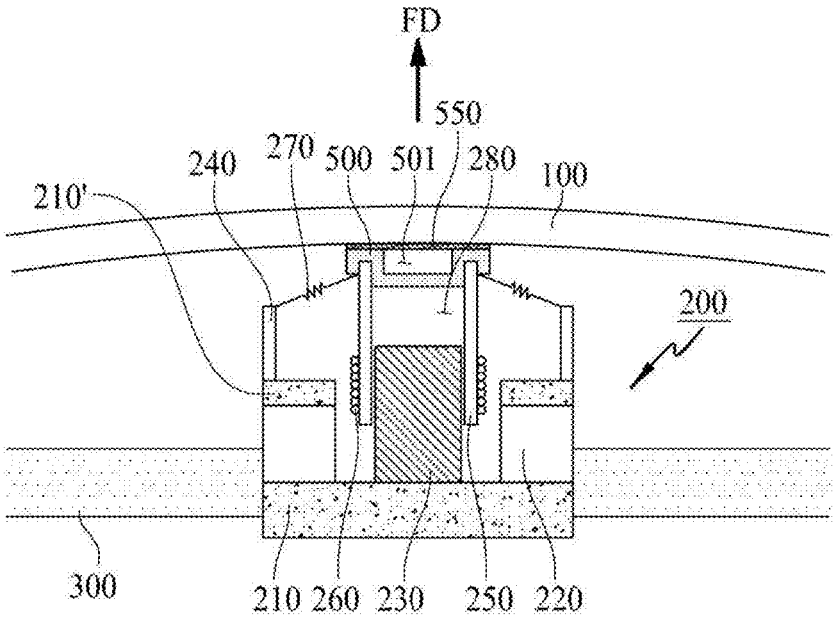
FIGS. 6A and 6B illustrate a sound generating method of the display apparatus according to an example embodiment of the present disclosure.
Figure 6B:
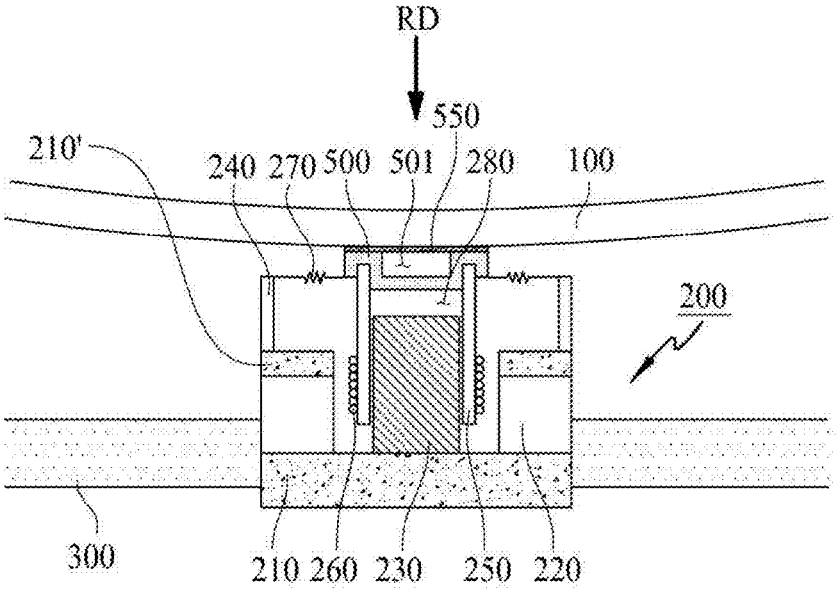

FIGS. 6A and 6B illustrate a sound generating method of the display apparatus according to an example embodiment of the present disclosure, and show the sound generating method by the sound generating device of the first structure.

With reference to FIG. 6A, if the current for generating the sound is applied to the coil 260, the center pole 230 becomes the N pole, and the second module frame 210' becomes the S pole, whereby the external magnetic field is generated inside the coil 260 (the space provided with the center pole 230 therein). In this case, the center pole 230 is formed as one body with the first module frame 210, and is connected with the lower surface of the magnet member 220, whereby the center pole 230 becomes the N pole. Also, the second module frame 210' is connected with the upper surface of the magnet member 220, whereby the second module frame 210' becomes the S pole.

Also, if the current for generating the sound is applied to the coil 260, the applied magnetic field is generated around the coil 260, and the bobbin 250 may be moved to the front direction (FD) of the display panel 100 by the force generated from the applied magnetic field and the external magnetic field. In more detail, if the current is applied to the coil 260, the applied magnetic field is formed around the coil 260, and the external magnetic field is formed around the coil 260 by the magnet member 220, whereby the entire bobbin 250 is guided by the center pole 230 based on Fleming's left hand rule, and is moved to the front direction (FD) of the display panel 100.

According as one surface of the bobbin 250 is in contact with the rear surface of the display panel 100 by the use of insulation member 500 and first adhesion member 550, the display panel 100 is vibrated in the front direction (FD) according to whether or not the current is applied to the coil 260, and the sound wave (or sound) is generated by the vibration of the display panel 100.

With reference to FIG. 6B, if the current for vibrating the bobbin 250 to the upper side is stopped or its opposite directional current is applied, a force of moving the bobbin 250 to a rear direction (RD) of the display panel 100 is generated based on principles of FIG. 6A, whereby the display panel 100 is vibrated in the rear direction (RD) in accordance with the movement of the bobbin 250, and the sound wave (or sound) is generated by the vibration of the display panel 100.

Accordingly, the display panel 100 may be vibrated in the front direction (FD) or rear direction (RD) in accordance with the direction and level of the current applied to the coil 260. The sound wave (or sound) generated by the vibration of the display panel 100 is output to the front direction (FD) of the display panel 100.

Except that the entire bobbin 250 is guided and moved based on Fleming's left hand rule by the external magnetic field formed inside the coil 260 by the use of magnet member 220 and the applied magnetic field formed around the coil 260 in accordance with the direction of the current applied to the coil 260, a sound generating method using the sound generating device of the second structure according to an example embodiment of the present disclosure is similar to the sound generating method using the sound generating device of the first structure according to an example embodiment of the present disclosure, whereby a detailed description for the sound generating method using the sound generating device of the second structure according to an example embodiment of the present disclosure will be omitted.

Figure 7:
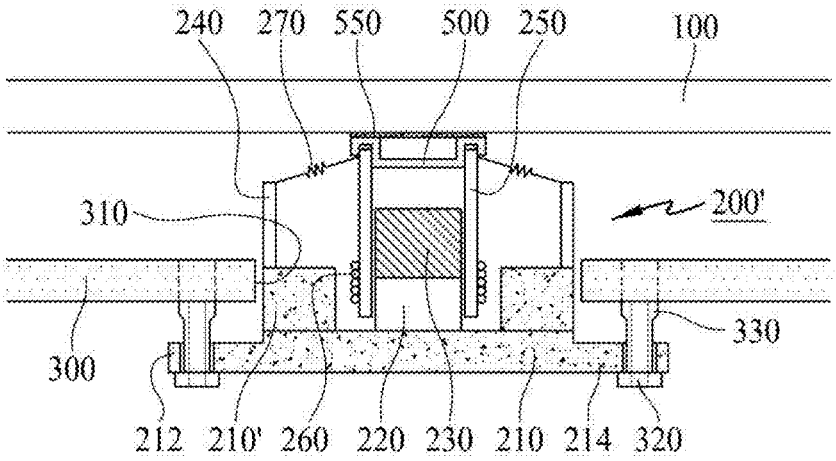
FIG. 7 illustrates a connection structure between a sound generating device and a rear structure in the display apparatus according to an example embodiment of the present disclosure.

FIG. 7 illustrates a connection structure between the sound generating device and the rear structure in the display apparatus according to an example embodiment of the present disclosure, wherein the sound generating device of the display apparatus according to an example embodiment of the present disclosure may have the first structure or second structure. Hereinafter, it is assumed that the sound generating device has the second structure.

With reference to FIG. 7, the sound generating device 200' according to an example embodiment of the present disclosure may further include an expanded-diameter portion 214 formed as one body with the first module frame 210.

The expanded-diameter portion 214 may protrude from one side of the first module frame 210, wherein a diameter of the expanded-diameter portion 214 is larger than a diameter of the first module frame 210. The expanded-diameter portion 214 may have a ring shape.

The expanded-diameter portion 214 may further include an extending portion 212 for fixing the sound generating device 200' to the rear structure 300. The extending portion 212 may include a hole, and a screw 320 penetrating through the hole is coupled with a nut 330. The nut 330 is fixed to the rear structure 300, and the sound generating device 200' is connected with the rear structure 300 by the use of screw 320. For example, the nut 330 may be embodied in a self-clinching nut. The self-clinching nut may include a PEM® nut as one type.

If the nut 330 is embodied as a self-clinching nut such as a PEM® nut, the vibration generated in the sound generating device 200' is partially absorbed in the nut 330, whereby the vibration transferred to the rear structure 300 may be reduced.

Figure 8:
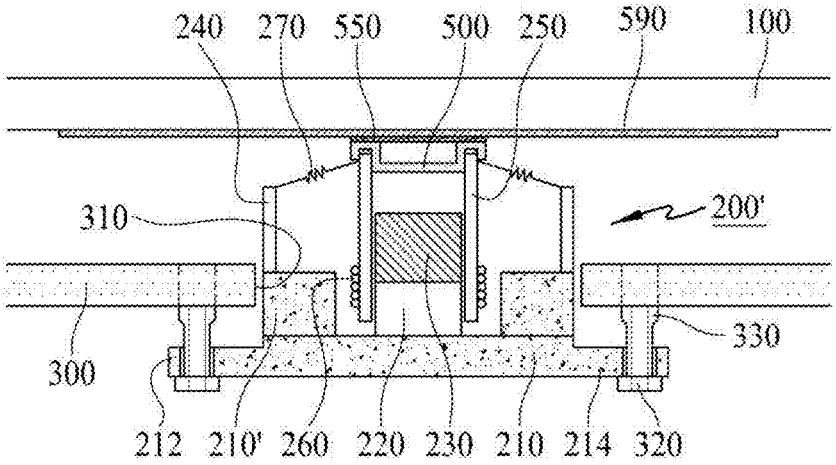
FIG. 8 illustrates a heat-radiation member of the display apparatus according to an example embodiment of the present disclosure.

FIG. 8 illustrates a heat-radiation member of the display apparatus according to an example embodiment of the present disclosure, wherein the heat-radiation member is additionally provided between the display panel and the insulation member of the display apparatus shown in FIG. 7. Hereinafter, only the heat-radiation member will be described in detail.

With reference to FIG. 8, the heat-radiation member 590 according to the embodiment of the present disclosure is provided between the display panel 100 and the insulation member 500 so that the heat transmitted through the insulation member 500 is diffused and radiated. That is, the heat-radiation member 590 is used as a heat sink for radiating the heat generated for the operation of the sound generating device 200', to thereby prevent efficiency of the display panel 100 from being deteriorated. In more detail, the heat generated for the operation of the sound generating device 200' is firstly blocked by the heat-radiation member 500, and the heat transmitted to the display panel 100 through the insulation member 500 is diffused to a large area so that it may be possible to prevent deterioration of picture quality in the display panel 100 caused by a sudden temperature change in a local area of the display panel 100 overlapped with the sound generating device 200'.

The heat-radiation member 590 according to an example embodiment of the present disclosure may be embodied in a polygonal or circular plate shape having a uniform thickness, wherein a size of the heat-radiation member 590 is relatively larger than a size of the sound generating device 200'. The heat-radiation member 590 may be attached to the rear surface of the display panel 100 overlapped with the sound generating device 200', or the entire rear surface of the display panel 100. For example, the heat-radiation member 590 may be embodied in a heat-radiation sheet or heat-radiation tape of a metal material with high thermal conductivity, for example, aluminum (Al), copper (Cu), argentums (Ag), and their alloys.

Additionally, the heat-radiation member 590 may include a plurality of discharge holes. The plurality of discharge holes serve as a passage for discharging bubbles generated inside an adhesive layer used for an adhering process between the heat-radiation member 590 and the rear surface of the display panel 100 and/or bubbles generated between the rear surface of the display panel 100 and the adhesion layer.

Figure 9A:
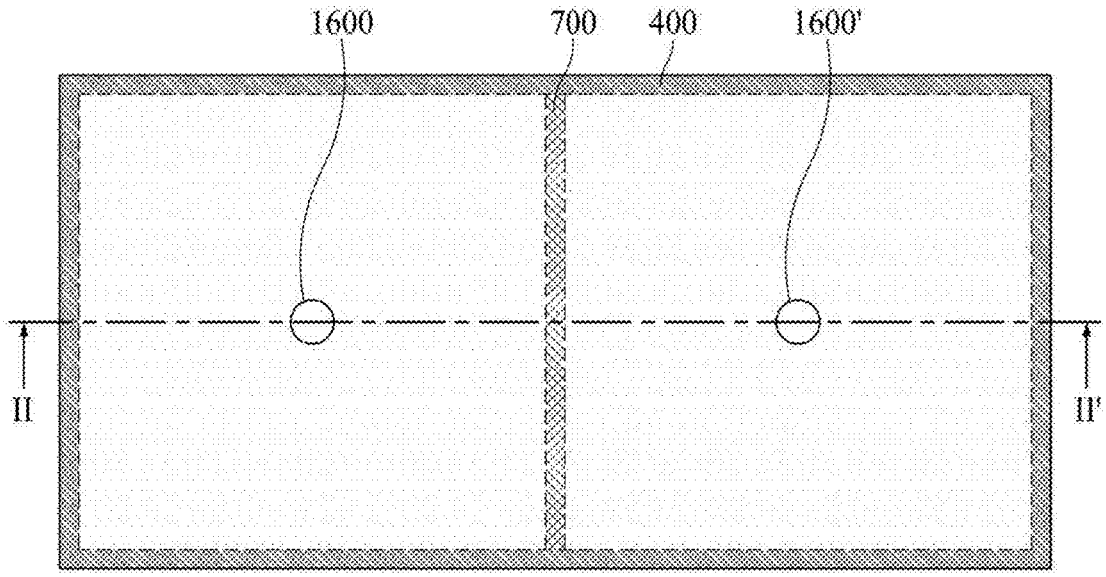
FIGS. 9A to 9C illustrate an example of the sound generating device and partition in the display apparatus according to the present disclosure.
Figure 9B:
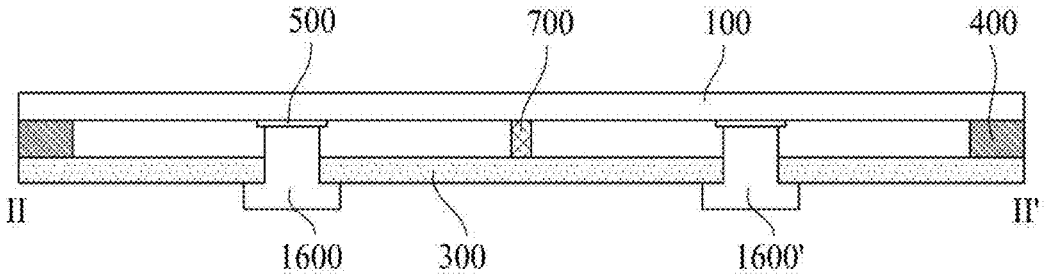
Figure 9C:
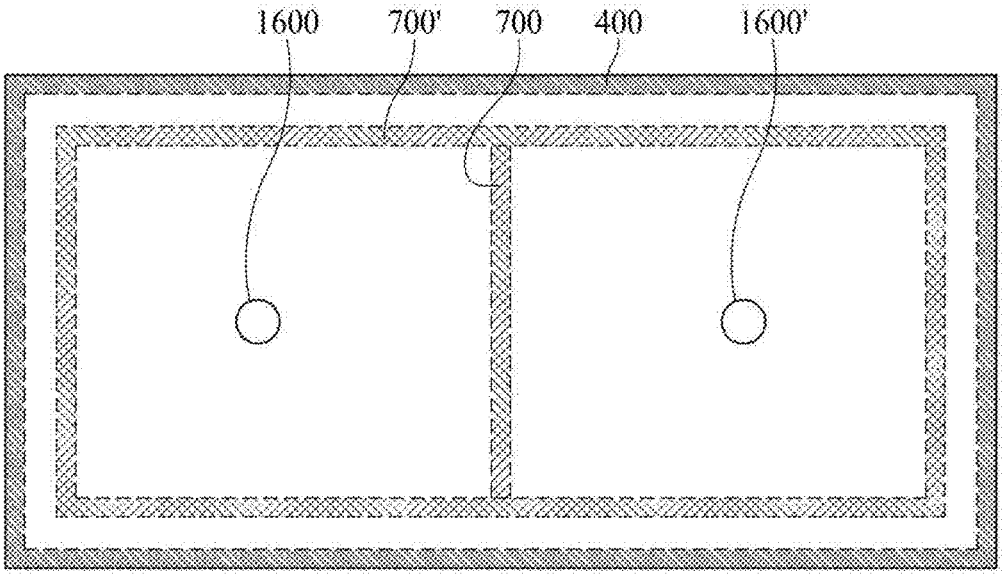

FIGS. 9A to 9C illustrate an example of the sound generating device and partition in the display apparatus according to the present disclosure.

With reference to FIG. 9A, the display panel 100 includes first and second areas. According to an example embodiment of the present disclosure, the first area corresponds to a left area of the display panel 100, and the second area corresponds to a right area of the display panel 100.

A first sound generating device 1600 is disposed in the first area of the display panel 100, and a second sound generating device 1600' is disposed in the second area of the display panel 100. The first sound generating device 1600 and the second sound generating device 1600' may output middle-range and high-range sound with different levels so that it may be possible to output stereo sound by the left and right sound separation. In this case, the middle-pitch sound is defined as the sound between 200 Hz and 3 kHz, and the high-pitch sound is defined as the sound of 3 kHz or more than 3 kHz, but they are not limited to these ranges.

The display apparatus may further include a partition 700 disposed between the first sound generating device 1600 and the second sound generating device 1600'. The partition 700 corresponds to a space for generating sound when the display panel 100 is vibrated by the sound generating device 1600. Also, the partition 700 may be an enclosure or baffle, but is not limited to these terms. The partition 700 may be additionally provided at four outer sides of the display panel 100. The partition 700 may be formed in a sealed structure or unsealed structure.

The partition 700 may separate the sound generated in the first sound generating device 1600 from the sound generated in the second sound generating device 1600'. The partition 700 attenuates or absorbs the vibration of the display panel 100 in the center of the display panel 100 so that it may be possible to prevent the left-side sound from being transferred to the area for the right-side sound. Accordingly, the partition 700 separates the left-side sound and the right-side sound from each other, and improves the sound output properties.

For example, the partition 700 may be formed of polyurethane or polyolefin, but is not limited to these materials. The partition 700 may be formed of single-sided tape or double-sided tape, or may be formed of a material with elasticity, which is capable of being pressed to a predetermined level.

Accordingly, the middle-range and high-range sound may be output from the two sound generating devices 1600 and 1600'. Also, the partition 700 is disposed between the two sound generating devices 1600 and 1600' so that it may be possible to separate the left-side sound and the right-side sound from each other, to thereby improve the sound stereo properties.

FIG. 9B is a cross sectional view along II-II' of FIG. 9A. With reference to FIG. 9B, the display apparatus may include the sound generating devices 1600 and 1600', the partition 700, the rear structure 300, and the adhesion member 400.

The rear structure (supporting member) 300 may support at least one of the rear and side (lateral) surfaces of the display panel 100. The sound generating devices 1600 and 1600' may be fixed to the rear structure 300. The connection structure between the sound generating device 1600 and 1600' and the rear structure 300 is the same as the aforementioned connection structure shown in FIG. 7.

The adhesion member 400 is disposed between the edge of the display panel 100 and the edge of the rear structure 300, to thereby adhere the display panel 100 and the rear structure 300 to each other. The adhesion member 400 according to an example embodiment of the present disclosure may be double-sided tape, but is not limited to this type.

FIG. 9C illustrates another example of the sound generating device and partition in the display apparatus according to the present disclosure. With reference to FIG. 9C, the partition 700 is disposed between the first sound generating device 1600 and the second sound generating device 1600', whereby the sound generated in the first sound generating device 1600 is separated from the sound generated in the second sound generating device 1600. In addition, a second partition 700' may be provided along fourth outer sides of the display panel 100.

The second partition 700' prevents the sound from leaking in each lateral surface of the display panel 100 so that the sound is output only to the front direction of the display panel 100, to thereby improve the sound output properties.

According to an example embodiment of the present disclosure, if the adhesion member 400 is formed of foam pad, it may serve as the second partition 700'. In this case, it may be possible not to provide the additional second partition 700'.

Figure 10A:
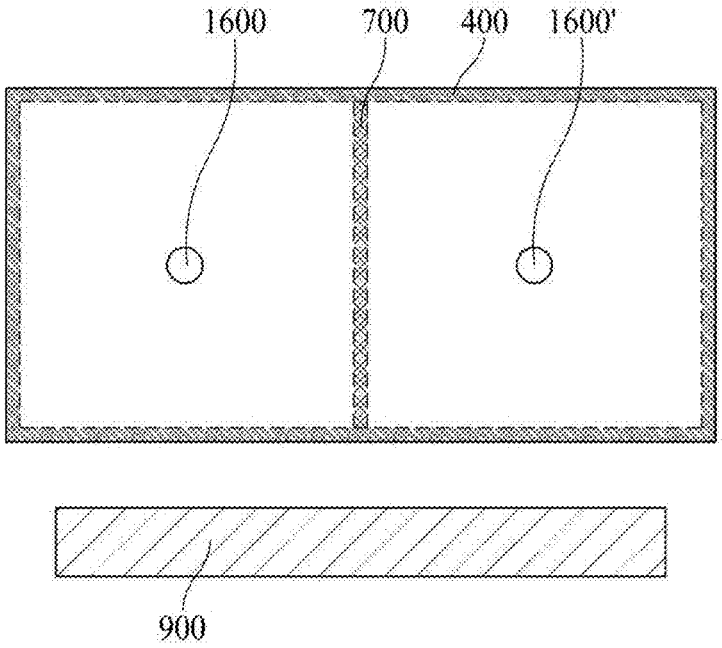
FIGS. 10A and 10B illustrate an example sound generating device and low-range sound generating device in the display apparatus according to the present disclosure.
Figure 10B:
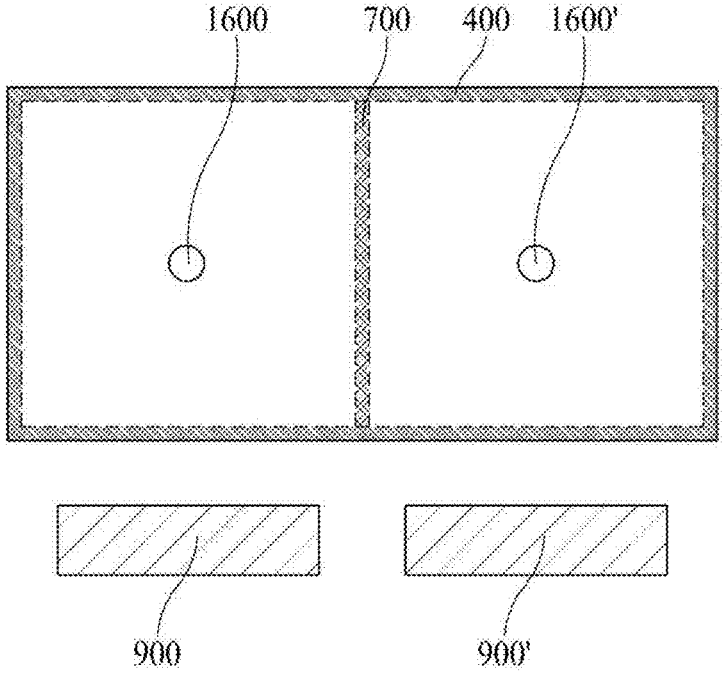

FIGS. 10A and 10B illustrate the sound generating device and low-range sound generating device in the display apparatus according to an example embodiment of the present disclosure. With reference to FIGS. 10A and 10B, the display apparatus may further include at least one low-range sound generating device 900 provided at a predetermined interval from the display panel 100.

In order to improve quality of low-range sound, the low-range sound generating device 900 is disposed in the periphery of the display panel 100. According to an example embodiment of the present disclosure, the low-range sound generating device 900 may be formed of a general speaker, for example, a woofer speaker capable of generating sound in the range of several kHz or less than several kHz, but is not limited to this type.

FIG. 10A illustrates an example of one low-range sound generating device without separation of left and right sides. It may be possible to provide two or more low-range sound generating devices for separation of the left and right areas of low-range sound. In this case, the low-range sound corresponds to the sound of 200 Hz or less than 200 Hz, but is not limited to this range.

With reference to FIG. 10B, the low-range sound generating device 900 according to an example embodiment of the present disclosure is provided at a predetermined interval from the display panel 100, and at least one low-range sound generating device 900 may be disposed at each of the first and second areas of the display panel 100.

In more detail, the left low-range sound generating device 900 is disposed at a lower end of the left-side sound generating device 1600, and the right low-range sound generating device 900' is disposed at a lower end of the right-side sound generating device 1600'. Accordingly, the display apparatus according to an example embodiment of the present disclosure includes the first and second sound generating devices 1600 and 1600' for generating the middle-range and high-range sound by vibrating the display panel 100, and the first and second low-range sound generating devices 900 and 900' provided to generate the low-range sound and respectively disposed in the first and second sound generating devices 1600 and 1600' so that it may be possible to improve the sound output properties for the all range sound.

Figure 11A:
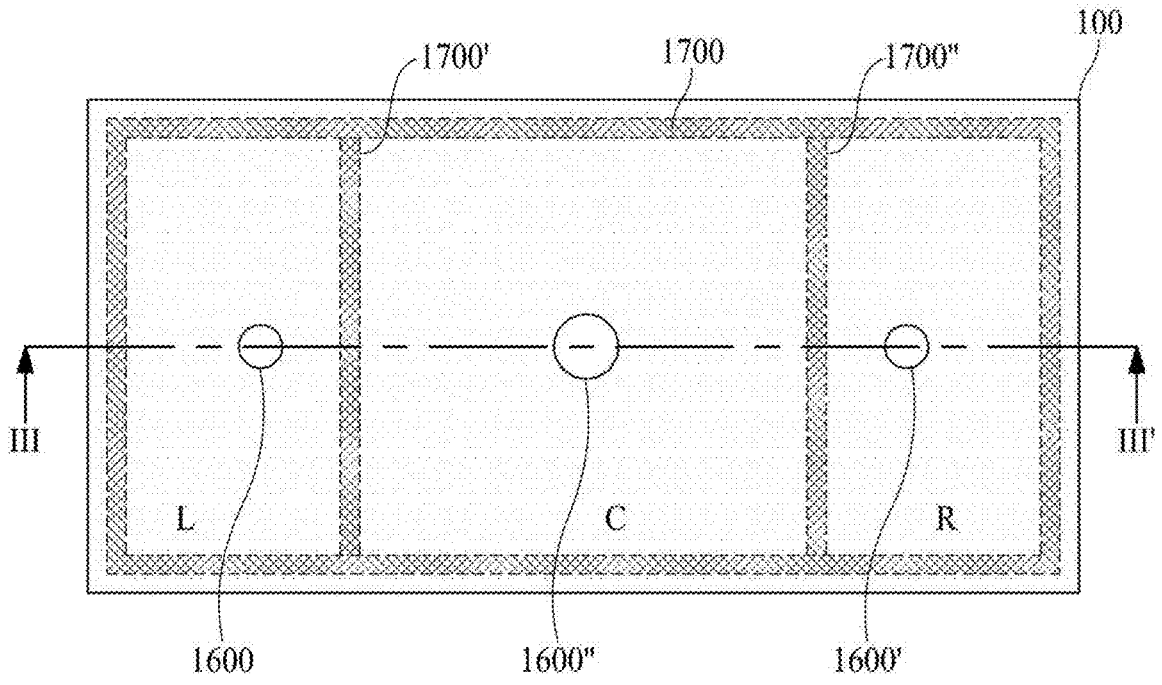
FIGS. 11A to 11E illustrate another example of the sound generating device and partition in the display apparatus according to the present disclosure.
Figure 11B:
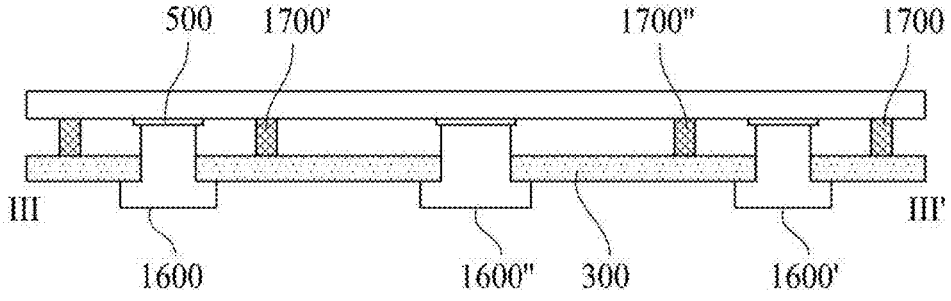

FIGS. 11A to 11E illustrate another example of the sound generating device and partition in the display apparatus according to the present disclosure. With reference to FIGS. 11A and 11B, the display panel 100 includes first, second, and third areas. In this case, the first area corresponds to a left area (L) of the display panel 100, the second area corresponds to a right area (R) of the display panel 100, and the third area corresponds to a central area (C) of the display panel 100. A first sound generating device 1600 is disposed in the first area of the display panel 100, a second sound generating device 1600' is disposed in the second area of the display panel 100, and a third sound generating device 1600" is disposed in the third area of the display panel 100. For example, the third sound generating device 1600" corresponds to a woofer speaker.

The first sound generating device 1600 and the second sound generating device 1600' may output middle-range and high-range sound, and the third sound generating device 1600" may output low-range sound. Accordingly, the first sound generating device 1600 and the second sound generating device 1600' enable the stereo sound output, and the third sound generating device 1600" enables the low-range sound output, whereby the display apparatus according to an example embodiment of the present disclosure may have the sound output properties of 2.1 channel type.

Also, in case of the third area whose size is larger than a size of the first area and the second area, even though the first, second, and third sound generating devices 1600, 1600', and 1600" have the same sound output, it may be possible to stably output low-range sound owing to the relatively-large size of the third sound generating device 1600" for generating the low-range sound.

A partition enables a separation of middle-range and high-range sound in the first and second areas, and also enables a separation of low-range sound in the third area. The partition may include a first partition 1700' disposed between the first area and the third area, a second partition 1700" disposed between the third area and the second area, and a third partition 1700 disposed in the edge of the display panel 100. Accordingly, the first partition 1700' prevents the vibration of the first area of the display panel 100 from being transferred to the third area of the display panel 100, and the second partition 1700" prevents the vibration of the second area of the display panel 100 from being transferred to the third area of the display panel 100.

According to an example embodiment of the present disclosure, the first partition 1700', the second partition 1700", and the third partition 1700 may be formed of double-sided tape or single-sided tape of polyurethane or polyolefin having a uniform thickness (or height) and width, but is not limited to these types. The first partition 1700', the second partition 1700", and the third partition 1700 may be formed of a material with elasticity, which is capable of being pressed to a predetermined level, wherein the first partition 1700', the second partition 1700", and the third partition 1700 may be referred to as a foam pad.

The rear structure (supporting member) 300 may support at least one of the rear and lateral surfaces of the display panel 100. The sound generating devices 1600, 1600', and 1600" may be fixed to the rear structure 300. The connection structure between the sound generating device 1600, 1600', and 1600" and the rear structure 300 is the same as the aforementioned connection structure shown in FIG. 7.

Figure 11C:
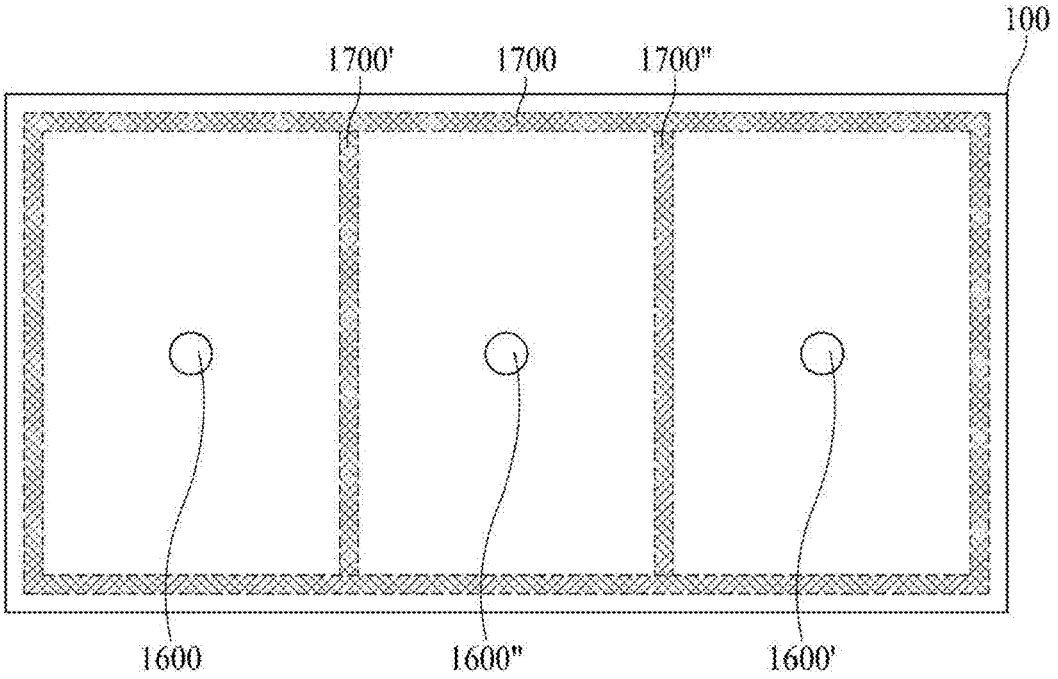

With reference to FIG. 11C, in order to realize good sound output properties both in the middle-range and high-pitch sound and the low-range sound, the first area, the second area, and the third area may have the same size. That is, as shown in FIG. 11C, the display panel 100 may include the first area, the second area, and the third area having the same size. The first sound generating device 1600 is disposed in the first area of the display panel 100, the second sound generating device 1600' is disposed in the second area of the display panel 100, and the third sound generating device 1600" is disposed in the third area of the display panel 100. The first sound generating device 1600 and the second sound generating device 1600' may generate the middle-range and high-range sound, and the third sound generating device 1600" may generate the low-range sound. Even though the first area, the second area, and the third area of the display panel 100 have the same size, the display apparatus is capable of outputting the stereo sound.

The first partition 1700' is disposed between the first sound generating device 1600 and the third sound generating device 1600", the second partition 1700" is disposed between the second sound generating device 1600' and the third sound generating device 1600", and the third partition is disposed in the edge of the display panel 100.

Figure 11D:
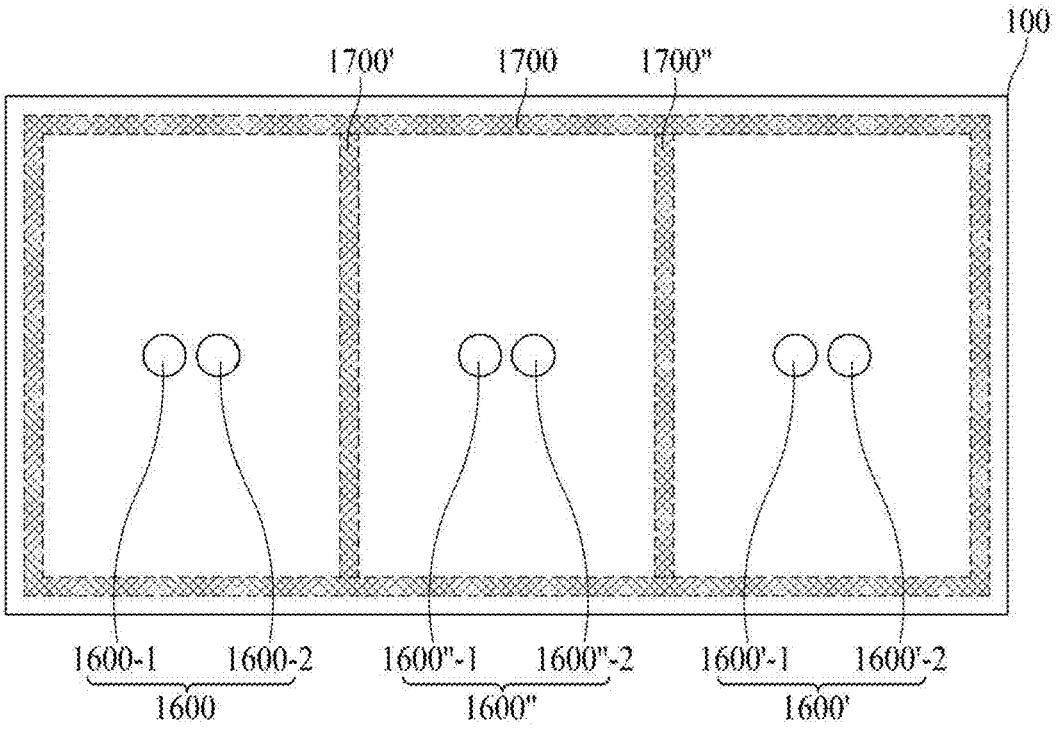

With reference to FIG. 11D, the two sound generating devices are disposed in each of the first, second, and third areas.

The first sound generating device 1600 includes two sub sound generating modules 1600-1 and 1600-2 disposed in the first area corresponding to the left area of the display panel 100. The second sound generating device 1600' includes two sub sound generating modules 1600'-1 and 1600'-2 disposed in the second area corresponding to the right area of the display panel 100. Also, the third sound generating device 1600" includes two sub sound generating modules 1600"-1 and 1600"-2 disposed in the third area corresponding to the central area of the display panel 100.

The first sound generating device 1600 and the second sound generating device 1600' may generate the middle-range and high-range sound, and the third sound generating device 1600" may generate the low-range sound.

In the display apparatus according to an example embodiment of the present disclosure, the sound generating device including the two sub sound generating modules is provided in each of the first, second, and third areas of the display panel 100, whereby the two sub sound generating modules for each area may output the sound of the same range, to thereby improve the sound pressure.

Also, the first partition 1700' is disposed between the first sound generating device 1600 and the third sound generating device 1600", the second partition 1700" is disposed between the second sound generating device 1600' and the third sound generating device 1600", and the third partition is disposed in the edge of the display panel 100.

Figure 11E:
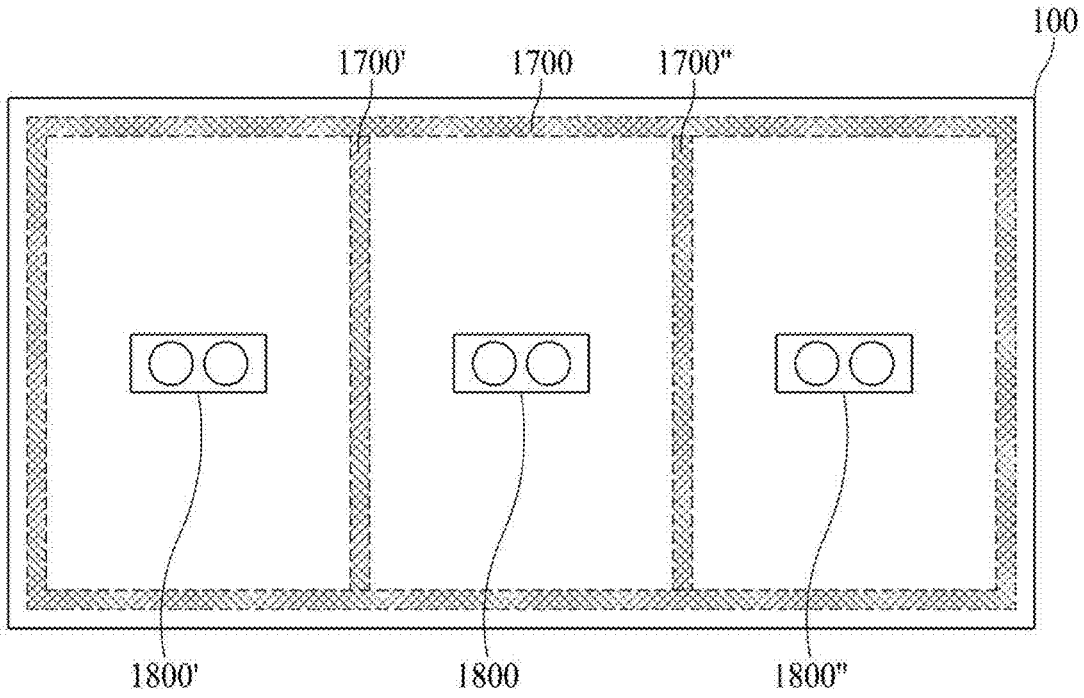

With reference to FIG. 11E, a pair of sound generating devices may be disposed in each of the first, second, and third areas. For example, a pair of first sound generating device 1800' is disposed in the first area corresponding to the left area of the display panel 100, and a pair of second sound generating device 1800" is disposed in the second area corresponding to the right area of the display panel 100. Also, a pair of third sound generating device 1800 is disposed in the third area corresponding to the central area of the display panel 100.

The first sound generating device 1800' and the second sound generating device 1800" may generate the middle-range and high-range sound, and the third sound generating device 1800 may generate the low-range sound.

In the display apparatus according to an example embodiment of the present disclosure, a pair of sound generating device is provided in each of the first, second, and third areas of the display panel 100, whereby it may be possible to maintain uniform sound output properties, and to improve the sound pressure.

Also, the first partition 1700' is disposed between the first sound generating device 1800' and the third sound generating device 1800, the second partition 1700" is disposed between the second sound generating device 1800" and the third sound generating device 1800, and the third partition 1700 is disposed in the edge of the display panel 100.

Also, the sound generating device disposed in each of the first, second, and third areas of the display panel 100 shown in FIGS. 11A to 11E may be the sound generating device disposed in each of the first, second, and third areas to be explained with reference to FIGS. 17 and 18.

FIGS. 12A to 12K illustrate another example of the sound generating device and partition in the display apparatus according to the present disclosure. With reference to FIGS. 12A to 12K, first and second partitions 1700' and 1700" are adjacent to each other, and the first and second partitions 1700' and 1700" may be formed in a dual structure for separating the first area and the second area from each other. For a mono sound of outputting the same sound in the left and right areas, the left and right areas of the display panel 100 have the same vibration properties, whereby it may cause a problem related with the reduction of sound pressure by maximized resonant phenomenon and interference phenomenon in a specific frequency band. In order to decrease an influence of the output properties caused by the difference of resonant frequency between the middle-range and high-range sound generated in the first sound generating device of the first area corresponding to the left area and the middle-range and high-range sound generated in the second sound generating device of the second area corresponding to the right area, it may have a structure including two or more partitions. According to an example embodiment of the present disclosure, the two partitions may be provided, or the three or more partitions may be provided. If there are the three or more partitions, even though the sound inference may become serious in the left and right areas, it may be possible to prevent the reduction of sound pressure, thereby preventing discontinuity of the sound output properties.

The first and second sound generating devices may output the different levels of the middle-range and high-range sound so that it may be possible to output the stereo sound by the separation of the left and right areas. Also, the first sound generating device of the first area corresponding to the left area and the second sound generating device of the second area corresponding to the right area are provided, and the sound generating device is not provided in the third area corresponding to the central area, whereby it may be possible to improve the sound output properties of the middle-range and high-range sound in the left and right areas of the display panel 100.

Figure 12A:
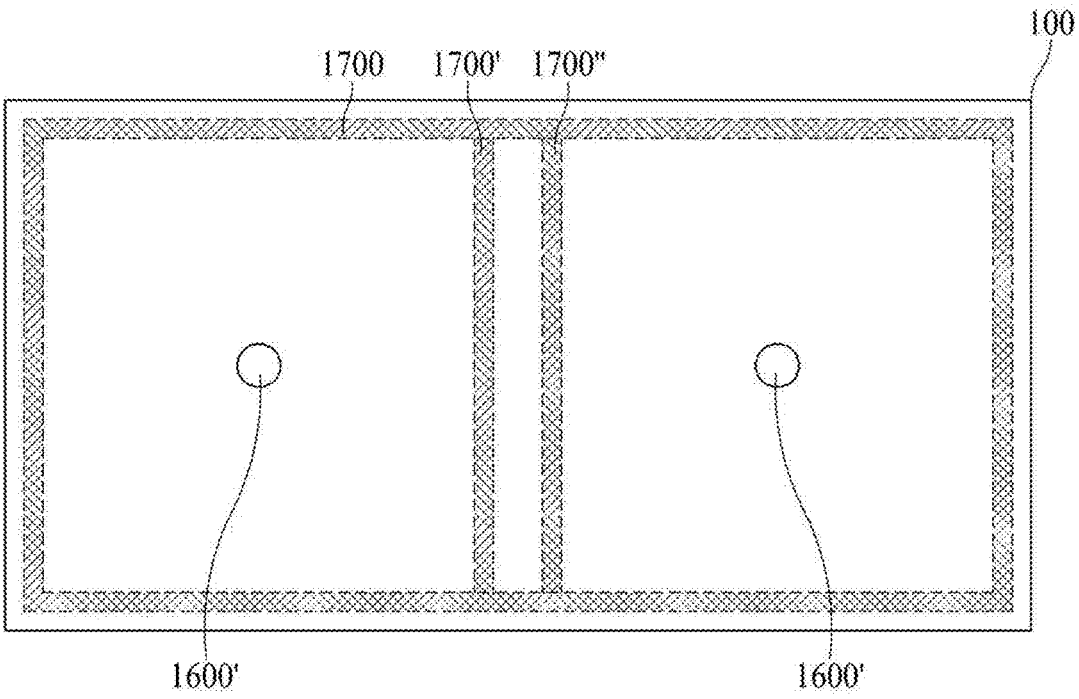
FIGS. 12A to 12K illustrate another example of the sound generating device and partition in the display apparatus according to the present disclosure.

With reference to FIG. 12A, the first sound generating device 1600 is disposed in the first area corresponding to the left area of the display panel 100, and the second sound generating device 1600' is disposed in the second area corresponding to the right area of the display panel 100. At least two partitions including the first partition 1700' and the second partition 1700" may be disposed between the first sound generating device 1600 and the second sound generating device 1600", or the first partition 1700' with at least two sub partitions may be disposed between the first sound generating device 1600 and the second sound generating device 1600". Also, the third partition 1700 may be disposed in the edge of the display panel 100. Accordingly, the two partitions are provided in the central area of the display panel 100 so that it may be possible to decrease an influence of the output properties caused by the difference of resonant frequency in the middle-range and high-range sound between the left and right areas of the display panel 100.

Figure 12B:
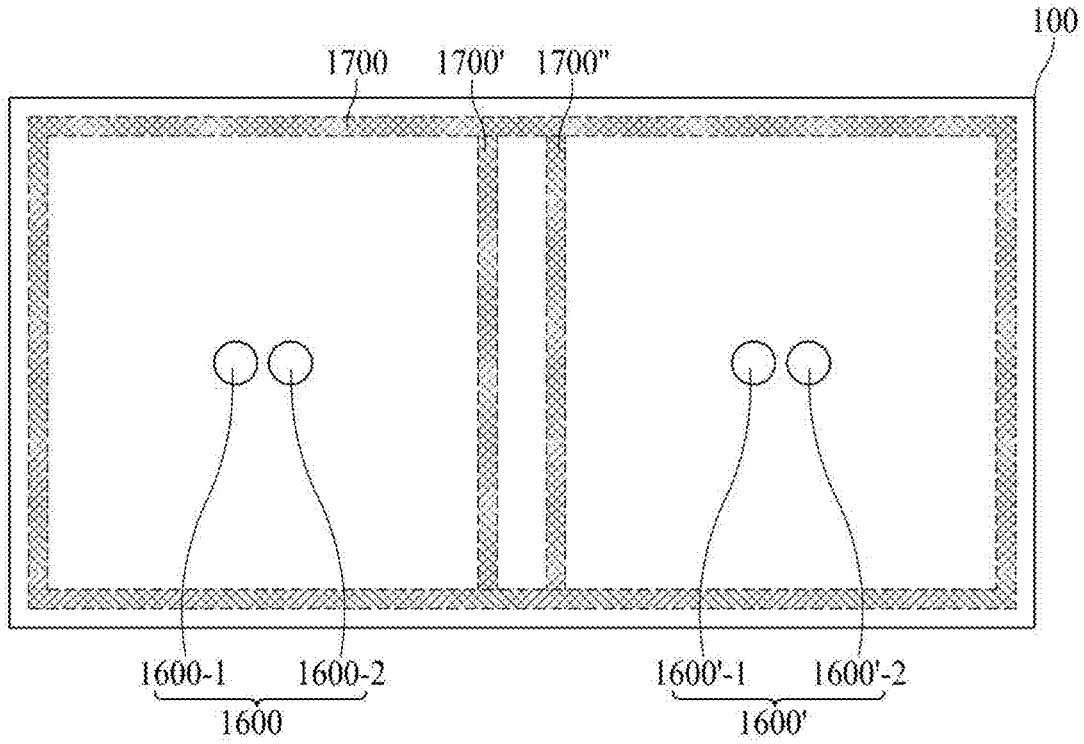

With reference to FIG. 12B, the first sound generating device 1600 including the two sub sound generating modules 1600-1 and 1600-2 is disposed in the first area corresponding to the left area of the display panel 100. The second sound generating device 1600' including the two sub sound generating modules 1600'-1 and 1600'-2 is disposed in the second area corresponding to the right area of the display panel 100. At least two partitions of the first partition 1700' and the second partition 1700" may be disposed between the first sound generating device 1600 and the second sound generating device 1600', or the first partition 1700' including the two or more sub partitions may be disposed between the first sound generating device 1600 and the second sound generating device 1600'. The third partition 1700 is disposed in the edge of the display panel 100. Accordingly, the two partitions are provided in the central area of the display panel 100 so that it is possible to decrease an influence of the output properties caused by the difference of resonant frequency in the middle-range and high-range sound between the left and right areas of the display panel 100.

Figure 12C:
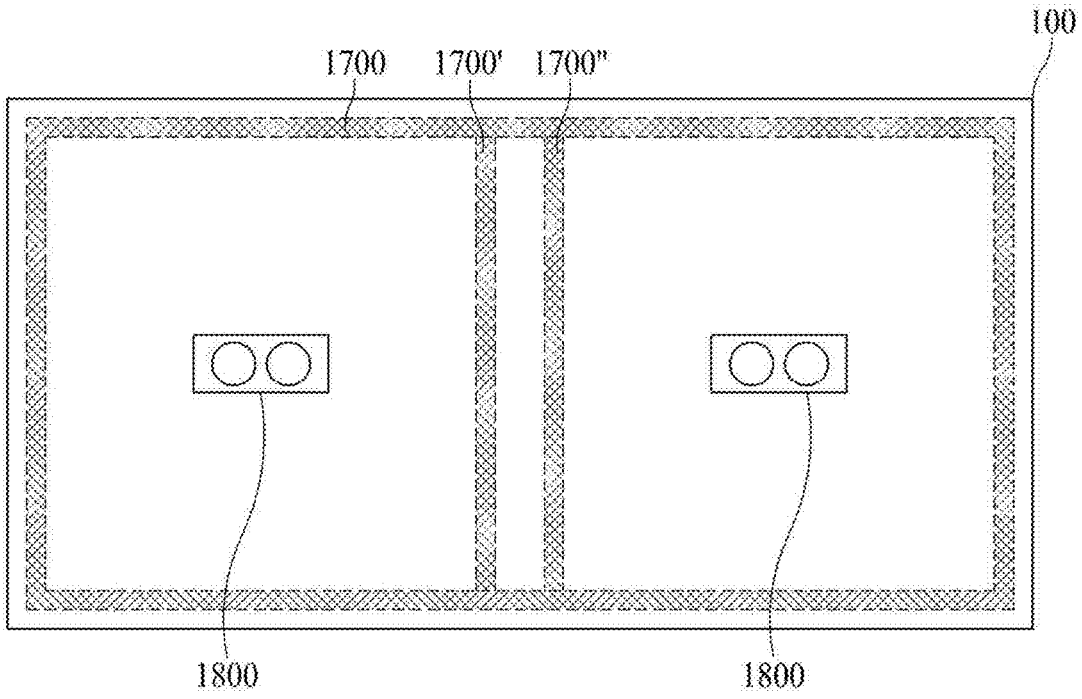

With reference to FIG. 12C, a pair of first sound generating device 1800 is disposed in the first area corresponding to the left area of the display panel 100, and a pair of second sound generating device 1800' is disposed in the second area corresponding to the right area of the display panel 100. If a pair of sound generating devices is provided in each of the first and second areas, it may be possible to reduce an interference or delay phenomenon of the sound wave generated in the sound generating device, to thereby improve the sound output properties. Between the first sound generating device 1800 and the second sound generating device 1800', there are at least two partitions of the first partition 1700' and the second partition 1700", or there are at least two sub partitions. Also, the third partition 1700 is disposed in the edge of the display panel 100. Accordingly, the two partitions are provided in the central area of the display panel 100 so that it may be possible to decrease an influence of the output properties caused by the difference of resonant frequency in the middle-range and high-range sound between the left and right areas of the display panel 100.

The sound wave generated by vibrating the display panel 100 through the use of sound generating device radially progresses from the center of the sound generating device, which is referred to as a progressive wave. If the progressive wave is reflected on one side of the partition, and progresses to an opposite direction, it is referred to as a reflected wave. If this reflected wave is overlapped and interfered with the progressive wave, it is not progressed, and it is in a standing state, which is referred to as a standing wave. The standing wave causes the reduction of sound pressure, to thereby deteriorate the sound output properties. Thus, in order to prevent the reduction of sound pressure by the standing wave generated due to the interference between the progressive wave and the reflected wave, a bent portion is formed in the partition. The standing wave causing the reduction of sound pressure generates at a point having the large progressive wave and the large reflected wave. Accordingly, the bent portion may be disposed in the point having the largest sound wave approaching from the sound generating device, which will be described with reference to FIGS. 12D to 12K.

FIGS. 12D to 12K show the partition of the dual structure including the two or more partitions, and the bent portion is provided in at least one side of the partition.

Figure 12D:
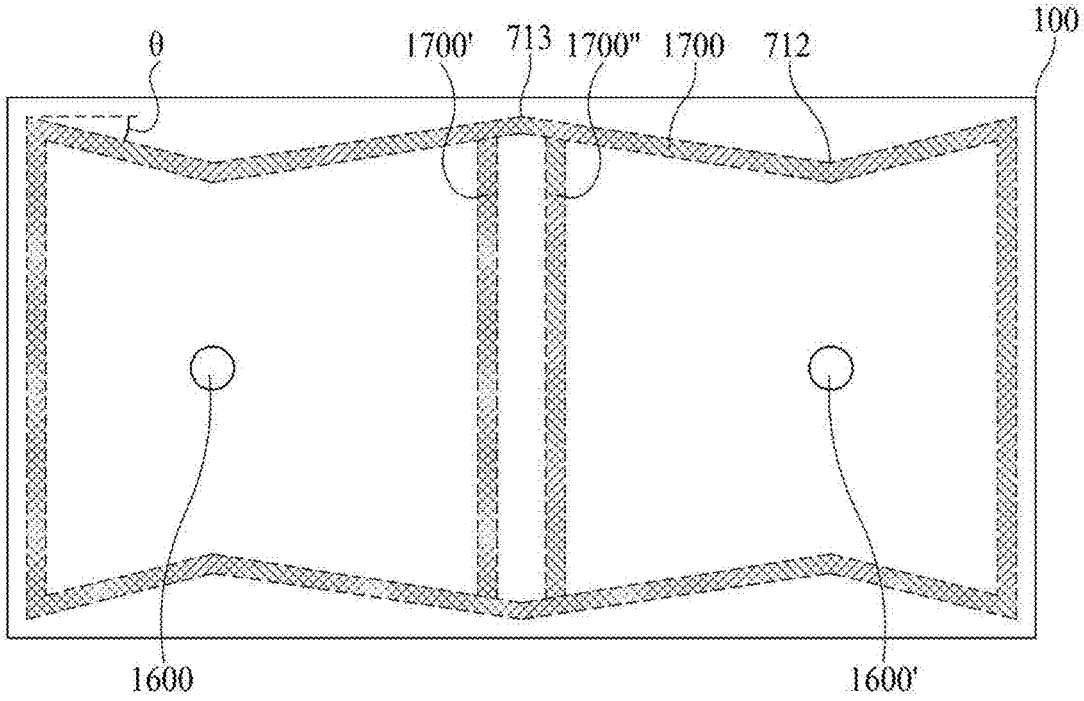
Figure 12E:
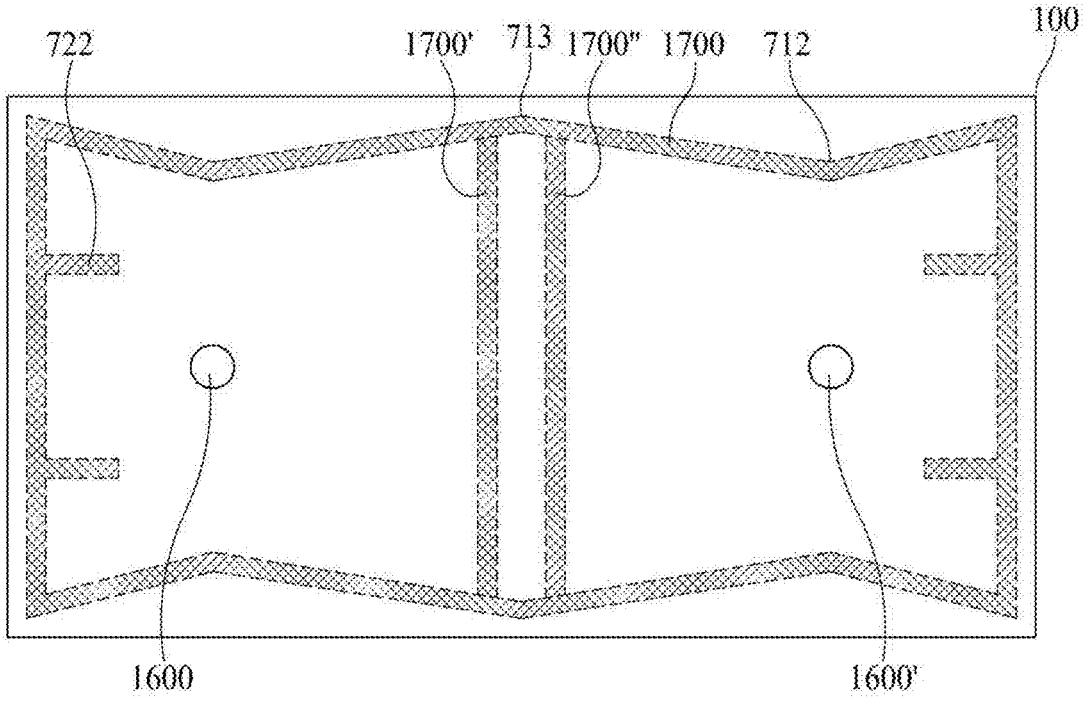

With reference to FIGS. 12D and 12E, the first sound generating device 1600 is disposed in the first area corresponding to the left area of the display panel 100, and the second sound generating device 1600' is disposed in the second area corresponding to the right area of the display panel 100. At least two partitions including the first partition 1700' and the second partition 1700" may be disposed between the first sound generating device 1600 and the second sound generating device 1600", or the first partition 1700' with at least two sub partitions may be disposed between the first sound generating device 1600 and the second sound generating device 1600". Also, the third partition 1700 may be disposed in the edge of the display panel 100. The bend portion 712 is provided in at least one side of the third partition 1700.

The bent portion 712 is formed in at least one side, at which the largest sound wave approaches, among four sides of the third partition 1700, wherein the bent portion 712 is bent toward the direction of the sound generating device 1600 and 1600'. The bent portion 712 may be bent toward the center of the first sound generating device 1600 and the center of the second sound generating device 1600' so that it may be possible to prevent the reduction of sound pressure by the standing wave.

The display panel 400 includes the four sides, wherein the bent portion 712 is formed in the first side corresponding to one or more sides among the four sides. Thus, the bent portion 712 is formed in such a way that the two sides corresponding to the lower and upper sides of the four sides are provided to have a predetermined inclined angle with respect to a horizontal direction (or length direction) of the display panel 100. The bent portion 712 is provided with two straight-line portions, wherein the bent portion 712 is formed at a point where the two straight-line portions meet. The bent portion 712 may be formed in a straight line shape, a curved line shape, or a round shape, but not limited to these shapes.

The inclined angle (θ) of the bent portion 712 may be changed based on requirement for restriction of the standing wave, and the inclined angle (θ) of the bent portion 712 may be set within a range from 10° to 30°. For example, in case of the sound output range for the low-range sound or the large output of the sound generating device, inclined angle (θ) of the bent portion 712 becomes large. In case of the sound output range for the high-range sound or the small output of the sound generating device, inclined angle (θ) of the bent portion 712 becomes small. In this case, the inclined angle (θ) of the bent portion 712 may be the angle obtained by one side of the third partition 1700 and the horizontal direction (or length direction) of the display panel 100. Herein, the horizontal direction or length direction corresponds to the direction of the long side of the display apparatus, and the vertical direction or width direction corresponds to the direction of the short side of the display apparatus.

Between the first partition 1700' and the second partition 1700", there is the third partition 1700 having a bent shape, wherein the bent shape is bent toward the display panel 100. The bent portion 713 of the third partition 1700 disposed between the first partition 1700' and the second partition 1700" may be formed in a straight line shape, a curved line shape, or a round shape, but not limited to these shapes.

With reference to FIG. 12E, there are both bent portion 712 and protrusion portion 722. For example, the bent portion 712 is formed in at least one side of the third partition 1700, and at least one protrusion portion 722 is formed in the side perpendicular to the side with the bent portion 712. The protrusion portion 722 disposed in the left area of the display panel 100 faces toward the first sound generating device 1600, and the protrusion portion 722 disposed in the right area of the display panel 100 faces toward the second sound generating device 1600'.

The protrusion portion 722 is capable of trapping the reflected wave, and decreasing the reduction of sound pressure by the standing wave. At least one protrusion 722 may be formed in at least one side of the third partition 1700, wherein the protrusions 722 may be symmetrically disposed with respect to the sound generating device. FIG. 12E shows that at least one protrusion portion 722 is formed in any one side of the first side and the second side being perpendicular to the first side among the four sides of the display panel 100.

Figure 12F:
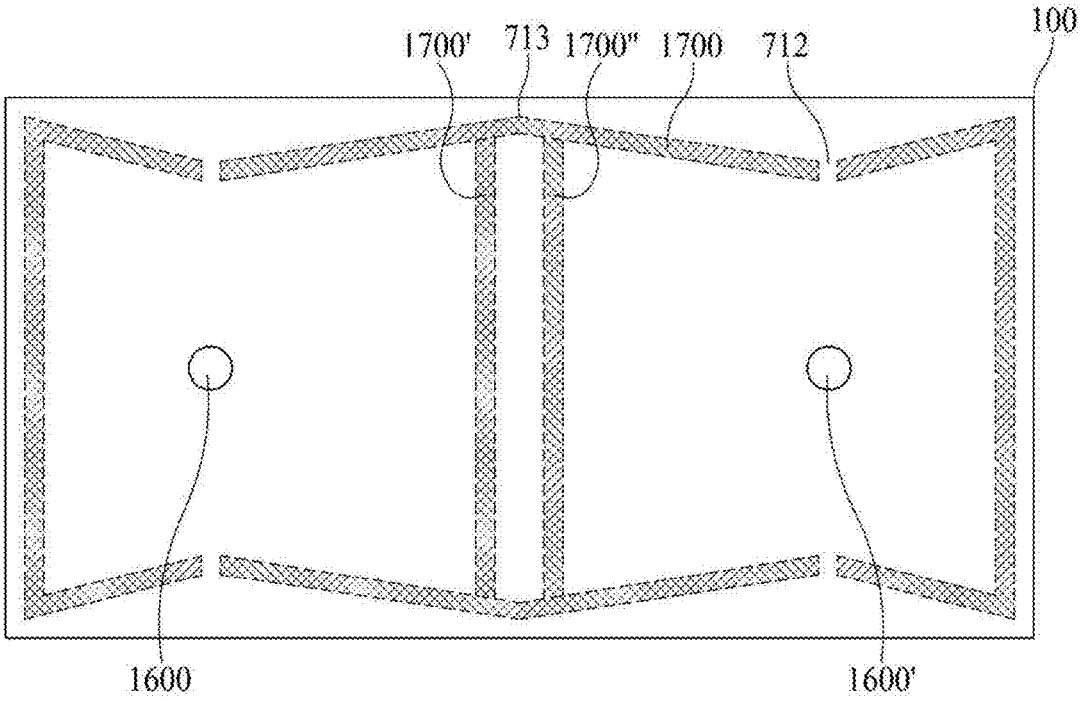
Figure 12G:
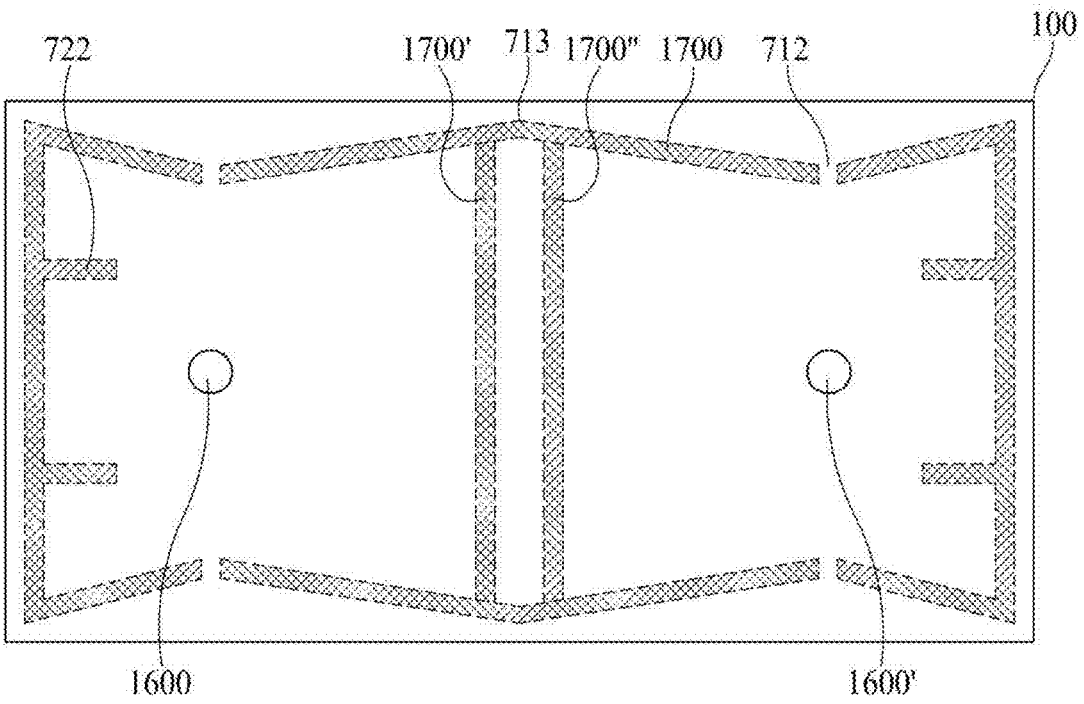

FIGS. 12D and 12E show a sealed structure of the third partition 1700, and FIGS. 12F and 12G show an unsealed structure of the third partition 1700. In detail, the third partition 1700 may be formed in the zigzag shape and sealed structure, or the third partition 1700 may be formed in the zigzag shape and unsealed structure. Also, the bent portion 712 may be formed in the sealed structure, and the bent shape disposed between the first partition 1700' and the second partition 1700" may be formed in the unsealed structure. If the third partition 1700 has the unsealed structure, a cost for the third partition 1700 is reduced in comparison to the case of the sealed structure. There is no different in sound output properties between the third partition 1700 having the sealed structure and the third partition 1700 having the unsealed structure.

With reference to FIGS. 12F and 12G, the first sound generating device 1600 is disposed in the first area corresponding to the left area of the display panel 100, and the second sound generating device 1600' is disposed in the second area corresponding to the right area of the display panel 100. The first partition 1700' and the second partition 1700" are disposed between the first sound generating device 1600 and the second sound generating device 1600", and the third partition 1700 is disposed in the edge of the display panel 100. The first partition 1700' including the two or more sub partitions may be disposed between the first sound generating device 1600 and the second sound generating device 1600'. The bent portion 712 is formed in at least one side of the third partition 1700, and the bent portion 712 is bent toward the central direction of the first sound generating device 1600 and the central direction of the second sound generating device 1600'. The third partition 1700 is formed in the unsealed structure. In detail, the third partition 1700 is formed in the zigzag shape and unsealed structure. The bent portion 712 may be formed in the unsealed structure, and the bent shape disposed between the first partition 1700' and the second partition 1700" is formed in the sealed structure.

In FIG. 12G, the protrusion portion 722 is additionally provided, wherein the protrusion portion 722 is the same as that of FIG. 12E.

Figure 12H:
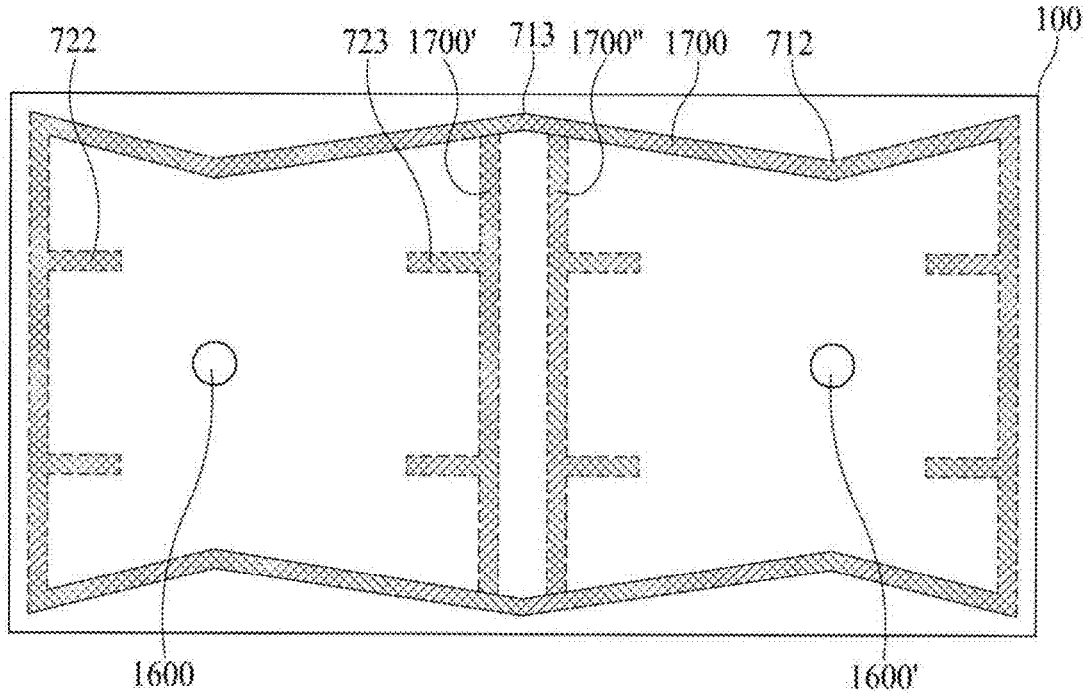
Figure 12I:
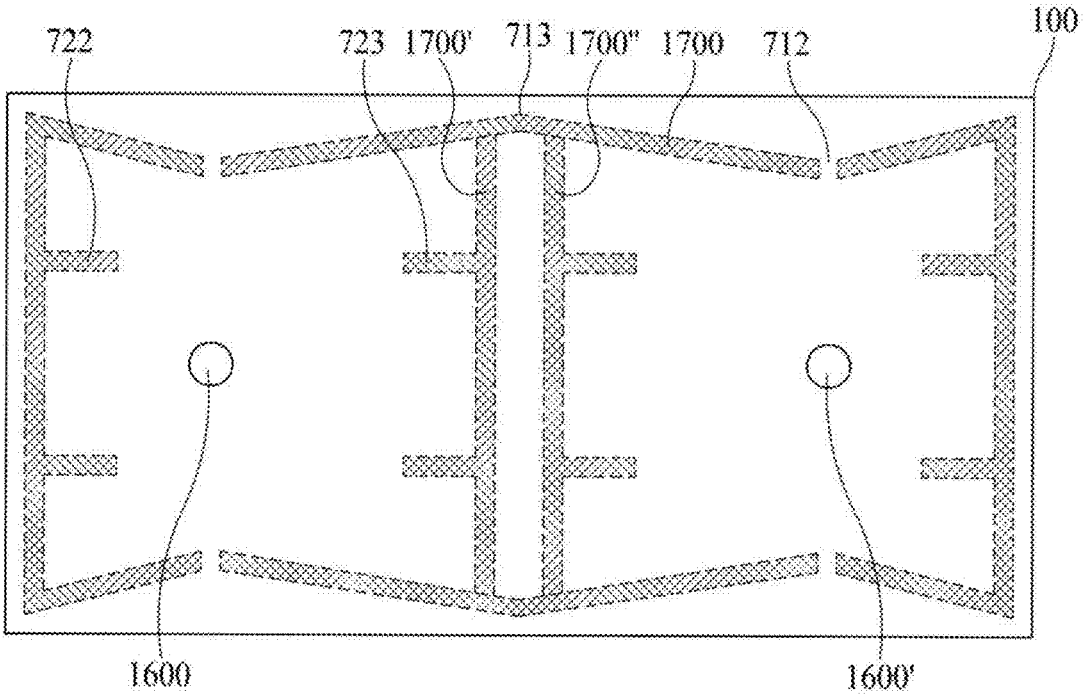

In FIGS. 12H and 12I, at last one protrusion 722 and second protrusion portion 723 are formed in the first side of the four sides of the display panel 100, and the second side perpendicular to the first side. The protrusion portion 722 and second protrusion portion 723 disposed in the left area of the display panel 100 face toward the first sound generating device 1600, and the protrusion portion 722 and second protrusion portion 723 disposed in the right area of the display panel 100 face toward the second sound generating device 1600'. As there are the protrusion portion 722 and second protrusion portion 723, it may be possible to trap the reflected wave and to decrease the reduction of sound pressure by the standing wave.

FIG. 12H shows the sealed structure of the third partition, and FIG. 12I shows the unsealed structure of the third partition 1700. A description for the third partition 1700 is the same as that of FIGS. 12D to 12G.

Figure 12J:
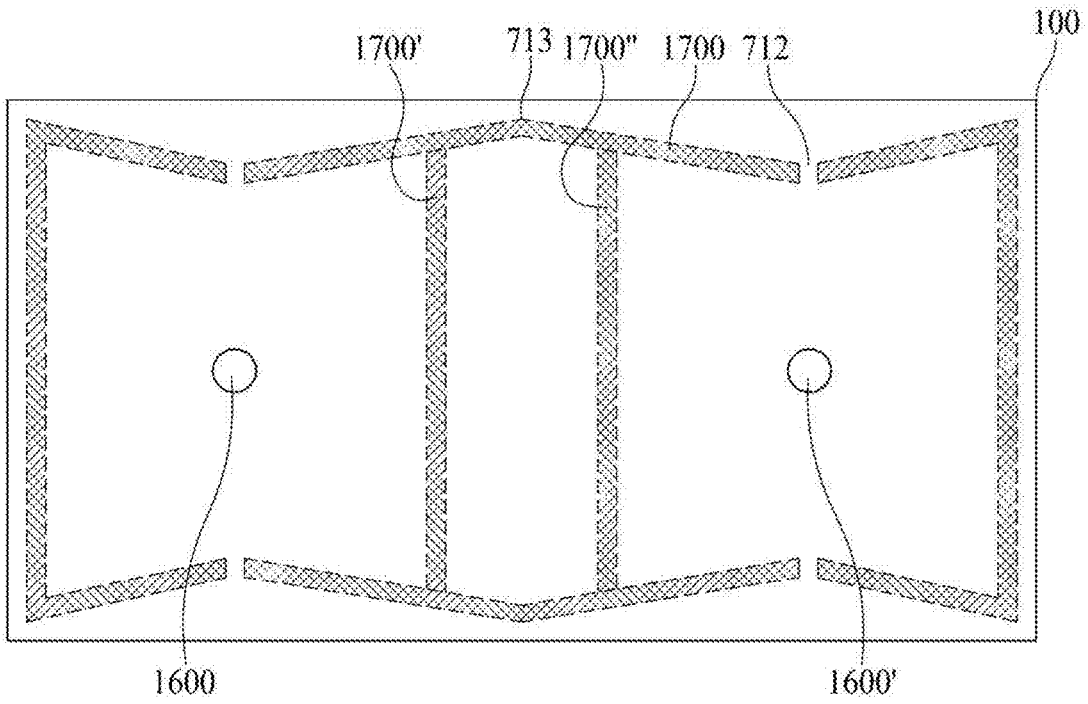
Figure 12K:
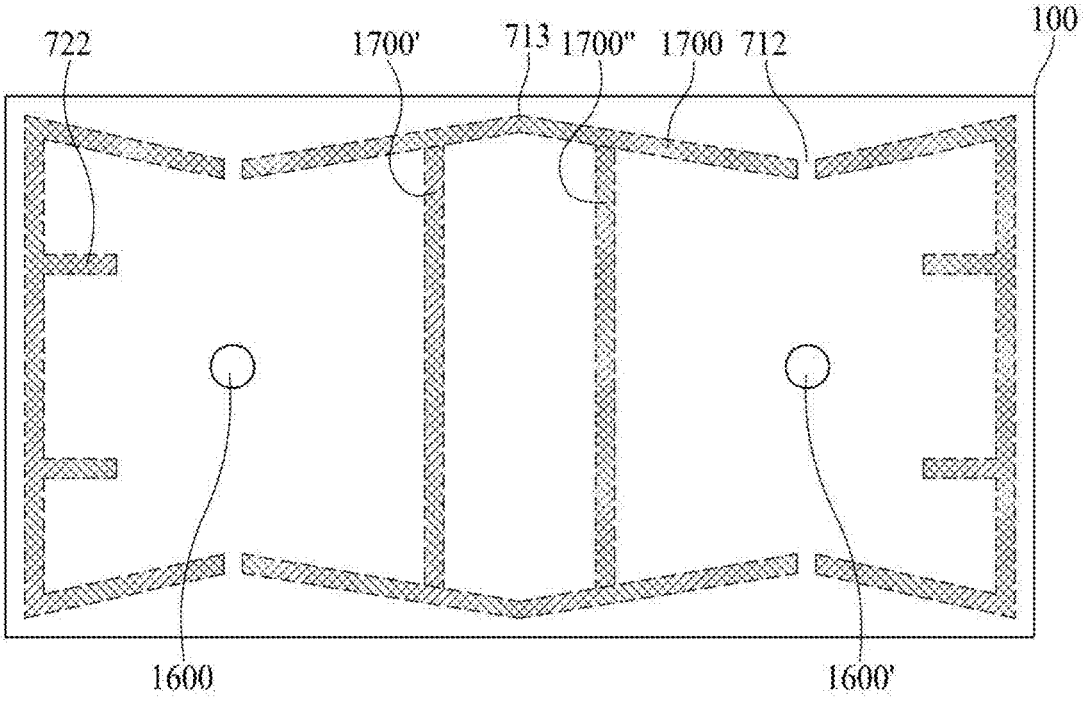

In FIGS. 12J and 12K, an interval between the first partition 1700' and the second partition 1700" may be larger than that shown in FIGS. 12A to 12I. In this case, the sound output properties of the low-range sound may be improved in comparison to the case of providing the same-sized first, second, and third areas.

In FIG. 12K, the protrusion portion 722 is additionally provided, wherein the protrusion portion 722 is the same as that of FIG. 12E.

The structure of sound generating device and partition shown in FIGS. 12D to 12I may be similarly applied to the structure shown in FIGS. 12J and 12K.

In FIGS. 12D to 12K, one sound generating device is disposed in each of the first and second areas of the display panel 100. In the same manner as that of FIG. 12B, the two sound generating devices being adjacent to each other may be disposed in each of the first and second areas of the display panel 100 shown in FIGS. 12D to 12K. In the same manner as that of FIG. 12C, a pair of sound generating devices may be disposed in each of the first and second areas of the display panel 100 shown in FIGS. 12D and 12K.

In FIGS. 12A to 12K, the display panel 100 has the three areas, and the sound generating device is not disposed in the third area corresponding to the central area of the display panel 100. The size of the third area is smaller than the size of the first area and the second area so that it may be possible to improve the sound output properties of the low-range sound. In order to realize the good sound output properties both in the middle-range and high-range sound and the low-range sound, the first area, the second area, and the third area may have the same size. In order to improve the sound output properties of the low-range sound, the size of the third area may be larger than the size of the first area and the second area.

In FIGS. 12J and 12K, the third partition 1700 is formed in the unsealed structure. The third partition 1700 may be formed in the sealed structure.

In FIGS. 12A to 12K, the sound generating device is not disposed in the center of the left area corresponding to the first area or the center of the right area corresponding to the second area in the display panel 100, but is disposed more toward the left area or right area of the display panel 100, but is not limited to this structure. For example, the sound generating device may be disposed in the center of the left area corresponding to the first area or the center of the right area corresponding to the second area in the display panel 100. The sound generating devices may be asymmetrically disposed in the first and second areas of the display panel 100. If the sound generating device is disposed more toward the left area or right area of the display panel 100, the stereo sound properties may be improved in comparison to the case where the sound generating device is disposed in the center of the left area corresponding to the first area or the center of the right area corresponding to the second area in the display panel 100.

The sound output properties of the sound generating device with the bent portion will be described with reference to FIG. 13, and the sound output properties of the sound generating device with the bent portion and the protrusion portion will be described with reference to FIG. 14.

Figure 13:
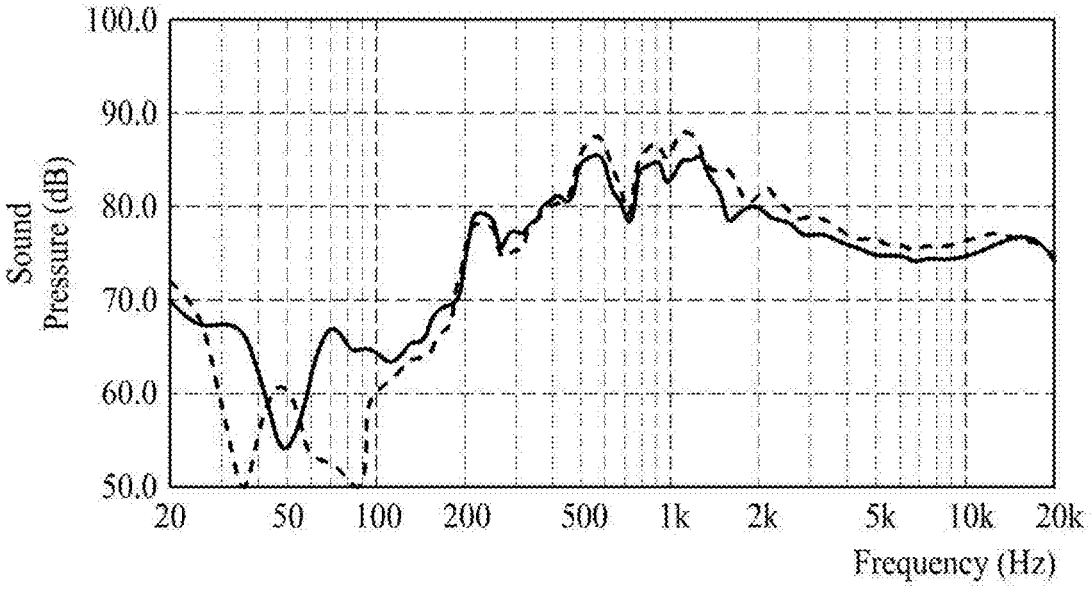
FIG. 13 illustrates the sound output properties in accordance with another example of the sound generating device and partition in the display apparatus according to the present disclosure.

FIG. 13 illustrates the sound output properties in accordance with another example of the sound generating device and partition in the display apparatus according to the present disclosure. In FIG. 13, a dotted line indicates the sound output properties of FIG. 12A, and a solid line indicates the sound output properties of FIG. 12D. With reference to FIG. 13, in comparison to the case without the bent portion, the case with the bent portion has the improved sound output properties in the low-range sound of about 200 Hz or less than 200 Hz.

Figure 14:
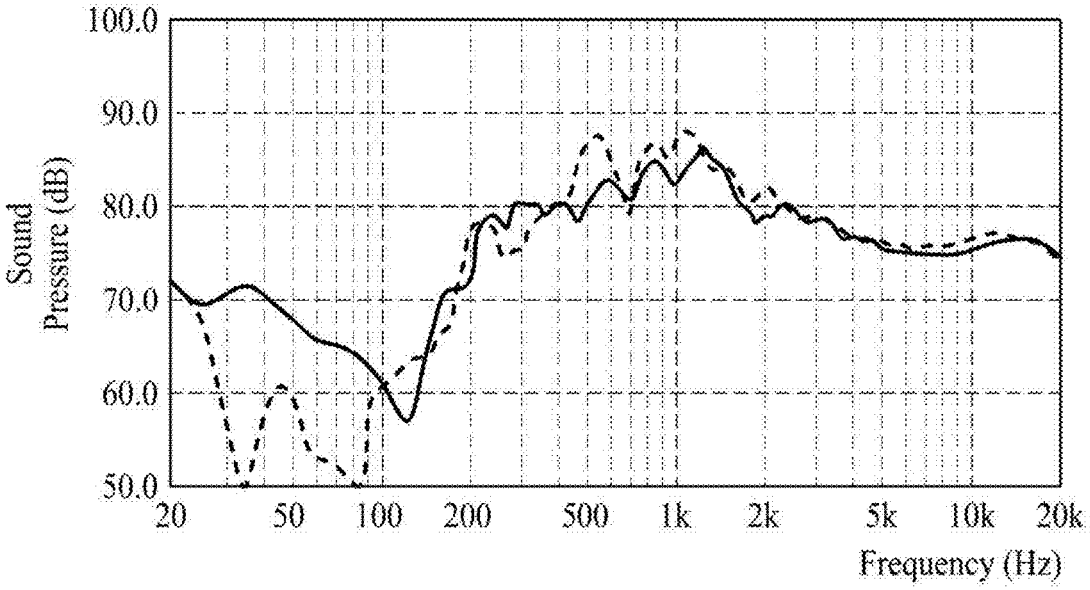
FIG. 14 illustrates the sound output properties in accordance with another example of the sound generating device and partition in the display apparatus according to the present disclosure.

FIG. 14 illustrates the sound output properties in accordance with another example of the sound generating device and partition in the display apparatus according to the present disclosure. In FIG. 14, a dotted line indicates the sound output properties of FIG. 12A, and a solid line indicates the sound output properties of FIG. 12E. With reference to FIG. 14, in comparison to the case without the bent portion and protrusion portion, the case with the bent portion and protrusion portion has the improved frequency properties in the entire-range sound.

The sound output properties of FIGS. 13 and 14 may be measured by a sound analyzing apparatus. The sound analyzing apparatus may include a sound card for receiving sound from a control PC, and transmitting sound to the control PC, an amplifier for amplifying the sound (signal) generated from the sound card, and transmitting the amplified sound to the sound generating device 1600 and 1600', and a microphone for collecting the sound generated in the display panel through the sound generating device 1600 and 1600'. The sound collected in the microphone is provided to the control PC through the sound card, and then the control PC checks the provided sound, and analyzes the sound of the sound generating device 1600 and 1600'.

Figure 15A:
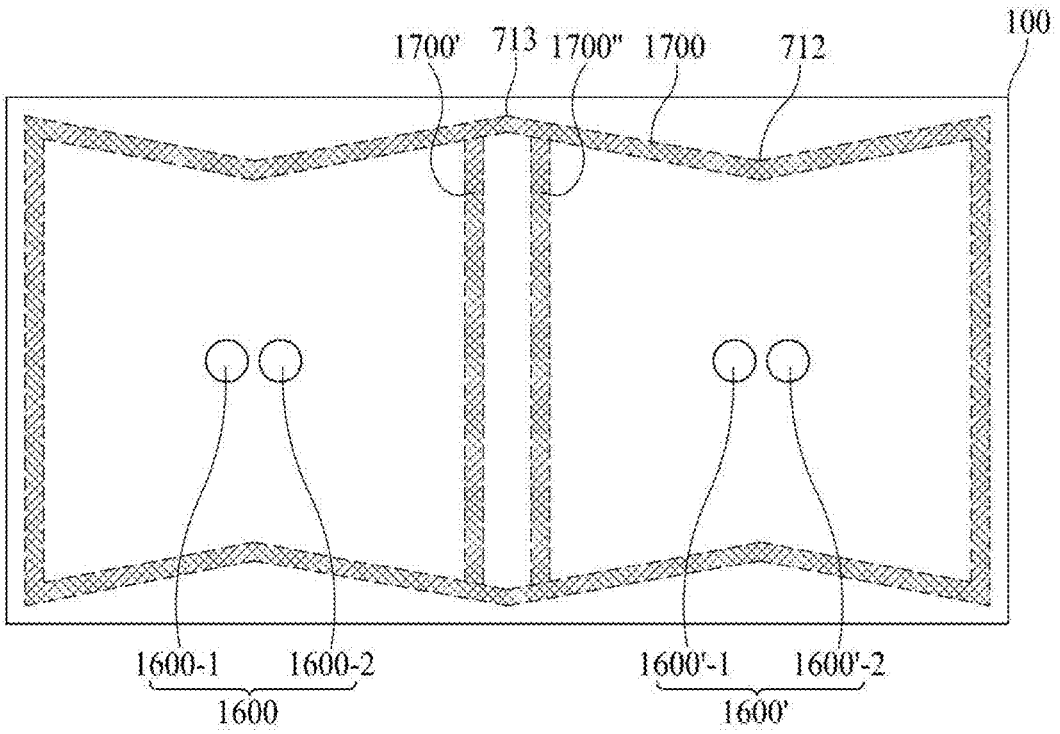
FIGS. 15A to 15D illustrate another example of the sound generating device and partition in the display apparatus according to the present disclosure.
Figure 15B:
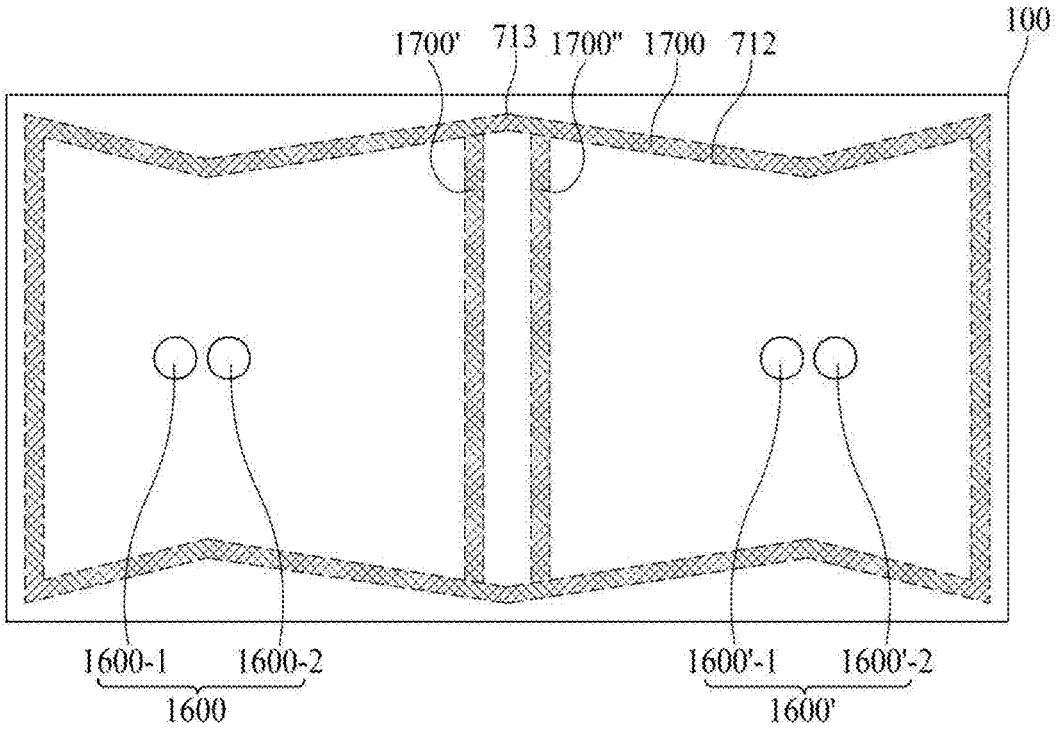
Figure 15C:
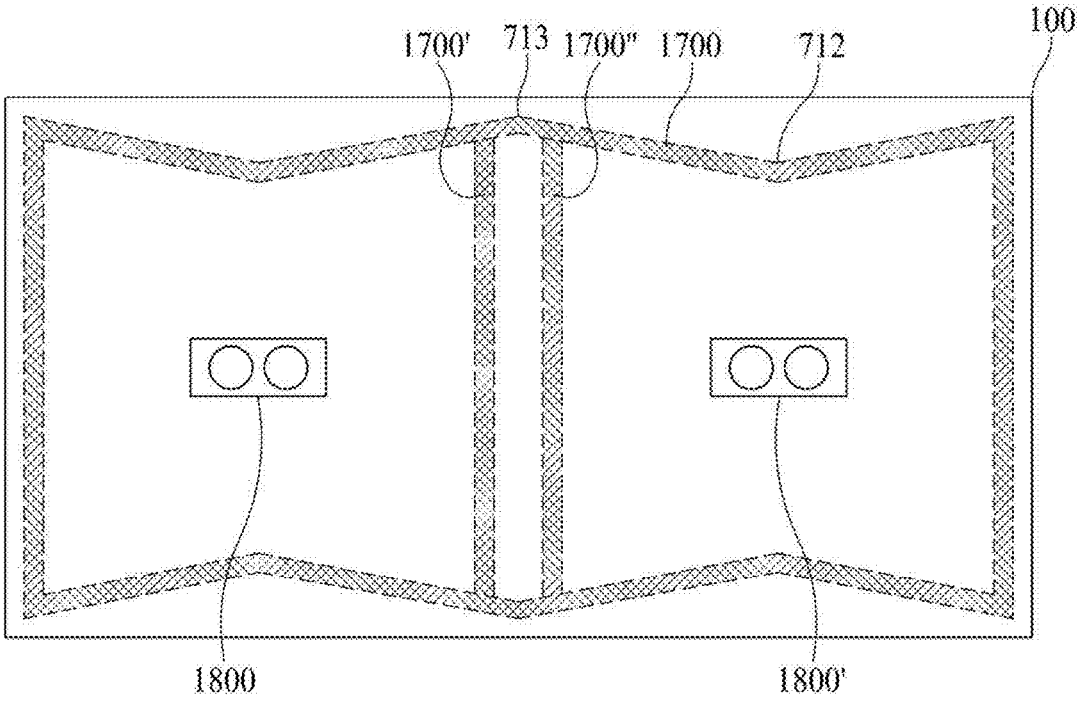
Figure 15D:
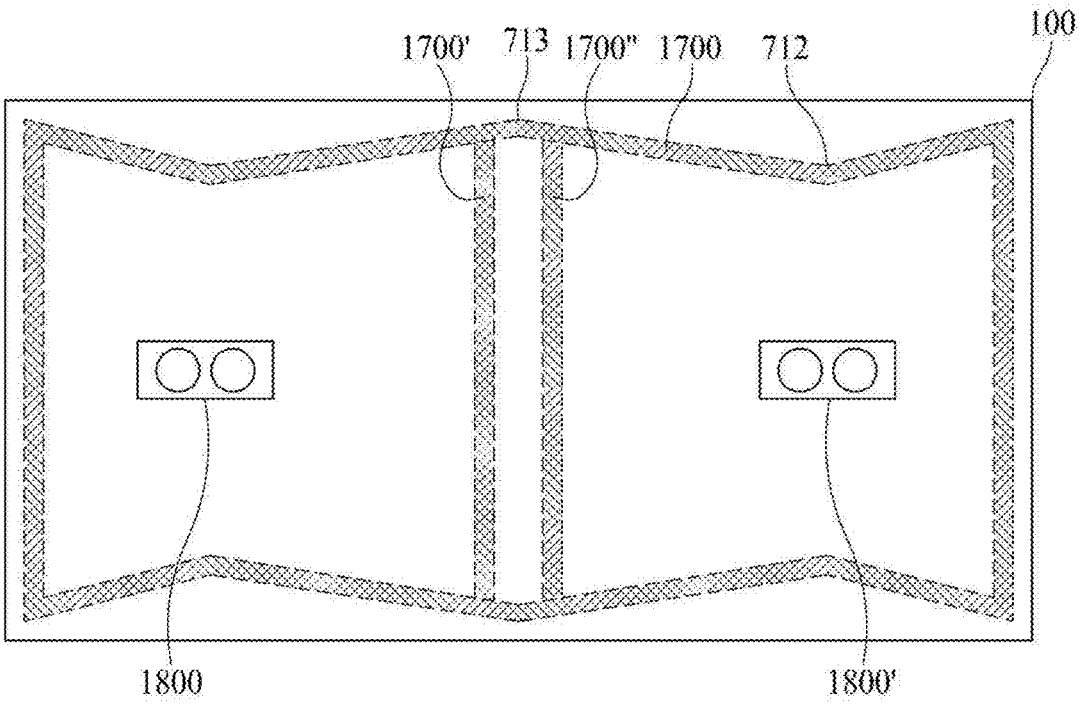

FIGS. 15A to 15D illustrate another example of the sound generating device and partition in the display apparatus according to the present disclosure. In FIGS. 15A and 15B, the two sound generating devices are provided in each of the first and second areas of the display panel. In FIGS. 15C and 15D, the two sound generating devices adjacent to each other are provided in each of the first and second areas of the display panel.

In FIGS. 15A to 15D, the third partition 1700 is formed in the sealed structure. In detail, the third partition 1700 may be formed in the zigzag shape and sealed structure. The bent portion 712 may be formed in the sealed structure, and the bent shape between the first partition 1700' and the second partition 1700' may be formed in the unsealed structure. The bent portion 713 of the third partition 1700 disposed between the first partition 1700' and the second partition 1700' may be formed in a straight line shape, a curved line shape, or a round shape, but not limited to these shapes.

In FIGS. 15A and 15C, the sound generating device is disposed in the center of the left area corresponding to the first area of the display panel 100 or the center of the right area corresponding to the second area of the display panel 100. In FIGS. 15B and 15D, the sound generating devices are asymmetrically disposed. In detail, the sound generating device is disposed more toward the left area or right area of the display panel 100.

With reference to FIGS. 15A and 15B, the first sound generating device 1600 including the two sub sound generating modules 1600-1 and 1600-2 is disposed in the first area corresponding to the left area of the display panel 100. The second sound generating device 1600' including the two sub sound generating modules 1600'-1 and 1600'-2 is disposed in the second area corresponding to the right area of the display panel 100. The first partition 1700' and the second partition 1700" are disposed between the first sound generating device 1600 and the second sound generating device 1600', and the third partition 1700 is disposed in the edge of the display panel 100. The first partition 1700' including the two or more sub partitions may be disposed between the first sound generating device 1600 and the second sound generating device 1600'. Also, the bent portion 712 is formed in at least one side of the third partition 1700, wherein the bent portion 712 is bent toward the center of the first sound generating device 1600 with the two sub sound generating modules 1600-1 and 1600-2 and the center of the second sound generating device 1600' with the two sub sound generating modules 1600'-1 and 1600'-2.

As described in FIGS. 12E, 12G, and 12K, one or more protrusion portions may be provided in the side which is perpendicular to the side with the bent portion 712, or one or more protrusion portions may be provided in the side of the third partition 1700. As described in FIGS. 12H and 12I, one or more protrusion portions may be provided in each of the side which is provided with the bent portion 712 and the side which is perpendicular to the side with the bent portion 712, or one or more protrusion portions may be provided in each side of the first partition 1700', the second partition 1700", and the third partition 1700.

With reference to FIGS. 15C and 15D, a pair of first sound generating devices 1800 is disposed in the first area corresponding to the left area of the display panel 100, and a pair of second sound generating devices 1800' is disposed in the second area corresponding to the right area of the display panel 100. Between the first sound generating devices 1800 and the second sound generating devices 1800', there are at least two partitions of the first partition 1700' and the second partition 1700". Also, the third partition 1700 is disposed in the edge of the display panel 100. The first partition 1700' including the two or more sub partitions may be disposed between the first sound generating devices 1800 and the second sound generating devices 1800'. The bent portion 712 is formed in at least one side of the third partition 1700. The bent portion 712 may be bent toward the center in the pair of first sound generating device 1800 and the center in the pair of the second sound generating devices 1800'.

As described in FIGS. 12E, 12G, and 12K, one or more protrusion portions may be provided in the side which is perpendicular to the side with the bent portion 712, or one or more protrusion portions may be provided in the side of the third partition 1700.

As described in FIGS. 12H and 12I, one or more protrusion portions may be provided in each of the side which is provided with the bent portion 712 and the side which is perpendicular to the side with the bent portion 712, or one or more protrusion portions may be provided in each side of the first partition 1700', the second partition 1700", and the third partition 1700.

Figure 16A:
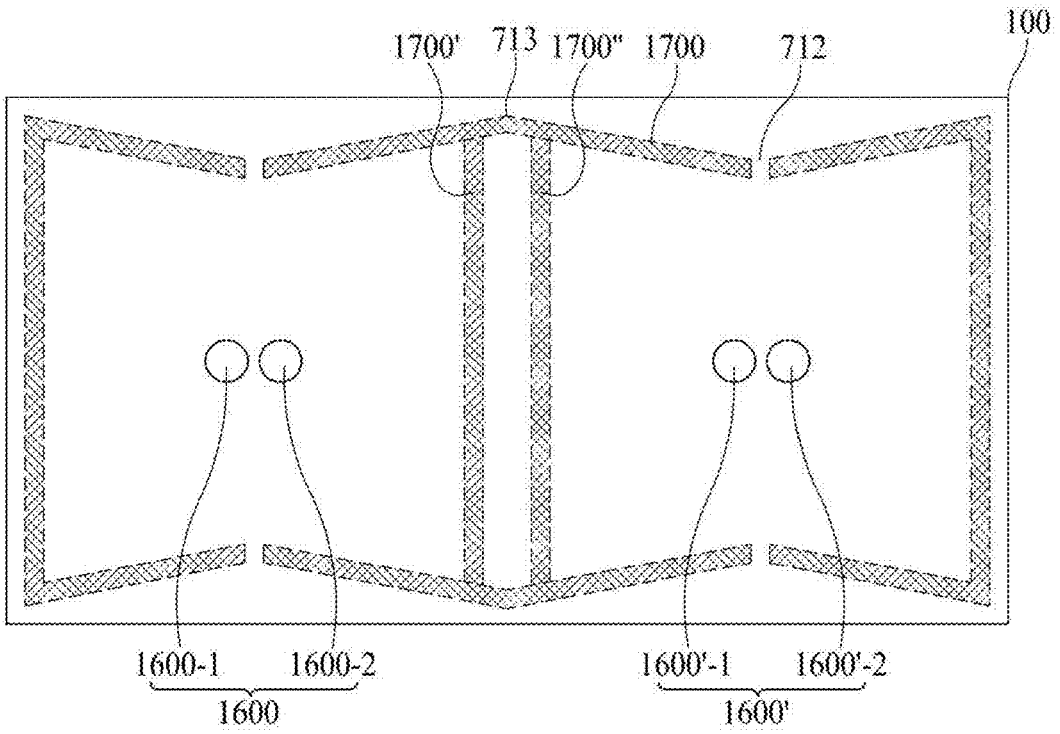
FIGS. 16A to 16D illustrate another example of the sound generating device and partition in the display apparatus according to the present disclosure.
Figure 16B:
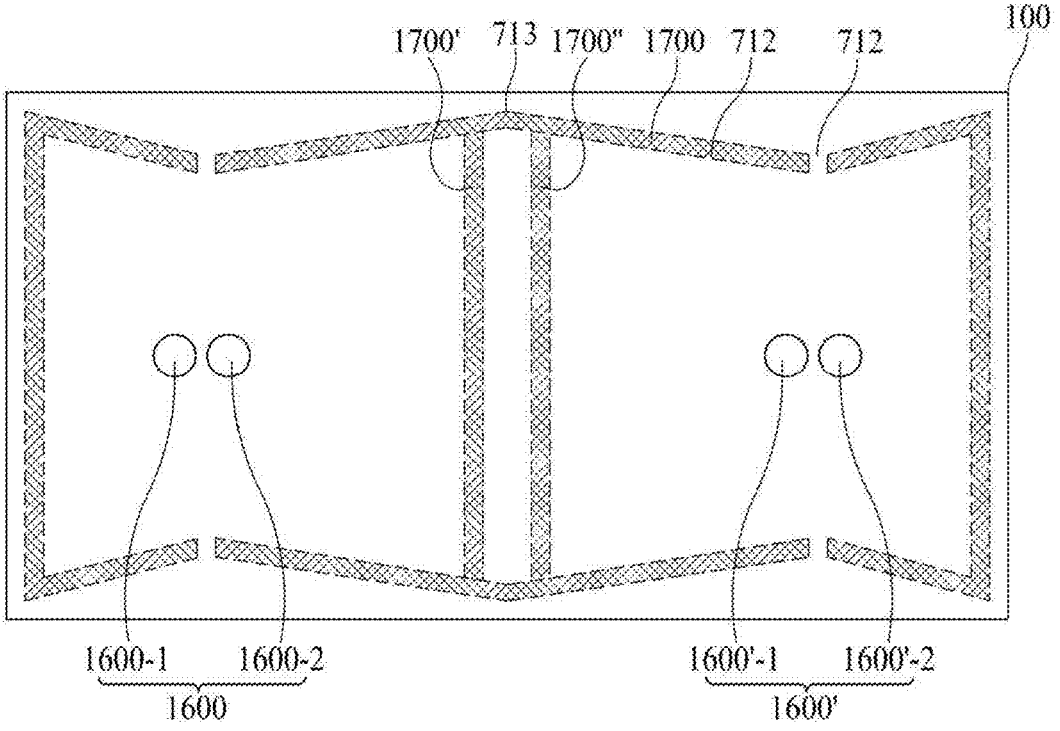
Figure 16C:
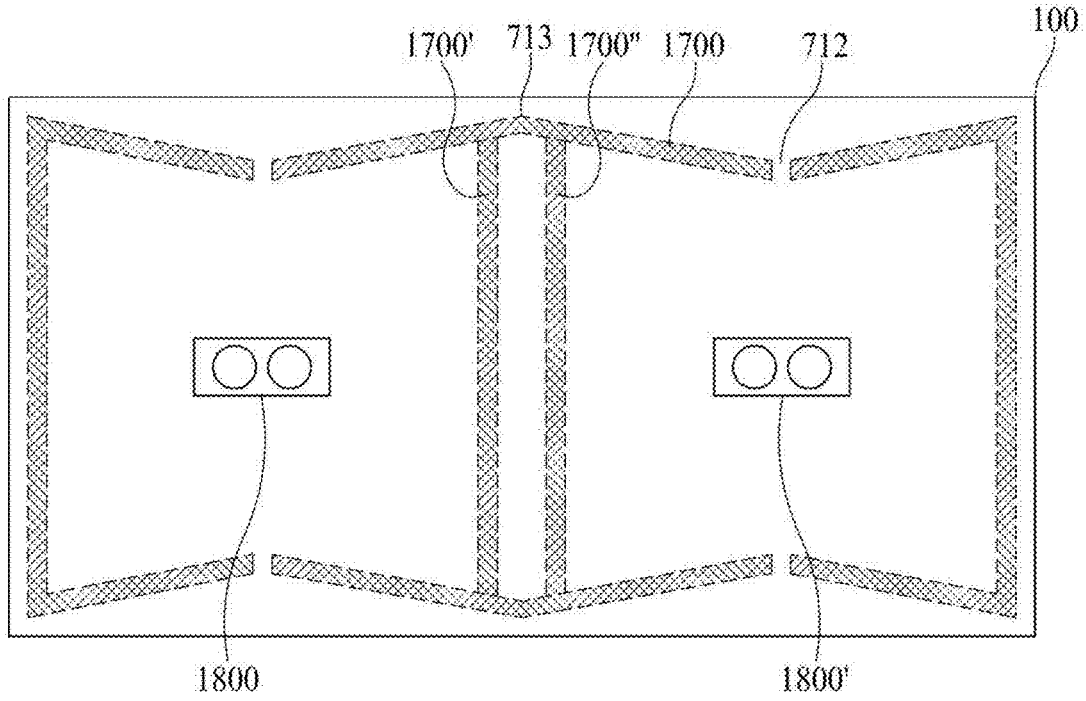
Figure 16D:
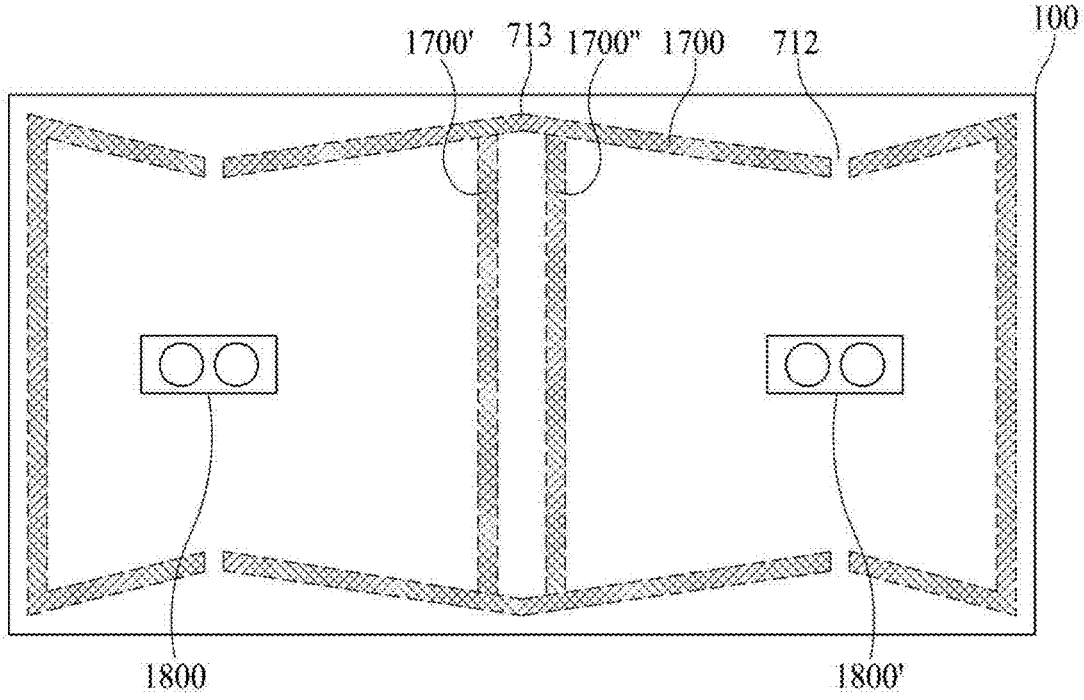

FIGS. 16A to 16D illustrate another example of the sound generating device and partition in the display apparatus according to the present disclosure. In FIGS. 16A and 16B, the two sound generating devices are provided in each of the first and second areas of the display panel. In FIGS. 16C and 16D, the two sound generating devices adjacent to each other are provided in each of the first and second areas of the display panel.

In FIGS. 16A to 16D, the third partition 1700 is formed in the unsealed structure. In detail, the third partition 1700 may be formed in the zigzag shape and unsealed structure. The bent portion 712 may be formed in the unsealed structure, and the bent shape between the first partition 1170' and the second partition 1700' may be formed in the sealed structure. The bent portion of the third partition 1700 disposed between the first partition 1700' and the second partition 1700' may be formed in a straight line shape, a curved line shape, or a round shape, but is not limited to these shapes.

In FIGS. 16A and 16C, the sound generating device is disposed in the center of the left area corresponding to the first area of the display panel 100 or the center of the right area corresponding to the second area of the display panel 100. In FIGS. 16B and 16D, the sound generating devices are asymmetrically disposed. In detail, in case of FIGS. 16B and 16D, the sound generating device is disposed more toward the left area or right area of the display panel 100.

In FIGS. 16A to 16D, as described in FIGS. 12E, 12G, and 12K, one or more protrusion portions may be provided in the side which is perpendicular to the side with the bent portion 712, or one or more protrusion portions may be provided in the side of the third partition 1700.

In FIGS. 16A to 16D, as described in FIGS. 12H and 12I, one or more protrusion portions may be provided in each of the side which is provided with the bent portion 712 and the side which is perpendicular to the side with the bent portion 712, or one or more protrusion portions may be provided in each side of the first partition 1700', the second partition 1700", and the third partition 1700.

FIGS. 17A to 17J illustrate another example of the sound generating device and partition in the display apparatus according to the present disclosure.

With reference to FIGS. 17A to 17J, the display panel 100 includes first, second, and third areas. In this case, the first area corresponds to the left area (L) of the display panel 100, the second area corresponds to the right area (R) of the display panel 100, and the third area corresponds to the central area (C) of the display panel 100. The first sound generating device disposed in the first area of the display panel 100, and the second sound generating device disposed in the second area of the display panel 100 may generate the middle-range and high-range sound, and the third sound generating device disposed in the third area of the display panel 100 may generate the low-range sound.

Accordingly, the third sound generating device may be a woofer speaker, which enables the low-range sound output, and the first sound generating device 1600 and the second sound generating device 1600' enable the stereo sound output, whereby the display apparatus according to an example embodiment of the present disclosure may have the sound output properties of 2.1 channel type.

Figure 17A:
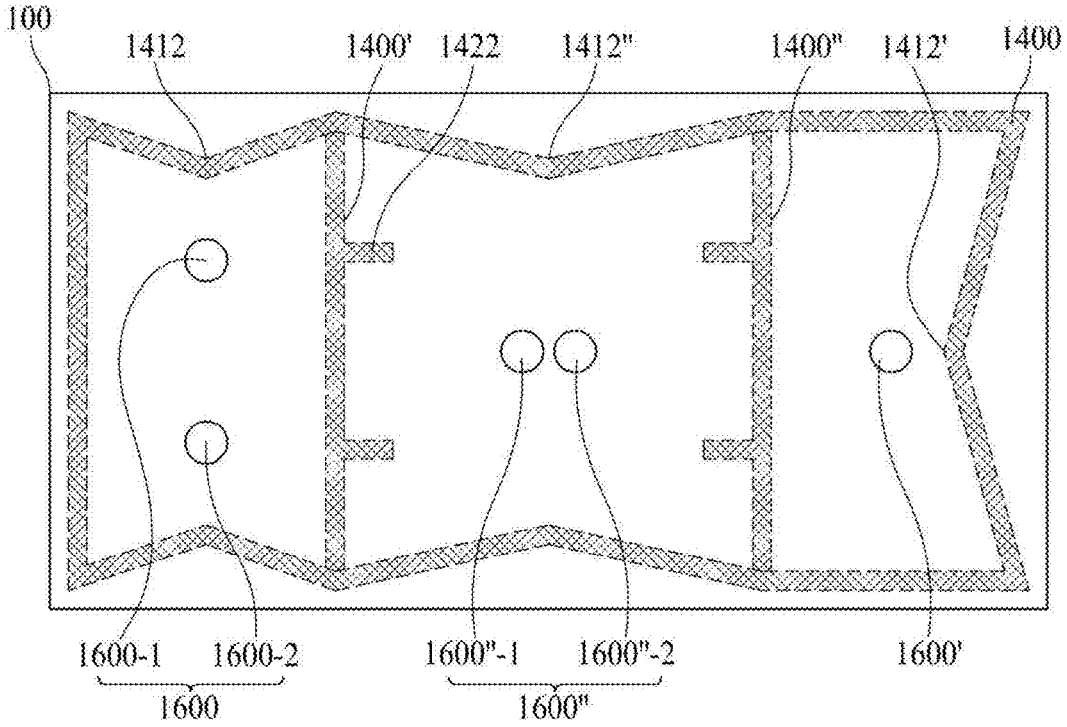
FIGS. 17A to 17J illustrate another example of the sound generating device and partition in the display apparatus according to the present disclosure.

With reference to FIG. 17A, the first sound generating device 1600 including the two sub sound generating modules 1600-1 and 1600-2 is disposed in the first area, the second sound generating device 1600' including the two sub sound generating modules 1600'-1 and 1600'-2 is disposed in the second area, and the third sound generating device 1600" including the two sub sound generating modules 1600"-1 and 1600"-2 is disposed in the third area. The two sub sound generating modules are adjacent to each other, and are parallel to each other in the horizontal direction or vertical direction of the display panel. In comparison to the sound generating device with the two sub sound generating modules spaced from each other, the sound generating device with the two sub sound generating modules adjacent to each other may further prevent deterioration of sound quality.

The first sound generating device 1600 disposed in the first area, and the second sound generating device 1600' disposed in the second area may generate the middle-range and high-range sound, and the third sound generating device 1600" disposed in the third area may generate the low-range sound. In detail, the 1-1 sub sound generating module 1600-1 corresponding to one of the two sub sound generating modules 1600-1 and 1600-2 included in the first sound generating device 1600 of the first area may generate the high-range sound, and the 1-2 sub sound generating module 1600-2 corresponding to the other of the two sub sound generating modules 1600-1 and 1600-2 included in the first sound generating device 1600 of the first area may generate the middle-range sound. The sound generated in the upper side of the display panel 100 is relatively higher-ranged than the sound generated in the lower side of the display panel so that it may be possible to generate the higher-ranged sound.

The first partition 1400' is disposed between the first sound generating device 1600 and the third sound generating device 1600", and the second partition 1400" is disposed between the second sound generating device 1600' and the third sound generating device 1600". The first partition 1400' prevents the vibration of the display panel 100 from being transferred from the first area to the third area, and the second partition 1400" prevents the vibration of the display panel 100 from being transferred from the second area to the third area. The third partition 1400 is disposed in the edge of the display panel 100, and the third partition 1400 is formed in the sealed structure.

The first bent portion 1412 is provided in the first area, wherein the first bent portion 1412 is bent toward the center of the first sound generating device 1600 with the two sub sound generating modules 1600-1 and 1600-2. The third bent portion 1412" is provided in the third area, wherein the third bent portion 1412" is bent toward the center of the third sound generating device 1600" with the two sub sound generating modules 1600"-1 and 1600"-2. If the second sound generating device 1600' is disposed in the second area corresponding to the right area of the display panel 100, the second bent portion 1412', which is bent toward the second sound generating device 1600', is provided in the side which is perpendicular to the side with the first bent portion 1412.

The protrusion portion 1422, which protrudes toward the third sound generating device 1600", is formed in the left and right sides of the third area. The protrusion portion 1422 is provided to decrease the reduction of sound pressure in the central area of the display panel 100 for the low-range sound by the standing wave.

In FIG. 17A, the first sound generating device 1600 and the second sound generating device 1600' are respectively disposed in the center of the left area corresponding to the first area of the display panel 100 and the center of the right area corresponding to the second area of the display panel 100, but are not limited to this structure. At least one of the first sound generating device 1600 and the second sound generating device 1600' may be disposed asymmetrically. In detail, at least one of the first sound generating device 1600 and the second sound generating device 1600' may be disposed more toward the left area or right area of the display panel 100, or each of the first sound generating device 1600 and the second sound generating device 1600' may be disposed more toward the left area and right area of the display panel 100.

The sound generating device may include at least one sound generating module or at least one pair of sound generating modules. In more detail, at least one sound generating module may be disposed in each of the left area and the right area, and at least one pair of sound generating modules may be disposed in the central area. Also, at least one sound generating module may include the two sub sound generating modules, and each of the two sub sound generating modules may generate the middle-range and high-range sound.

Figure 17B:
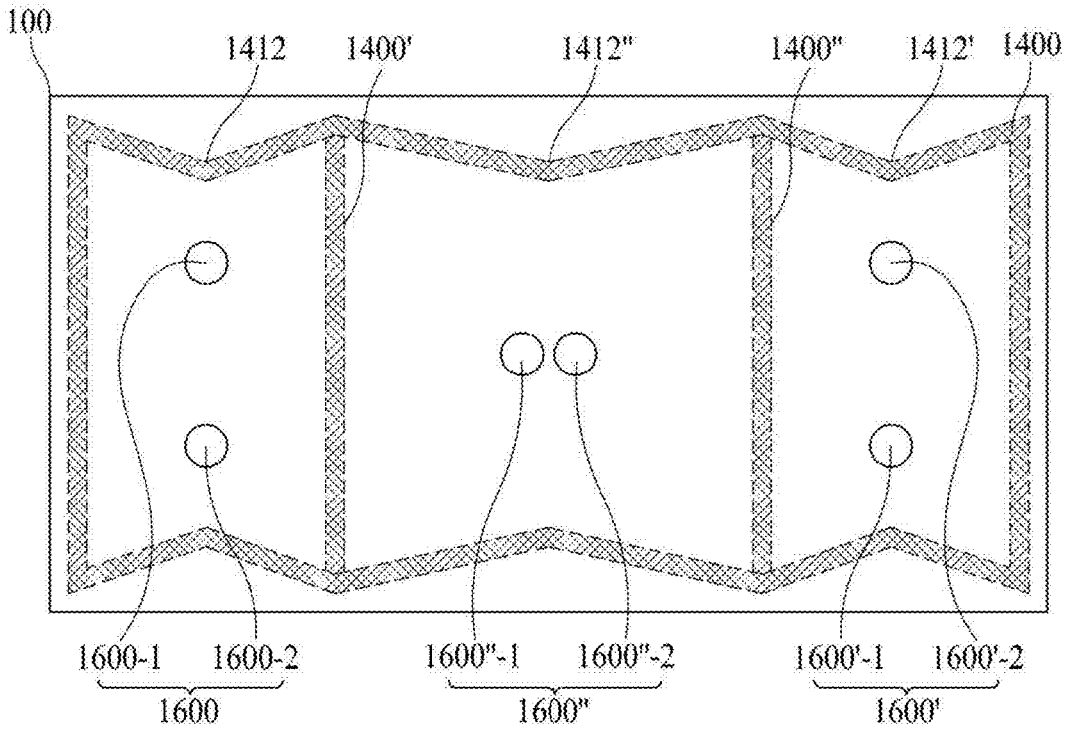

With reference to FIG. 17B, the first sound generating device 1600 including the two sub sound generating modules 1600-1 and 1600-2 is disposed in the first area, the second sound generating device 1600' including the two sub sound generating modules 1600'-1 and 1600'-2 is disposed in the second area, and the third sound generating device 1600" including the two sub sound generating modules 1600"-1 and 1600"-2 is disposed in the third area. In this case, each of the first sound generating device 1600, the second sound generating device 1600', and the third sound generating device 1600" includes the two sub sound generating modules adjacent to each other.

The first sound generating device 1600 disposed in the first area and the second sound generating device 1600' disposed in the second area may generate the middle-range and high-range sound, and the third sound generating device 1600" disposed in the third area may generate the low-range sound. In detail, the 1-1 sub sound generating module 1600-1 corresponding to one of the two sub sound generating modules 1600-1 and 1600-2 included in the first sound generating device 1600 of the first area may generate the high-range sound, and the 1-2 sub sound generating module 1600-2 corresponding to the other of the two sub sound generating modules 1600-1 and 1600-2 included in the first sound generating device 1600 of the first area may generate the middle-range sound. The 2-1 sub sound generating module 1600'-1 corresponding to one of the two sub sound generating modules 1600'- and 1600'-2 included in the second sound generating device 1600' of the second area may generate the high-range sound, and the 2-2 sub sound generating module 1600'-2 corresponding to the other of the two sub sound generating modules 1600'-1 and 1600'-2 included in the second sound generating device 1600' of the second area may generate the middle-range sound. The sound generated in the upper side of the display panel 100 is relatively higher-ranged than the sound generated in the lower side of the display panel so that it may be possible to generate the higher-ranged sound.

The first partition 1400' is disposed between the first sound generating device 1600 and the third sound generating device 1600", and the second partition 1400" is disposed between the second sound generating device 1600' and the third sound generating device 1600". The third partition 1400 is formed in the edge of the display panel 100, wherein the third partition 1400 is formed in the sealed structure.

The first bent portion 1412 is provided in the first area, wherein the first bent portion 1412 is bent toward the center of the first sound generating device 1600 with the two sub sound generating modules 1600-1 and 1600-2. The second bent portion 1412' is provided in the second area, wherein the second bent portion 1412 is bent toward the center of the second sound generating device 1600' with the two sub sound generating modules 1600'-1 and 1600'-2. The third bent portion 1412" is provided in the third area, wherein the third bent portion 1412" is bent toward the center of the third sound generating device 1600" with the two sub sound generating modules 1600"-1 and 1600"-2.

As described in FIG. 17A, the protrusion portion, which protrudes toward the third sound generating device 1600", may be formed in the left and right sides of the third area, that is, in each of the first partition 1400' and the second partition 1400".

In FIG. 17B, the first sound generating device 1600 is disposed in the center of the left area corresponding to the first area of the display panel 100, but is not limited to this structure. The first sound generating device 1600 may be disposed asymmetrically. In detail, the first sound generating device 1600 may be disposed more toward the left area corresponding to the first area of the display panel 100. The second sound generating device 1600' is disposed in the center of the right area corresponding to the second area of the display panel 100, but is not limited to this structure. The second sound generating device 1600' may be disposed asymmetrically. In detail, the second sound generating device 1600' may be disposed more toward the right area corresponding to the second area of the display panel 100. Accordingly, one of the first sound generating device 1600 and the second sound generating device 1600' may be disposed asymmetrically. In detail, at least one of the first sound generating device 1600 and the second sound generating device 1600' may be disposed more toward the left area or right area of the display panel 100, or each of the first sound generating device 1600 and the second sound generating device 1600' may be disposed more toward the left area and right area of the display panel 100.

Figure 17C:
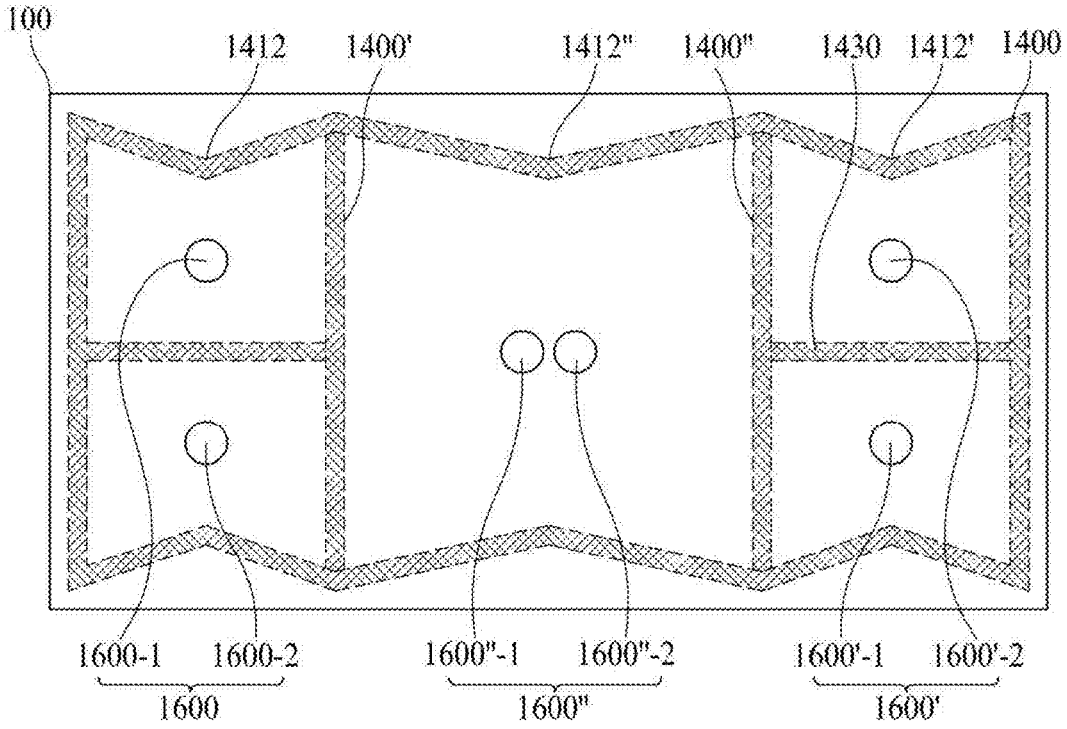

With reference to FIG. 17C, the first sound generating device 1600 including the two sub sound generating modules 1600-1 and 1600-2 is disposed in the first area, the second sound generating device 1600' including the two sub sound generating modules 1600'-1 and 1600'-2 is disposed in the second area, and the third sound generating device 1600" including the two sound generating devices being adjacent to each other is disposed in the third area.

The first partition 1400' is disposed between the first sound generating device 1600 and the third sound generating device 1600", and the second partition 1400" is disposed between the second sound generating device 1600' and the third sound generating device 1600". The third partition 1400 is formed in the edge of the display panel 100, wherein the third partition 1400 is formed in the sealed structure.

Also, each fourth partition 1430 is disposed between each of the two sub sound generating modules 1600-1 and 1600-2 included in the first sound generating device 1600 of the first area, and between each of the two sub sound generating modules 1600'-1 and 1600'-2 included in the second sound generating device 1600' of the second area. The fourth partition 1430 of the first area separates the high-range sound and the middle-range sound respectively generated in the 1-1 sub sound generating module 1600-1 and the 1-2 sub sound generating module 1600-2 included in the first sound generating device 1600 from each other, to thereby realize the more-improved sound output properties. The fourth partition 1430 of the second area separates the high-range sound and the middle-range sound respectively generated in the 2-1 sub sound generating module 1600'-1 and the 2-2 sub sound generating module 1600'-2 included in the second sound generating device 1600' from each other, to thereby realize more-improved sound output properties.

The first bent portion 1412 is provided in the first area, wherein the first bent portion 1412 is bent toward the center of the first sound generating device 1600 with the two sub sound generating modules 1600-1 and 1600-2. The second bent portion 1412' is provided in the second area, wherein the second bent portion 1412 is bent toward the center of the second sound generating device 1600' with the two sub sound generating modules 1600'-1 and 1600'-2. The third bent portion 1412" is provided in the third area, wherein the third bent portion 1412" is bent toward the center of the third sound generating device 1600" with the two sound generating devices being adjacent to each other.

As shown in FIG. 17A, the protrusion portion, which protrudes toward the third sound generating device 1600", may be formed in the left and right sides of the third area, that is, in each of the first partition 1400' and the second partition 1400".

In FIG. 17C, the first sound generating device 1600 is disposed in the center of the left area corresponding to the first area of the display panel 100, but is not limited to this structure. The first sound generating device 1600 may be disposed asymmetrically. In detail, the first sound generating device 1600 may be disposed more toward the left area corresponding to the first area of the display panel 100. The second sound generating device 1600' is disposed in the center of the right area corresponding to the second area of the display panel 100, but is not limited to this structure. The second sound generating device 1600' may be disposed asymmetrically. In detail, the second sound generating device 1600' may be disposed more toward the right area corresponding to the second area of the display panel 100. Accordingly, one of the first sound generating device 1600 and the second sound generating device 1600' may be disposed asymmetrically. In detail, at least one of the first sound generating device 1600 and the second sound generating device 1600' may be disposed more toward the left area or right area of the display panel 100, or each of the first sound generating device 1600 and the second sound generating device 1600' may be disposed more toward the left area and right area of the display panel 100.

In FIGS. 17B and 17C, the first sound generating device 1600 disposed in the first area, and the second sound generating device 1600' disposed in the second area may generate the middle-range and high-range sound, and the third sound generating device 1600" disposed in the third area may generate the low-range sound. In detail, the 1-1 sub sound generating module 1600-1 corresponding to one of the two sub sound generating modules 1600-1 and 1600-2 included in the first sound generating device 1600 of the first area may generate the high-range sound, and the 1-2 sub sound generating module 1600-2 corresponding to the other of the two sub sound generating modules 1600-1 and 1600-2 included in the first sound generating device 1600 of the first area may generate the middle-range sound. The 2-1 sub sound generating module 1600'-1 corresponding to one of the two sub sound generating modules 1600'-1 and 1600'-2 included in the second sound generating device 1600' of the second area may generate the high-range sound, and the 2-2 sub sound generating module 1600'-2 corresponding to the other of the two sub sound generating modules 1600'-1 and 1600'-2 included in the second sound generating device 1600' of the second area may generate the middle-range sound. The sound generated in the upper side of the display panel 100 is relatively higher-ranged than the sound generated in the lower side of the display panel so that it may be possible to generate the higher-ranged sound.

Figure 17D:
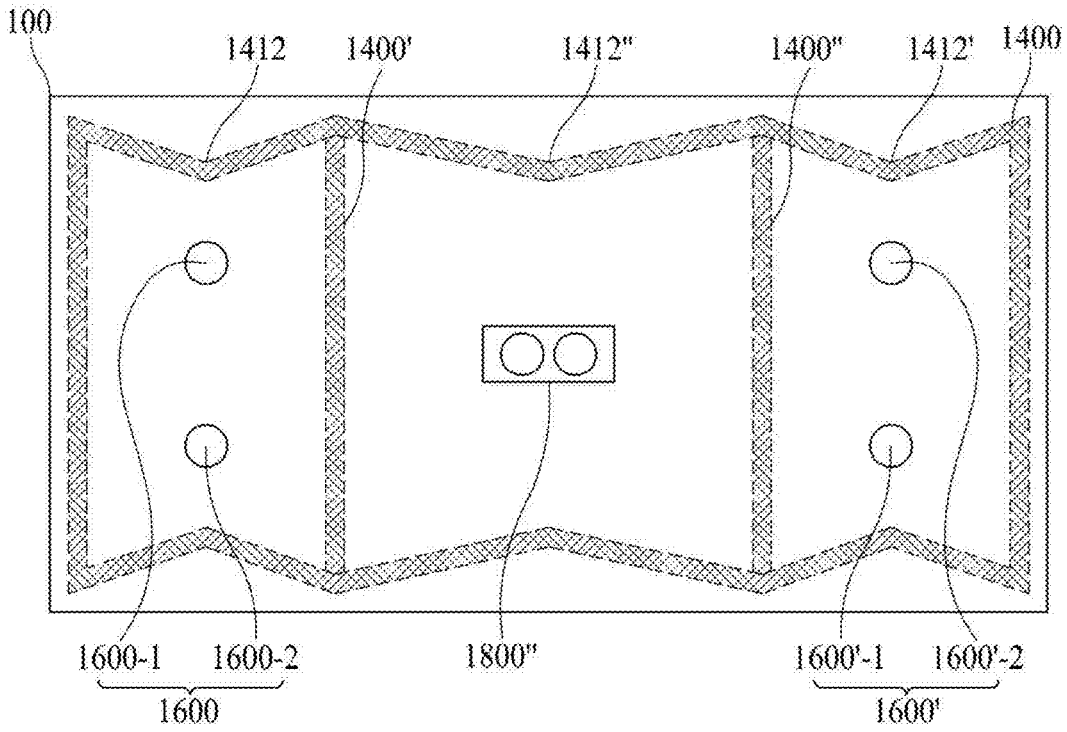

With reference to FIG. 17D, the first sound generating device 1600 including the two sub sound generating modules 1600-1 and 1600-2 is disposed in the first area, the second sound generating device 1600' including the two sub sound generating modules 1600'-1 and 1600'-2 is disposed in the second area, and one pair of third sound generating devices 1800" is disposed in the third area.

The first partition 1400' is disposed between the first sound generating device 1600 and the third sound generating device 1800", and the second partition 1400" is disposed between the second sound generating device 1600' and the third sound generating device 1800". The third partition 1400 is formed in the edge of the display panel 100, wherein the third partition 1400 is formed in the sealed structure.

The first bent portion 1412 is provided in the first area, wherein the first bent portion 1412 is bent toward the center of the first sound generating device 1600 with the two sub sound generating modules 1600-1 and 1600-2. The second bent portion 1412' is provided in the second area, wherein the second bent portion 1412' is bent toward the center of the second sound generating device 1600' with the two sub sound generating modules 1600'-1 and 1600'-2. The third bent portion 1412" is provided in the third area, wherein the third bent portion 1412" is bent toward the center of the third sound generating device 1600" with the two sound generating devices being adjacent to each other.

As shown in FIG. 17A, the protrusion portion, which protrudes toward the third sound generating device 1600", may be formed in the left and right sides of the third area, that is, in each of the first partition 1400' and the second partition 1400".

Figure 17E:
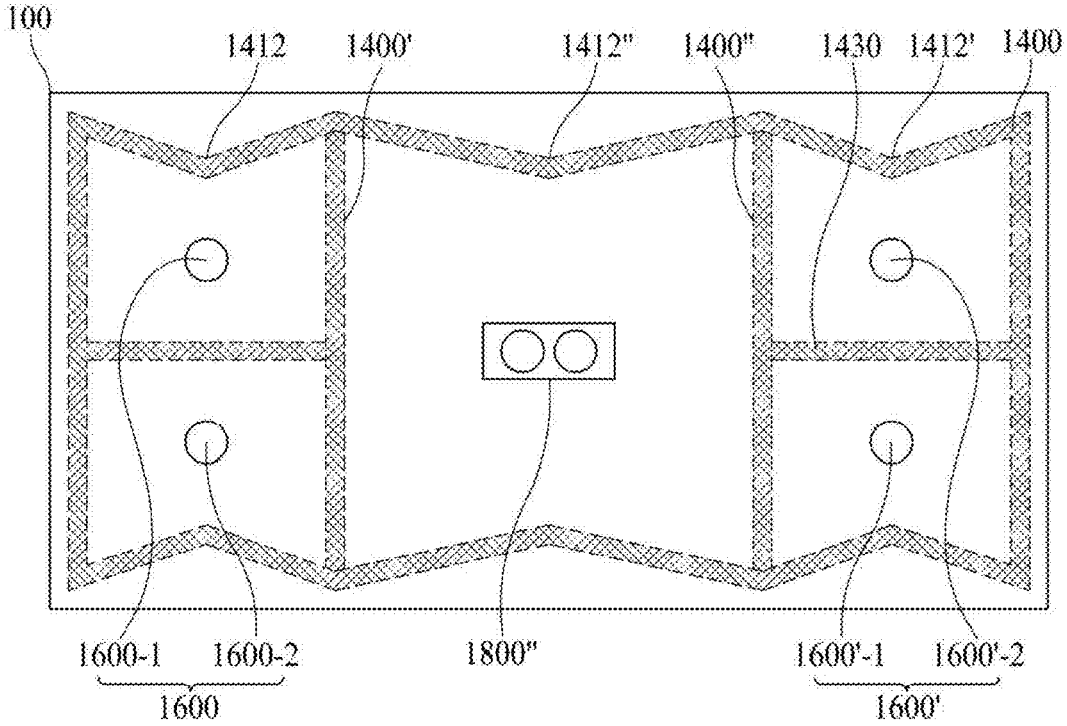

With reference to FIG. 17E, the first sound generating device 1600 including the two sub sound generating modules 1600-1 and 1600-2 is disposed in the first area, the second sound generating device 1600' including the two sub sound generating modules 1600'-1 and 1600'-2 is disposed in the second area, and the third sound generating device 1800" with one pair of sound generating devices is disposed in the third area. The first partition 1400' is disposed between the first sound generating device 1600 and the third sound generating device 1800", and the second partition 1400" is disposed between the second sound generating device 1600' and the third sound generating device 1800". The third partition 1400 is formed in the edge of the display panel 100, wherein the third partition 1400 is formed in the sealed structure.

Also, each fourth partition 1430 is disposed between each of the two sub sound generating modules 1600-1 and 1600-2 included in the first sound generating device 1600 of the first area, and between each of the two sub sound generating modules 1600'-1 and 1600'-2 included in the second sound generating device 1600' of the second area. The fourth partition 1430 of the first area separates the high-range sound and the middle-range sound respectively generated in the 1-1 sub sound generating module 1600-1 and the 1-2 sub sound generating module 1600-2 included in the first sound generating device 1600 from each other, to thereby realize more-improved sound output properties. The fourth partition 1430 of the second area separates the high-range sound and the middle-range sound respectively generated in the 2-1 sub sound generating module 1600'-1 and the 2-2 sub sound generating module 1600'-2 included in the second sound generating device 1600' from each other, to thereby realize more-improved sound output properties.

The first bent portion 1412 is provided in the first area, wherein the first bent portion 1412 is bent toward the center of the first sound generating device 1600 with the two sub sound generating modules 1600-1 and 1600-2. The second bent portion 1412' is provided in the second area, wherein the second bent portion 1412 is bent toward the center of the second sound generating device 1600' with the two sub sound generating modules 1600'-1 and 1600'-2. The third bent portion 1412" is provided in the third area, wherein the third bent portion 1412" is bent toward the center of the third sound generating device 1800" with the two sound generating devices being adjacent to each other.

As shown in FIG. 17A, the protrusion portion, which protrudes toward the third sound generating device 1800", may be formed in the left and right sides of the third area, that is, in each of the first partition 1400' and the second partition 1400".

In FIGS. 17D and 17E, the first sound generating device 1600 is disposed in the center of the left area corresponding to the first area of the display panel 100, but is not limited to this structure. The first sound generating device 1600 may be disposed asymmetrically. In detail, the first sound generating device 1600 may be disposed more toward the left area corresponding to the first area of the display panel 100. The second sound generating device 1600' is disposed in the center of the right area corresponding to the second area of the display panel 100, but is not limited to this structure. The second sound generating device 1600' may be disposed asymmetrically. In detail, the second sound generating device 1600' may be disposed more toward the right area corresponding to the second area of the display panel 100. Accordingly, one of the first sound generating device 1600 and the second sound generating device 1600' may be disposed asymmetrically. In detail, at least one of the first sound generating device 1600 and the second sound generating device 1600' may be disposed more toward the left area or right area of the display panel 100, or each of the first sound generating device 1600 and the second sound generating device 1600' may be disposed more toward the left area and right area of the display panel 100.

In FIGS. 17D and 17E, the first sound generating device 1600 disposed in the first area and the second sound generating device 1600' disposed in the second area may generate the middle-range and high-range sound, and the third sound generating device 1800" disposed in the third area may generate the low-range sound. In detail, the 1-1 sub sound generating module 1600-1 corresponding to one of the two sub sound generating modules 1600-1 and 1600-2 included in the first sound generating device 1600 of the first area may generate the high-range sound, and the 1-2 sub sound generating module 1600-2 corresponding to the other of the two sub sound generating modules 1600-1 and 1600-2 included in the first sound generating device 1600 of the first area may generate the middle-range sound. The 2-1 sub sound generating module 1600'-1 corresponding to one of the two sub sound generating modules 1600'-1 and 1600'-2 included in the second sound generating device 1600' of the second area may generate the high-range sound, and the 2-2 sub sound generating module 1600'-2 corresponding to the other of the two sub sound generating modules 1600'-1 and 1600'-2 included in the second sound generating device 1600' of the second area may generate the middle-range sound. The sound generated in the upper side of the display panel 100 is relatively higher-ranged than the sound generated in the lower side of the display panel so that it may be possible to generate the higher-ranged sound.

Figure 17F:
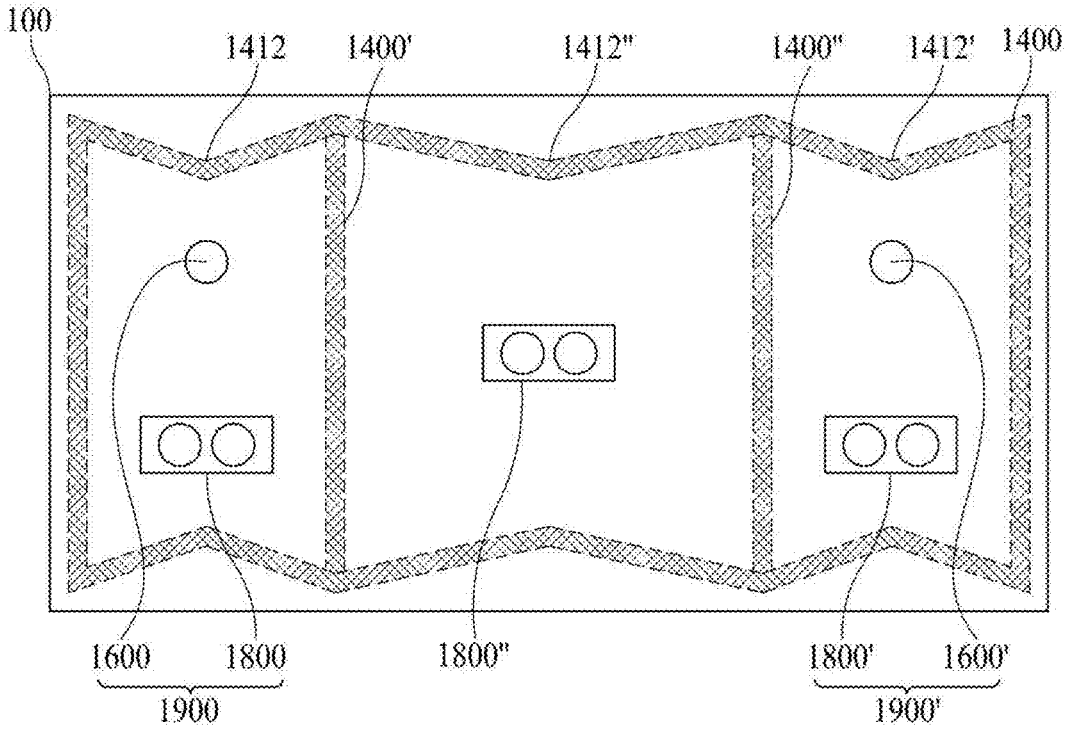

With reference to FIG. 17F, the first sound generating device 1900, which includes the first sub sound generating module 1600 with one sound generating device, and the second sub sound generating module 1800 with one pair of sound generating devices, is disposed in the first area. The second sound generating device 1900', which includes the third sub sound generating module 1600', and the fourth sub sound generating module 1800' with one pair of sound generating devices, is disposed in the second area. The third sound generating device 1800" including one pair of sound generating devices is disposed in the third area.

The first partition 1400' is disposed between the first sound generating device 1900 and the third sound generating device 1800", and the second partition 1400" is disposed between the second sound generating device 1900' and the third sound generating device 1800". The third partition 1400 is formed in the edge of the display panel 100, wherein the third partition 1400 is formed in the sealed structure.

The first bent portion 1412 is provided in the first area, wherein the first bent portion 1412 is bent toward the center of the first sub sound generating module 1600 and the center of the second sub sound generating module 1800 including one pair of sound generating devices. The second bent portion 1412' is provided in the second area, wherein the second bent portion 1412' is bent toward the center of the third sub sound generating module 1600' and the center of the fourth sub sound generating module 1800' including one pair of sound generating devices. The third bent portion 1412" is provided in the third area, wherein the third bent portion 1412" is bent toward the center of the third sound generating device 1800" with one pair of sound generating devices.

As shown in FIG. 17A, the protrusion portion, which protrudes toward the third sound generating device 1800", may be formed in the left and right sides of the third area, that is, in each of the first partition 140' and the second partition 1400".

Figure 17G:
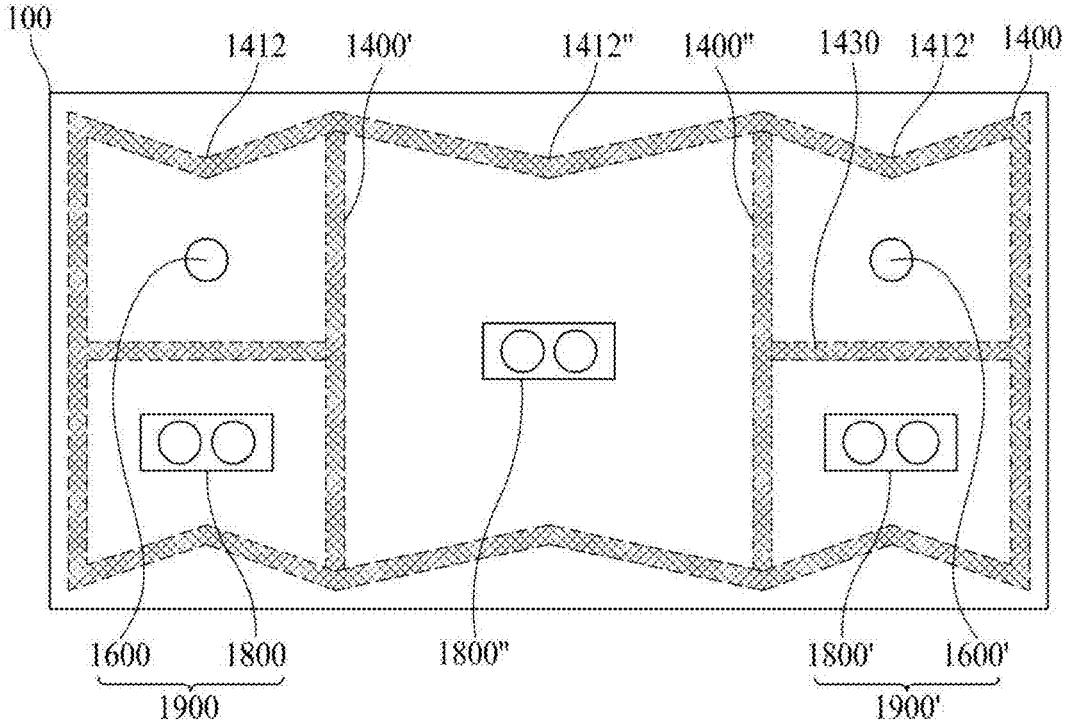

With reference to FIG. 17G, the first sound generating device 1900, which includes the first sub sound generating module 1600 with one sound generating device, and the second sub sound generating module 1800 with one pair of sound generating devices, is disposed in the first area. The second sound generating device 1900', which includes the third sub sound generating module 1600', and the fourth sub sound generating module 1800' with one pair of sound generating devices, is disposed in the second area. The third sound generating device 1800" including one pair of sound generating devices is disposed in the third area.

The first partition 1400' is disposed between the first sound generating device 1900 and the third sound generating device 1800", and the second partition 1400" is disposed between the second sound generating device 1900' and the third sound generating device 1800". The third partition 1400 is formed in the edge of the display panel 100, wherein the third partition 1400 is formed in the sealed structure.

Also, each fourth partition 1430 is disposed between the first sub sound generating module 1600 and the second sub sound generating module 1800 in the first area, and between the third sub sound generating module 1600' and the fourth sub sound generating module 1800' in the second area. The fourth partition 1430 of the first area separates the high-range sound and the middle-range sound respectively generated in the first sub sound generating module 1600 and the second sub sound generating module 1800 of the first sound generating device 1900 of the first area from each other, to thereby realize more-improved sound output properties. The fourth partition 1430 of the second area separates the high-range sound and the middle-range sound respectively generated in the third sub sound generating module 1600' and the fourth sub sound generating module 1800' of the second area from each other, to thereby realize more-improved sound output properties.

The first bent portion 1412 is provided in the first area, wherein the first bent portion 1412 is bent toward the center of the first sub sound generating module 1600 and the center of the second sub sound generating module 1800 including one pair of sound generating devices. The second bent portion 1412' is provided in the second area, wherein the second bent portion 1412' is bent toward the center of the third sub sound generating module 1600' and the center of the fourth sub sound generating module 1800' including one pair of sound generating devices. The third bent portion 1412" is provided in the third area, wherein the third bent portion 1412" is bent toward the center of the third sound generating device 1800" with one pair of sound generating devices.

As shown in FIG. 17A, the protrusion portion, which protrudes toward the third sound generating device 1800", may be formed in the left and right sides of the third area, that is, in each of the first partition 1400' and the second partition 1400".

In FIGS. 17F and 17G, the first sound generating device 1900 is disposed in the center of the left area corresponding to the first area of the display panel 100, but not limited to this structure. The first sound generating device 1900 may be disposed asymmetrically. In detail, the first sound generating device 1900 may be disposed more toward the left area corresponding to the first area of the display panel 100. The second sound generating device 1900' is disposed in the center of the right area corresponding to the second area of the display panel 100, but is not limited to this structure. The second sound generating device 1900' may be disposed asymmetrically. In detail, the second sound generating device 1900' may be disposed more toward the right area corresponding to the second area of the display panel 100. Accordingly, one of the first sound generating device 1900 and the second sound generating device 1900' may be disposed asymmetrically. In detail, at least one of the first sound generating device 1900 and the second sound generating device 1900' may be disposed more toward the left area or right area of the display panel 100, or each of the first sound generating device 1900 and the second sound generating device 1900' may be disposed more toward the left area and right area of the display panel 100.

In FIGS. 17F and 17G, the first sound generating device 1900 disposed in the first area, and the second sound generating device 1900' disposed in the second area may generate the middle-range and high-range sound, and the third sound generating device 1800" disposed in the third area may generate the low-range sound. In detail, the first sub sound generating module 1600 corresponding to the first sound generating device 1900 of the first area may generate the high-range sound, and the second sub sound generating module 1800 may generate the middle-range sound. The third sub sound generating module 1600' corresponding to the second sound generating device 1900' of the second area may generate the high-range sound, and the fourth sub sound generating module 1800' may generate the middle-range sound. The sound generated in the upper side of the display panel 100 is relatively higher-ranged than the sound generated in the lower side of the display panel so that it may be possible to generate the higher-ranged sound.

Figure 17H:
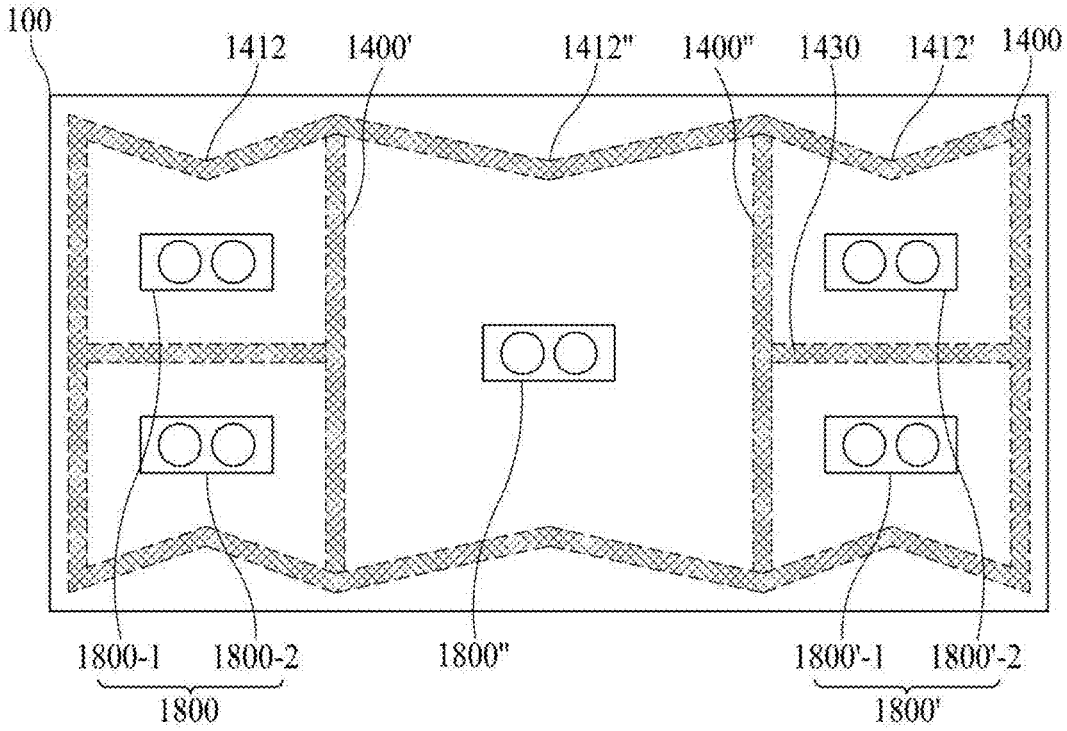

With reference to FIG. 17H, the first sound generating device 1800 including one pair of sub sound generating modules 1800-1 and 1800-2 is disposed in the first area. The second sound generating device 1800' including one pair of sub sound generating modules 1800'-1 and 1800'-2 is disposed in the second area. The third sound generating device 1800" including one pair of sound generating devices is disposed in the third area.

The first partition 1400' is disposed between the first sound generating device 1800 and the third sound generating device 1800", and the second partition 1400" is disposed between the second sound generating device 1800' and the third sound generating device 1800". The third partition 1400 is formed in the edge of the display panel 100, wherein the third partition 1400 is formed in the sealed structure.

Also, each fourth partition 1430 is disposed between each of the two sub sound generating modules 180-1 and 1800-2 included in the first sound generating device 1800 of the first area, and between each of the two sub sound generating modules 1800'-1 and 1800'-2 included in the second sound generating device 1800' of the second area. The fourth partition 1430 of the first area separates the high-range sound and the middle-range sound respectively generated in the 1-1 sub sound generating module 1800-1 and the 1-2 sub sound generating module 1800-2 included in the first sound generating device 1800 from each other, to thereby realize more-improved sound output properties. The fourth partition 1430 of the second area separates the high-range sound and the middle-range sound respectively generated in the 2-1 sub sound generating module 1800'-1 and the 2-2 sub sound generating module 1800'-2 included in the second sound generating device 1800' from each other, to thereby realize the more-improved sound output properties.

The first bent portion 1412 is provided in the first area, wherein the first bent portion 1412 is bent toward the center of the two sub sound generating modules 1800-1 and 1800-2 in the first area. The second bent portion 1412' is provided in the second area, wherein the second bent portion 1412 is bent toward the center of the two sub sound generating modules 1800'-1 and 1800'-2 in the second area. The third bent portion 1412" is provided in the third area, wherein the third bent portion 1412" is bent toward the center of the third sound generating device 1800" with one pair of sound generating devices.

As described in FIG. 17A, the protrusion portion, which protrudes toward the third sound generating device 1800", may be formed in the left and right sides of the third area, that is, in each of the first partition 1400' and the second partition 1400".

In FIG. 17H, the first sound generating device 1800 is disposed in the center of the left area corresponding to the first area of the display panel 100, but is not limited to this structure. The first sound generating device 1800 may be disposed asymmetrically. In detail, the first sound generating device 1800 may be disposed more toward the left area corresponding to the first area of the display panel 100. The second sound generating device 1800' is disposed in the center of the right area corresponding to the second area of the display panel 100, but is not limited to this structure. The second sound generating device 1800' may be disposed asymmetrically. In detail, the second sound generating device 1800' may be disposed more toward the right area corresponding to the second area of the display panel 100. Accordingly, one of the first sound generating device 1800 and the second sound generating device 1800' may be disposed asymmetrically. In detail, at least one of the first sound generating device 1800 and the second sound generating device 1800' may be disposed more toward the left area or right area of the display panel 100, or each of the first sound generating device 1800 and the second sound generating device 1800' may be disposed more toward the left area and right area of the display panel 100.

With reference to FIG. 17H, the first sound generating device 1800 disposed in the first area, and the second sound generating device 1800' disposed in the second area may generate the middle-range and high-range sound, and the third sound generating device 1800" disposed in the third area may generate the low-range sound. In detail, the 1-1 sub sound generating module 1800-1 corresponding to one of the two sub sound generating modules 1800-1 and 1800-2 included in the first sound generating device 1800 of the first area may generate the high-range sound, and the 1-2 sub sound generating module 1800-2 corresponding to the other of the two sub sound generating modules 1800-1 and 1800-2 included in the first sound generating device 1800 of the first area may generate the middle-range sound. The 2-1 sub sound generating module 1800'-1 corresponding to one of the two sub sound generating modules 1800'-1 and 1800'-2 included in the second sound generating device 1800' of the second area may generate the high-range sound, and the 2-2 sub sound generating module 1800'-2 corresponding to the other of the two sub sound generating modules 1800'-1 and 1800'-2 included in the second sound generating device 1800' of the second area may generate the middle-range sound. The sound generated in the upper side of the display panel 100 is relatively higher-ranged than the sound generated in the lower side of the display panel so that it may be possible to generate the higher-ranged sound.

Figure 17I:
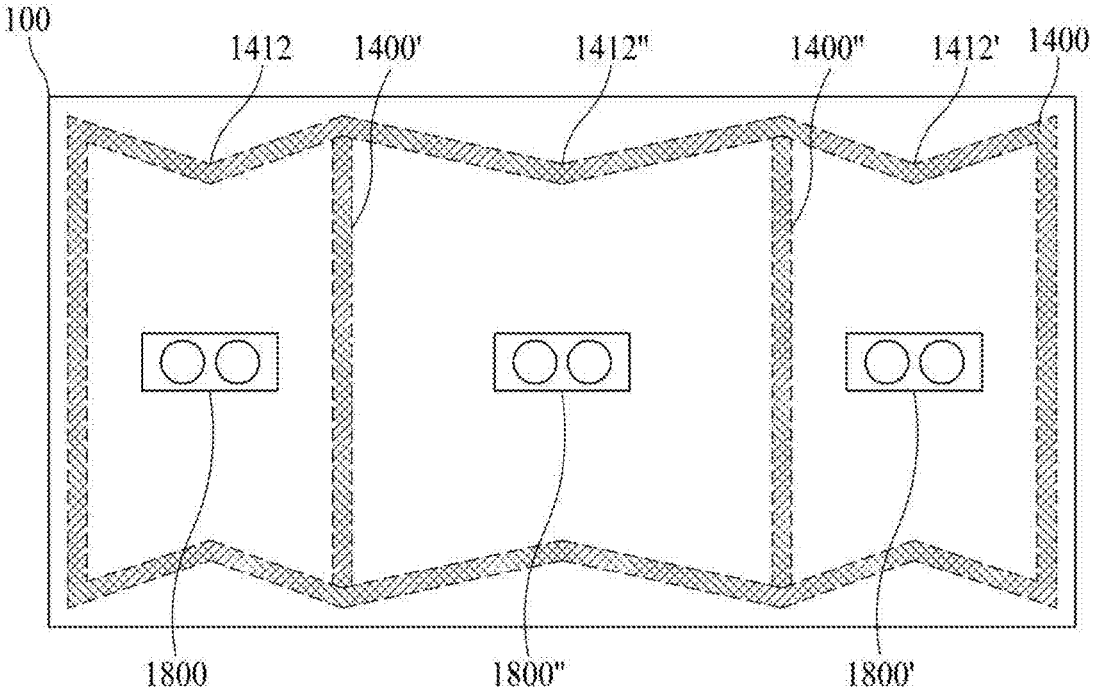

With reference to FIG. 17I, the first sound generating device 1800 including one pair of sound generating devices is disposed in the first area, the second sound generating device 1800' including one pair of sound generating devices is disposed in the second area, and the third sound generating device 1800" including one pair of sound generating devices is disposed in the third area.

The first sound generating device 1800 disposed in the first area, and the second sound generating device 1800' disposed in the second area may generate the middle-range and high-range sound, and the third sound generating device 1800" disposed in the third area may generate the low-range sound.

The first partition 1400' is disposed between the first sound generating device 1800 and the third sound generating device 1800", and the second partition 1400" is disposed between the second sound generating device 1800' and the third sound generating device 1800". The third partition 1400 is formed in the edge of the display panel 100, wherein the third partition 1400 is formed in the sealed structure.

The first bent portion 1412 is provided in the first area, wherein the first bent portion 1412 is bent toward the center of the first sound generating device 1600 with one pair of sound generating devices. The second bent portion 1412' is provided in the second area, wherein the second bent portion 1412' is bent toward the center of the second sound generating device 1800' with one pair of sound generating devices. The third bent portion 1412" is provided in the third area, wherein the third bent portion 1412" is bent toward the center of the third sound generating device 1800" with one pair of sound generating devices.

As shown in FIG. 17A, the protrusion portion, which protrudes toward the third sound generating device 1800", may be formed in the left and right sides of the third area, that is, in each of the first partition 1400' and the second partition 1400".

In FIG. 17I, the first sound generating device 1800 is disposed in the center of the left area corresponding to the first area of the display panel 100, but is not limited to this structure. The first sound generating device 1800 may be disposed asymmetrically. In detail, the first sound generating device 1800 may be disposed more toward the left area corresponding to the first area of the display panel 100. The second sound generating device 1800' is disposed in the center of the right area corresponding to the second area of the display panel 100, but is not limited to this structure. The second sound generating device 1800' may be disposed asymmetrically. In detail, the second sound generating device 1800' may be disposed more toward the right area corresponding to the second area of the display panel 100. Accordingly, one of the first sound generating device 1800 and the second sound generating device 1800' may be disposed asymmetrically. In detail, at least one of the first sound generating device 1800 and the second sound generating device 1800' may be disposed more toward the left area or right area of the display panel 100, or each of the first sound generating device 1800 and the second sound generating device 1800' may be disposed more toward the left area and right area of the display panel 100.

Figure 17J:
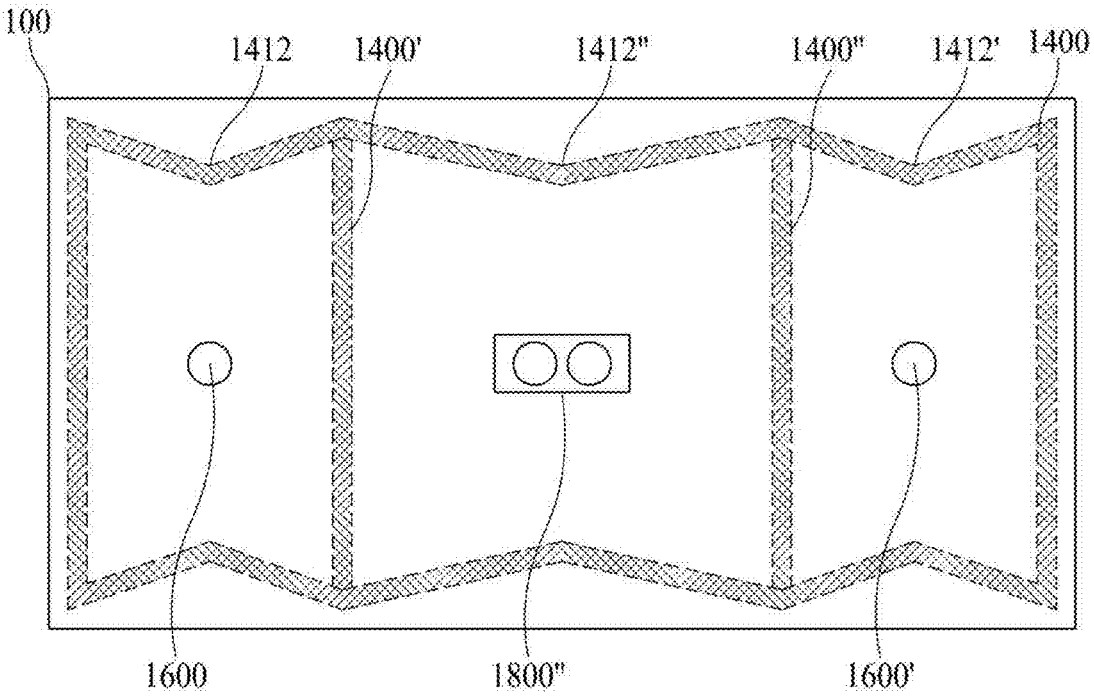

With reference to FIG. 17J, the first sound generating device 1600 is disposed in the first area, the second sound generating device 1600' is disposed in the second area, and the third sound generating device 1800" including one pair of sound generating devices is disposed in the third area.

The first sound generating device 1600 disposed in the first area, and the second sound generating device 1600' disposed in the second area may generate the middle-range and high-range sound, and the third sound generating device 1800" disposed in the third area may generate the low-range sound.

The first partition 1400' is disposed between the first sound generating device 1600 and the third sound generating device 1800", and the second partition 1400" is disposed between the second sound generating device 1600' and the third sound generating device 1800". The third partition 1400 is formed in the edge of the display panel 100, wherein the third partition 1400 is formed in the sealed structure.

The first bent portion 1412 is provided in the first area, wherein the first bent portion 1412 is bent toward the center of the first sound generating device 1800. The second bent portion 1412' is provided in the second area, wherein the second bent portion 1412' is bent toward the center of the second sound generating device 1600'. The third bent portion 1412" is provided in the third area, wherein the third bent portion 1412" is bent toward the center of the third sound generating device 1800" with one pair of sound generating devices.

As shown in FIG. 17A, the protrusion portion, which protrudes toward the third sound generating device 1800", may be formed in the left and right sides of the third area, that is, in each of the first partition 1400' and the second partition 1400".

In FIG. 17I, the first sound generating device 1600 is disposed in the center of the left area corresponding to the first area of the display panel 100, but is not limited to this structure. The first sound generating device 1600 may be disposed asymmetrically. In detail, the first sound generating device 1600 may be disposed more toward the left area corresponding to the first area of the display panel 100. The second sound generating device 1600' is disposed in the center of the right area corresponding to the second area of the display panel 100, but not limited to this structure. The second sound generating device 1600' may be disposed asymmetrically. In detail, the second sound generating device 1600' may be disposed more toward the right area corresponding to the second area of the display panel 100. Accordingly, one of the first sound generating device 1600 and the second sound generating device 1600' may be disposed asymmetrically. In detail, at least one of the first sound generating device 1600 and the second sound generating device 1600' may be disposed more toward the left area or right area of the display panel 100, or each of the first sound generating device 1600 and the second sound generating device 1600' may be disposed more toward the left area and right area of the display panel 100.

For the above description of FIGS. 17A to 17J, each of the first bent portion 1412, the second bent portion 1412', and the third bent portion 1412" of the third partition 1400 provided in the edge of the display panel 100 is formed in the sealed structure, but they are not limited to this structure. For example, as shown in FIG. 12F, at least one of the first bent portion 1412, the second bent portion 1412', and the third bent portion 1412" may be formed in the unsealed structure.

As described above, the display apparatus according to an example embodiment of the present disclosure includes the insulation member disposed between the display panel and the sound generating device so that it may be possible to prevent the heat generated by the operation of the sound generating device from being transferred to the display panel.

The following Table 1 shows results of front temperature of the display panel for the operation of the sound generating device in the display apparatus according to an example embodiment of the present disclosure and each display apparatus according to a comparative example.

TABLE 1

| | Sample 1 | Sample 2 |
|---|---|---|
| Tpanel | 65° C. | 57° C. |

The above Table 1 is obtained by measuring the front temperature (Tpanel) of the display panel after operating the sound generating device for one hour under the sound output condition of 10 W. As shown in the above Table 1, the front temperature of the display panel in the display apparatus according to the comparative example (Sample 1) is about 65° C. Meanwhile, the front temperature of the display panel in the display apparatus according to an example embodiment of the present disclosure (Sample 2) is about 57° C. Accordingly, the display apparatus according to the present disclosure includes the insulation member so that it may be possible to restrict or limit the temperature rise of the display panel caused by the heat generated for the operation of the sound generating device, to thereby prevent deterioration of picture quality in the display panel by the sudden temperature change in the local area of the display panel overlapped with the sound generating device.

According to an embodiment of the present disclosure, the display apparatus includes the display panel for displaying an image, the rear structure disposed on the rear surface of the display panel, the sound generating device, which is fixed to the rear structure, for vibrating the display panel, and the insulation member provided between the display panel and the sound generating device and provided to restrict the temperature rise of the display panel caused by heat generated in the sound generating device.

Also, the insulation member includes the air gap provided between the display panel and the sound generating device.

Furthermore, the display apparatus includes the first adhesion member provided between the display panel and the sound generating device, wherein the insulation member provides the closed space between the first adhesion member and the sound generating device.

At this time, the sound generating device includes the module frame fixed to the rear structure, the bobbin having a hollow, the bobbin connected with the insulation member, the magnet member inserted into the hollow of the bobbin or provided to surround the bobbin, the coil wound on the bobbin, the center pole for elevating the bobbin, and the damper provided between the module frame and the bobbin.

Also, the insulation member includes the central portion provided to cover the hollow of the bobbin and provided at a predetermined interval from the rear surface of the display panel, the sidewall portion for supporting an edge of the central portion, and the peripheral portion connected with one end of the bobbin so as to support the sidewall portion.

At this time, the insulation member is connected with the rear surface of the display panel by the use of first adhesion member, and the insulation member provides the closed space between the central portion and the first adhesion member.

According to an example embodiment of the present invention, the insulation member is formed of rubber, silicon, fiber reinforced plastics, complex resin including fiber reinforced plastics, metal, or their mixture.

In addition, the display apparatus further includes the heat-radiation member provided between the display panel and the insulation member.

Also, the display apparatus further includes at least one partition disposed between the display panel and the rear structure so as to divide the rear surface of the display panel into two or more rear areas, wherein the sound generating device is disposed in each of the two or more rear areas.

Also, the display apparatus further includes at least two insulation members provided in each of the two rear areas, and at least one heat-radiation member provided between the insulation member and the display panel.

Also, the display apparatus further includes at least one low-range sound generating device provided at a predetermined interval from the display panel.

According to an example embodiment of the present disclosure, the display panel includes the central area, the left area, and the right area, and wherein the partition includes the first partition for separating the central area of the display panel and the left area of the display panel from each other, the second partition for separating the central area of the display panel and the right area of the display panel from each other, and the third partition for surrounding the rear edge of the display panel.

At this time, third partition includes four sides, and the bent portion provided in the first side among the four sides, wherein the bent portion is bent toward the sound generating device.

Also, the third partition includes the protrusion portion provided in at least one side of the first side and the second side, wherein the first side is provided with the bent portion, and the second side is perpendicular to the first side.

According to an example embodiment of the present disclosure, the sound generating device disposed in each of the left and right areas of the display panel generates middle-range and high-range sound, and the sound generating device disposed in the central area of the display panel generates low-range sound.

The sound generating device according to an example embodiment of the present disclosure includes at least one sound generating module or at least one pair of sound generating modules. For example, at least one sound generating module is disposed in each of the left and right areas of the display panel, and at least one pair of sound generating modules is disposed in the central area of the display panel. For example, at least one sound generating module includes two sub sound generating modules, and each of the two sub sound generating modules generates middle-range and high-range sound.

According as the display apparatus according to the present disclosure includes the sound generating device which vibrates the display panel so as to generate sound, it may be possible to output the sound to the front direction of the display panel, and furthermore, to enhance a user's sense of immersion.

Also, the display apparatus according to the present disclosure includes the insulation member between the display panel and the sound generating device so that it may be possible to prevent the heat generated by the operation of the sound generating device from being transferred to the display panel.

According to an example embodiment of the present disclosure, the display apparatus may include a display panel configured to emit light, a rear structure disposed on a rear surface of the display panel, a sound generating device fixed to the rear structure and configured to vibrate the display panel, and an insulation member disposed between the display panel and the sound generating device.

Furthermore, the insulation member may include an air gap between the display panel and the sound generating device.

Also, the display apparatus may further include a first adhesion member between the display panel and the sound generating device, wherein the insulation member provides the air gap between the first adhesion member and the sound generating device.

Additionally, the sound generating device may include a module frame fixed to the rear structure, a bobbin having a hollow, the bobbin connected with the insulation member, a magnet member in the hollow of the bobbin or surrounding the bobbin, a coil wound on the bobbin, a center pole configured to elevate the bobbin, and a damper between the module frame and the bobbin.

Furthermore, the sound generating device may include a bobbin having a hollow, the bobbin connected with the insulation member, and the insulation member may include a central portion to cover the hollow of the bobbin, the central portion at a predetermined interval from the rear surface of the display panel, a sidewall portion at an edge of the central portion, and a peripheral portion connected with one end of the bobbin and at the sidewall portion.

Additionally, the central portion of the insulation member may be disposed inside the hollow of the bobbin.

Also, the insulation member may include an air gap between the display panel and the sound generating device, and the central portion of the insulation member may face the rear surface of the display panel with the air gap between the central portion of the insulation member and the rear surface of the display panel.

Furthermore, the display apparatus may further include a first adhesion member between the display panel and the sound generating device, wherein the insulation member provides an air gap between the first adhesion member and the sound generating device, and wherein the insulation member is connected with the rear surface of the display panel by the first adhesion member, and the insulation member provides the air gap between the central portion and the first adhesion member.

Additionally, the display apparatus may further include a first connection member in the bobbin, and a second connection member in the insulation member and connected with the first connection member.

Also, the first connection member may include a hole, groove, or protrusion in the bobbin, and the second connection member may include a hole, groove, or protrusion in the insulation member to be connected with the first connection member.

Furthermore, the insulation member may be formed of at least one of rubber, silicon, fiber reinforced plastics, complex resin including fiber reinforced plastics, or metal, or their mixture.

Additionally, the display apparatus may further include a heat-radiation member between the display panel and the insulation member.

Also, the display apparatus may further include at least one partition disposed between the display panel and the rear structure to divide the rear surface of the display panel into two or more rear areas, wherein the sound generating device is disposed in each of the two or more rear areas, and at least two insulation members provided in the two or more rear areas, and at least one heat-radiation member between the insulation members and the display panel.

Furthermore, the insulation member may be provided to restrict a temperature rise of the display panel caused by heat generated in the sound generating device.

Additionally, the sound generating device may include a bobbin having a hollow, the bobbin connected with the insulation member, and the insulation member may cover the hollow of the bobbin.

Also, the insulation member may include an air gap between the display panel and the sound generating device, and the insulation member may face the display panel with the air gap therebetween.

According to an example embodiment of the present disclosure, a sound generator for a display panel configured to emit light may include a sound generating device configured to vibrate the display panel, and an insulation member disposed on the sound generating device, wherein the sound generating device includes a bobbin having a hollow, the bobbin connected with the insulation member.

Furthermore, the insulation member may cover the hollow of the bobbin.

Also, the insulation member may include an air gap between the display panel and the sound generating device, and the insulation member may face the display panel with the air gap therebetween.

It will be apparent to those skilled in the art that various modifications and variations can be made in the present disclosure without departing from the spirit or scope of the disclosures. Thus, it is intended that the present disclosure covers the modifications and variations of this disclosure provided they come within the scope of the appended claims and their equivalents.

What is claimed is:

1. A display apparatus, comprising:

a display panel configured to emit light;

a rear structure disposed on a rear surface of the display panel;

a sound generating device in the rear structure and configured to vibrate the display panel, wherein the sound generating device includes a bobbin; and a heat-radiation member disposed between the display panel and the bobbin.

2. The display apparatus according to claim 1, further comprising:

an insulation member disposed between the display panel and the bobbin.

3. The display apparatus according to claim 2, wherein:

the bobbin has a hollow, and the bobbin is connected with the insulation member; and the insulation member includes:

a central portion to cover the hollow of the bobbin, the central portion at a predetermined interval from the rear surface of the display panel;

a sidewall portion at an edge of the central portion; and a peripheral portion connected with one end of the bobbin and at the sidewall portion.

4. The display apparatus according to claim 3, wherein the central portion of the insulation member is disposed inside the hollow of the bobbin.

5. The display apparatus according to claim 3, wherein the peripheral portion covers an upper surface of the bobbin.

6. The display apparatus according to claim 2, wherein the insulation member includes an air gap between the display panel and the sound generating device.

7. The display apparatus according to claim 6, further comprising:

a first adhesion member between the display panel and the sound generating device, wherein the insulation member provides the air gap between the first adhesion member and the sound generating device.

8. The display apparatus according to claim 2, wherein the sound generating device further includes:

a module frame in the rear structure;

the bobbin having a hollow, the bobbin connected with the insulation member;

a magnet member in the hollow of the bobbin or surrounding the bobbin;

a coil wound on the bobbin;

a center pole configured to elevate the bobbin; and a damper between the module frame and the bobbin.

9. The display apparatus according to claim 2, wherein:

the insulation member includes an air gap between the display panel and the sound generating device; and a central portion of the insulation member faces the rear surface of the display panel with the air gap between the central portion of the insulation member and the rear surface of the display panel.

10. The display device according to claim 9, wherein:

the insulation member includes the air gap between the display panel and the sound generating device; and the insulation member faces the display panel with the air gap therebetween.

11. The display apparatus according to claim 2, further comprising:

a first adhesion member between the display panel and the sound generating device, wherein the insulation member provides an air gap between the first adhesion member and the sound generating device; and wherein the insulation member is connected with the rear surface of the display panel by the first adhesion member, and the insulation member provides the air gap between a central portion of the insulation member and the first adhesion member.

12. The display apparatus according to claim 11, further comprising:

a first connection member in the bobbin; and a second connection member in the insulation member and connected with the first connection member.

13. The display apparatus according to claim 12, wherein the first connection member includes a hole, a groove, or a protrusion in the bobbin, and the second connection member includes a hole, a groove, or a protrusion in the insulation member to be connected with the first connection member.

14. The display apparatus according to claim 2, wherein the insulation member includes at least one of rubber, silicon, fiber reinforced plastics, complex resin including fiber reinforced plastics, and metal, or their mixture.

15. The display apparatus according to claim 2, wherein the heat-radiation member is between the display panel and the insulation member.

16. The display apparatus according to claim 2, further comprising:

a partition disposed between the display panel and the rear structure to divide the rear surface of the display panel into two or more rear areas, wherein the sound generating device is disposed in each of the two or more rear areas; and two insulation members provided in the two or more rear areas, and the heat-radiation member between the insulation members and the display panel.

17. The display apparatus according to claim 2, wherein the insulation member is configured to restrict a temperature rise of the display panel caused by heat generated in the sound generating device.

18. The display device according to claim 2, wherein:

the sound generating device includes the bobbin having a hollow, the bobbin connected with the insulation member; and the insulation member covers the hollow of the bobbin.

19. The display device according to claim 2, wherein the insulation member further includes a peripheral portion and a skirt portion.

20. The display device according to claim 19, wherein the skirt portion is vertically connected with a rear edge of the peripheral portion.

21. The display apparatus according to claim 1, wherein a size of the heat-radiation member is larger than a size of the sound generating device.

22. The display apparatus according to claim 1, wherein the heat-radiation member includes a heat-radiation sheet or a heat-radiation tape.

23. A sound generator for a display panel configured to emit light, comprising:

a sound generating device configured to vibrate the display panel; and a heat-radiation member disposed on the sound generating device, wherein the sound generating device includes a bobbin having a hollow; and wherein the heat-radiation member is disposed between the display panel and the bobbin.

24. The sound generator according to claim 23, further comprising:

an insulation member disposed between the display panel and the bobbin.

25. The sound generator according to claim 24, wherein:

the insulation member covers the hollow of the bobbin.

26. The sound generator according to claim 24, wherein:

the insulation member further includes an air gap between the display panel and the sound generating device; and the insulation member faces the display panel with the air gap therebetween.

27. The sound generator according to claim 24, wherein:

the insulation member includes:

a central portion to cover the hollow of the bobbin, the central portion at a predetermined interval from a rear surface of the display panel;

a sidewall portion at an edge of the central portion; and the peripheral portion connected with one end of the bobbin and at the sidewall portion.

28. The sound generator according to claim 27, wherein the central portion of the insulation member is disposed inside the hollow of the bobbin.

29. The sound generator according to claim 27, wherein the peripheral portion covers an upper surface of the bobbin.

30. The sound generator according to claim 24, wherein:

the insulation member includes an air gap between the display panel and the sound generating device; and a central portion of the insulation member faces a rear surface of the display panel with the air gap between the central portion of the insulation member and the rear surface of the display panel.

31. The sound generator according to claim 24, further comprising:

a first adhesion member between the display panel and the sound generating device, wherein the insulation member provides an air gap between the first adhesion member and the sound generating device; and wherein the insulation member is connected with a rear surface of the display panel by the first adhesion member, and the insulation member provides the air gap between a central portion of the insulation member and the first adhesion member.

32. The sound generator according to claim 31, further comprising:

a first connection member in the bobbin; and a second connection member in the insulation member and connected with the first connection member.

33. The sound generator according to claim 32, wherein the first connection member includes a hole, a groove, or a protrusion in the bobbin, and the second connection member includes a hole, a groove, or a protrusion in the insulation member to be connected with the first connection member.

34. The display device according to claim 24, wherein the insulation member further includes a peripheral portion and a skirt portion.

35. The sound generator according to claim 34, wherein the skirt portion is vertically connected with a rear edge of the peripheral portion.

36. The sound generator according to claim 23, wherein a size of the heat-radiation member is larger than a size of the sound generating device.

37. The sound generator according to claim 23, wherein the heat-radiation member includes a heat-radiation sheet or a heat-radiation tape.

38. A display apparatus, comprising:

a display panel configured to emit light;

a rear structure disposed on a rear surface of the display panel;

a sound generating device in the rear structure and configured to vibrate the display panel, wherein the sound generating device includes a bobbin; and an insulation member disposed between the display panel and the bobbin, wherein:

the bobbin has a hollow, and the bobbin is connected with the insulation member;

the insulation member includes:

a central portion to cover the hollow of the bobbin, the central portion at a predetermined interval from the rear surface of the display panel;

a sidewall portion at an edge of the central portion; and a peripheral portion connected with one end of the bobbin and at the sidewall portion; and the peripheral portion covers an upper surface of the bobbin.

* * * * *